US011679525B2

(12) United States Patent
McRoberts et al.

(10) Patent No.: US 11,679,525 B2
(45) **Date of Patent: *Jun. 20, 2023**

(54) LOW PROFILE CHAINSAW

(71) Applicant: Black & Decker, Inc., New Britain, CT (US)

(72) Inventors: Jason C. McRoberts, Red Lion, PA (US); Ashok Samuel Baskar, Lutherville, MD (US); Mark D. Miller, Fawn Grove, PA (US); Lin Wu, Jiangsu Province (CN); Jianyi Liu, Jiangsu Province (CN); Corey Barnett, Bowie, MD (US); Chao Wu, Jiangsu Province (CN)

(73) Assignee: Black & Decker, Inc., New Britain, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/109,798

(22) Filed: Dec. 2, 2020

(65) Prior Publication Data

US 2021/0086394 A1 Mar. 25, 2021

Related U.S. Application Data

(63) Continuation of application No. 14/928,215, filed as application No. PCT/CN2015/087366 on Aug. 18, 2015, now Pat. No. 10,882,206.

(51) Int. Cl.

| | |
|---|---|
| ***B27B 17/14*** | (2006.01) |
| ***B27B 17/00*** | (2006.01) |
| ***B27B 17/10*** | (2006.01) |

(52) U.S. Cl.
CPC ..... *B27B 17/14* (2013.01); *B27B 17/00* (2013.01); *B27B 17/10* (2013.01)

(58) Field of Classification Search
CPC ..... Y10T 83/04; Y10T 83/909; B27B 17/14; B27B 17/00; B27B 17/10; B27B 17/02
USPC ..... 30/381, 383, 386
See application file for complete search history.

(56) References Cited

U.S. PATENT DOCUMENTS

| | | | | |
|---|---|---|---|---|
| 2,556,790 A * | 6/1951 | Berdan | ..... | A01D 43/16 56/2 |
| 6,105,263 A * | 8/2000 | Stones | ..... | B27B 17/083 30/382 |
| 6,237,228 B1 * | 5/2001 | Moody | ..... | B27B 17/14 30/381 |
| 2006/0196058 A1 * | 9/2006 | Warfel | ..... | B27B 17/14 30/381 |

* cited by examiner

*Primary Examiner* — Phong H Nguyen
(74) *Attorney, Agent, or Firm* — John Yun

(57) ABSTRACT

A chainsaw which has a low profile chain cover and a chain bar tightening clutch system. The chain bar tightening clutch system can have a bar tightening knob which drives a clutch which governs the amount of pressure applied to the chain bar by operating the bar tightening knob. The chainsaw can have a chain bar tensioning system which can have a tensioning drive member in an offset position from the tensioning post which positions the tensioning post to achieve a chain tension and compact chainsaw design. The chainsaw can also have an oil cap with a lock channel having a detent with produces a sound when moved from a disengaged to an engage position with an oil reservoir.

12 Claims, 37 Drawing Sheets

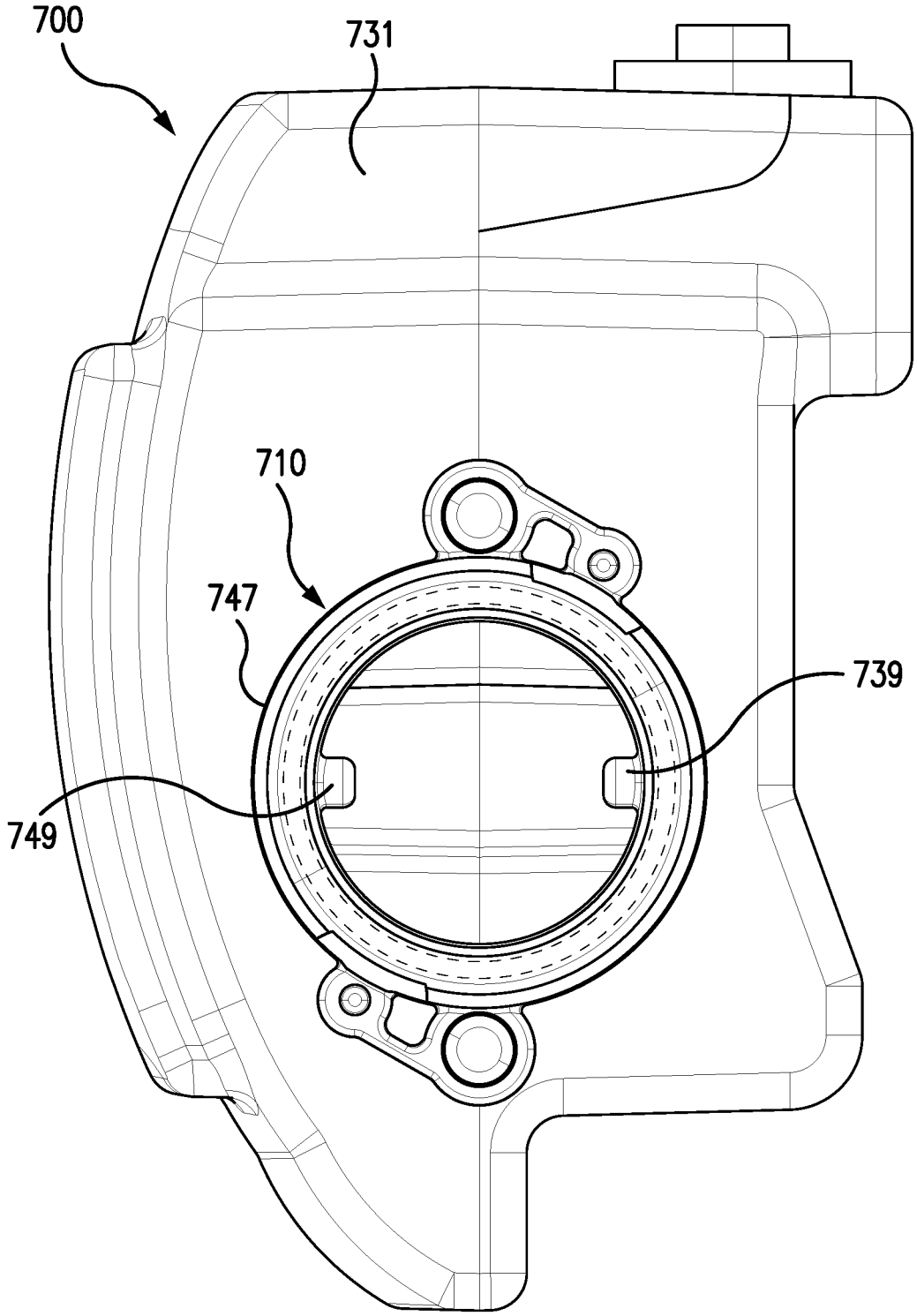
FIG. 13B1

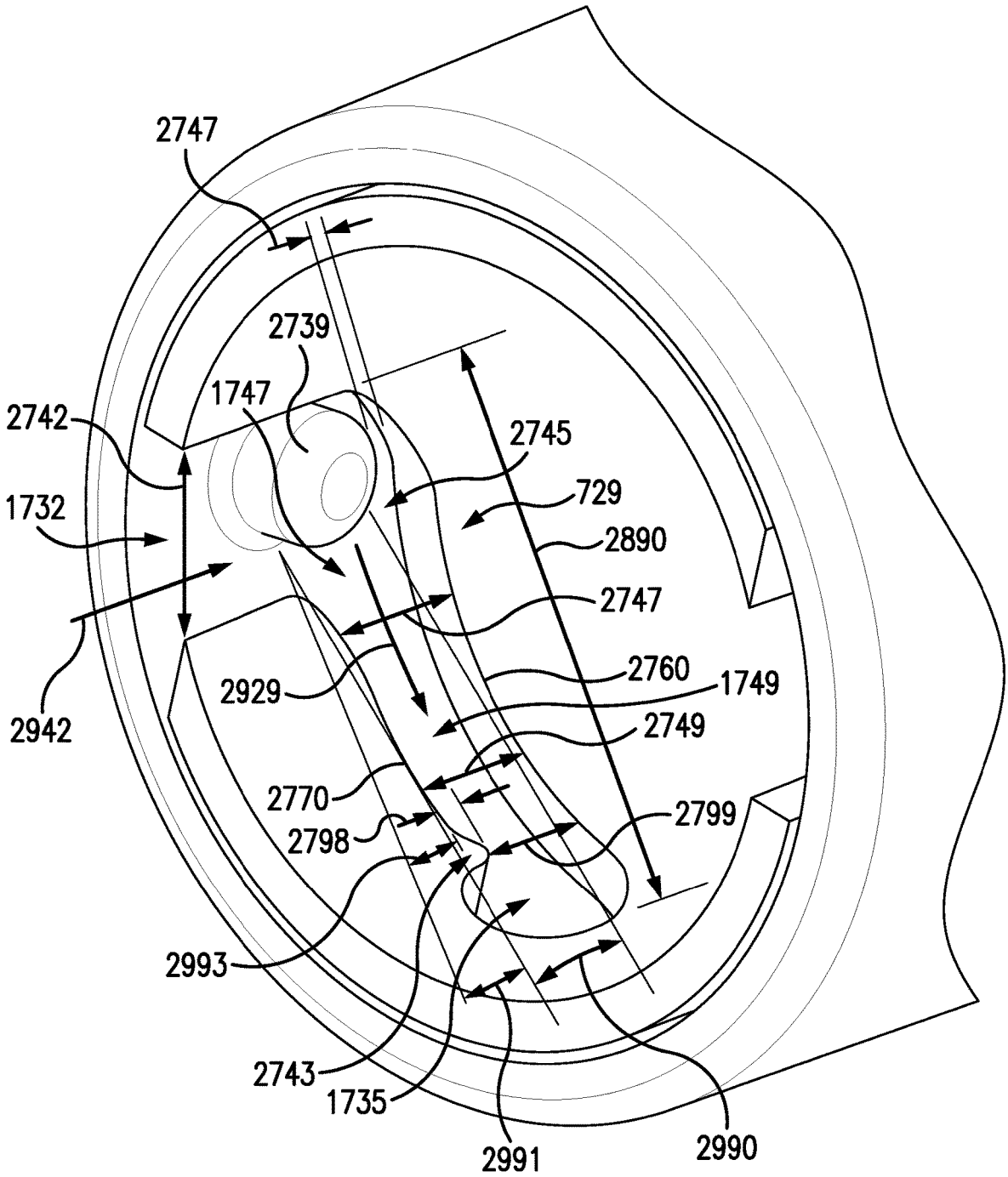
FIG. 14D1

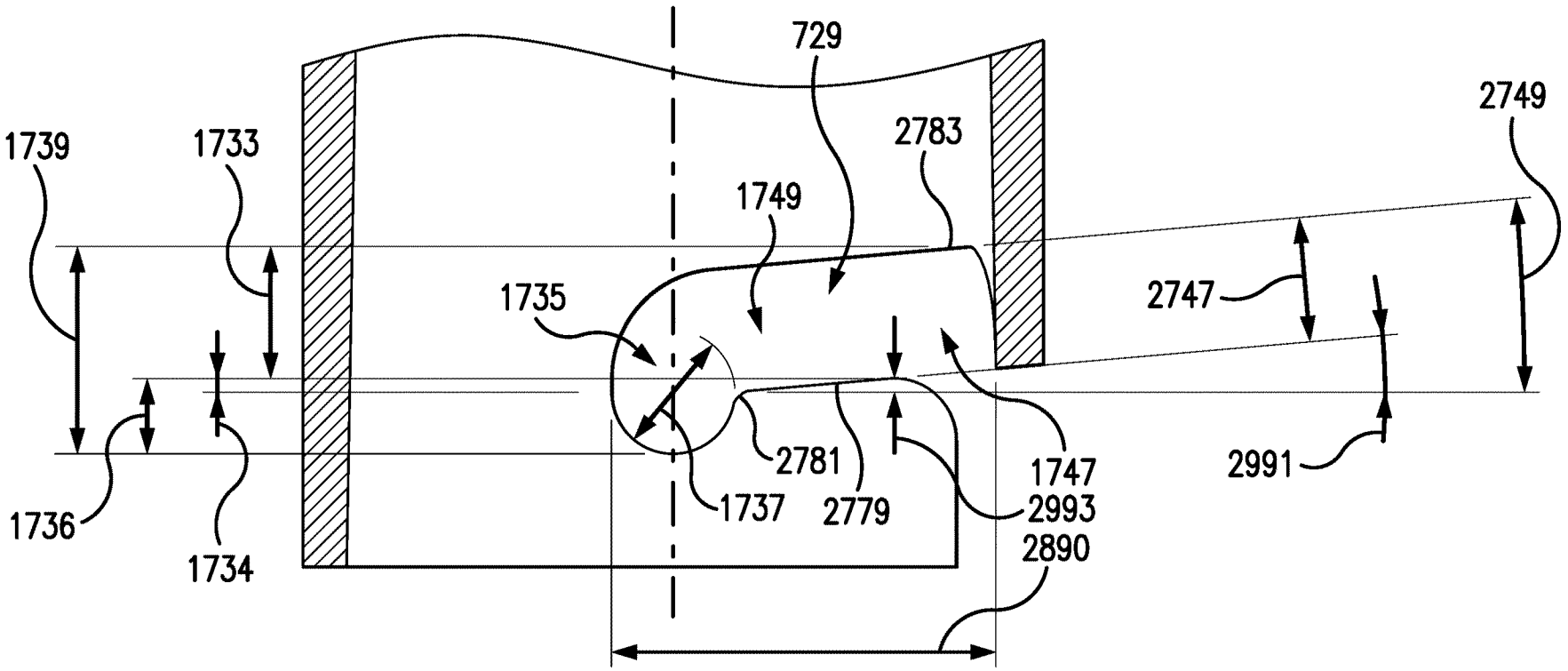
FIG. 14D2

LOW PROFILE CHAINSAW

CROSS-REFERENCE TO RELATED APPLICATION

This patent application is a continuation of application Ser. No. 14/928,215 entitled "Low Profile Chainsaw" filed Oct. 30, 2015, which claims benefit of PCT Application No. PCT/CN2015/087366 entitled "Low Profile Chainsaw" filed Aug. 18, 2015, which are herein incorporated by reference in their entirety.

FIELD OF THE INVENTION

This invention in its several and varied embodiments regards chainsaw technology.

BACKGROUND OF THE INVENTION

Chainsaws suffer from problems associated with bulky size, high weight and inadequate dependability, as well as from poor efficiency in maintenance and difficulties in use. Chainsaws have chain covers which are large, bulky and which prevent an operator from making saw cuts close to a fixed object, such as close to the ground, or a tree trunk, or another fixed surface. Additionally, an operator can overtighten a chain bar which can result in deforming the chain bar, equipment damage, shortened tool life and/or pinching of the chain. Chainsaws further suffer from inadequate tensioning systems which increase chainsaw size and are inaccurate to operate. Chainsaw oil caps leak, can be lost, are clumsy to operate and add to chainsaw bulk and size problems.

SUMMARY OF THE INVENTION

Applicant's invention in its several and varied embodiments significantly improves the technology of chainsaws. In an embodiment, a chain bar clutch system for a chainsaw can have a chainsaw housing with a motor therein. A chain bar can be secured to the chainsaw housing and operatively connected to the motor. A chain cover can be used to secure the chain bar to the chainsaw housing. A clutch system can be used to control the force exerted by the chain cover against the chain bar.

In an embodiment, the clutch system can have a clutch plate that urges the chain cover against the chain bar. The clutch plate is capable of slipping to prevent overtightening of the chain bar. The clutch system can also have a tightening knob engaging the clutch plate, the tightening knob can rotate the clutch plate in a first direction to tighten the chain cover against the chain bar when the force applied to the chain bar is below a predetermined level, and the tightening knob can experience slipping with respect to the clutch plate when the force applied to the chain bar is at or above the predetermined level.

In an embodiment, a chain bar tightening clutch system for a chainsaw can have a clutch having a tightening state and a clutch state (or "clutched state"). When in the tightening state, the clutch can communicate a force to at least a portion of a chain cover and can move the chain cover to impart a pressing force to at least a portion of a chain bar. When in the tightening state, the clutch can communicate an increasing force to the at least a portion of chain cover until the clutch state is activated. When the clutch state is activated, the clutch can free at least a portion of the chain cover from receiving an additional force from the clutch.

In another embodiment, when in a tightening state, the clutch, or a portion of the clutch mechanism, can communicate a force to at least a portion of a chain bar. When in the tightening state, the clutch can communicate an increasing force to at least a portion of the chain bar until the clutch state is activated. When the clutch state is activated, the clutch frees at least a portion of the chain bar from receiving additional force from the clutch.

The bar tightening knob can engage the clutch plate and can impart a force to the clutch plate by means of one or more of a projecting member. In an embodiment, the projecting member can be a clutch tooth, or a plurality of clutch teeth. In an embodiment, the clutch plate can have pawls having an inclined face, the tightening knob can have teeth which each can have a corresponding inclined face that can engage respective pawl inclined faces, such that when the predetermined force level is reached, the pawl inclined face and teeth inclined face can rotate past one another.

The clutch plate can have a flexible member which is adapted to be moved by one or more of the projecting member. The flexible member activating a clutch condition when the one or more of the projecting member has a deflection angle of 5°, or greater. The projecting member is a clutch tooth and the flexible member is a spring finger. The chain bar tightening clutch system can have a clutch plate which can have a plurality of a spring finger which clutches when one or more of the spring finger has a deflection angle of 5°, or greater.

The chain bar clutch system can have a tightening knob which can be rotated in a second direction, opposite of a first direction, such that the clutch plate loosens the force exerted by the chain cover against the chain bar. The chain bar clutch system can have a bar tightening bolt extending from the chainsaw housing through a groove in the chain bar to engage the tightening knob. The clutch plate connector can be reversibly engaged with the bar tightening bolt such that when the clutch is in the tightening state, rotating the bar tightening knob in a tightening direction can rotate the clutch plate in a tightening direction and rotate the clutch plate connector in a tightening direction. In an embodiment, the chain bar tightening clutch system can have a threaded portion configured to be screwed onto a plurality of bolt threads of a bar tightening bolt, the threaded portion being screwed further onto the bar tightening bolt when the clutch system is not in a clutch state.

Rotating the clutch plate connector in a tightening direction can cause the clutch plate connector to move along the bar tightening bolt length toward a chain bar backstop; and when the clutch plate connector moves toward the chain bar backstop, the clutch plate imparts a force to at least a portion of a chain cover moving the chain cover toward at least a portion of the chain bar.

A bar tightening knob for a chainsaw can have a tightening knob body and a clutch. The bar tightening knob body can have a member configured to impart a force to a clutch plate. The clutch plate can be configured to reversibly engage with a bar tightening bolt. The chain cover can optionally have a clutch plate retention means.

When the clutch is in the tightening state, at least a portion of the chain cover can receive a force imparted by the clutch plate which can force at least a portion of the chain cover to exert a compressive force against at least a portion of the chain bar. When the clutch is in the tightening state the clutch plate can receive a torque in a range of 5 in-lbf to 150 in-lbf causing tightening to occur. Regarding clutching, which stops increased tightening, the clutch can have a clutch set point which is set to a torque of 10 in-lbf or greater. In another embodiment, clutching can occur at a torque of 15 in-lbf or greater. While tightening torques up to 150 in-lbf, or more may be desired in some uses, the clutch set point can be set at a desired torque at which the clutch will free the chain bar from experiencing greater tightening.

In an embodiment, the bar tightening knob can be adapted to have a recessed knob height which is less than a chain cover height. The tightening knob can have a tightening knob handle which is adapted to be recessed to a location of height at or below the chain cover height. Optionally, the chain cover has a chain cover height of 20 mm or less.

In an embodiment, a chain bar tightening clutch system can have a bar tightening knob which when turned can provide a driving force to a clutch plate. The clutch plate can impart a force which acts upon a chain bar contact portion. The chain bar contact portion can be adapted to impart a tightening force to at least a portion of a chain bar. The chain bar contact portion can impart a tightening force to at least a portion of a surface of a chain bar.

A chain bar tightening knob can comprise a clutch. The chain bar tightening knob can have a clutch plate. In an embodiment, the chain bar tightening knob can provide a driving force to a plurality clutch teeth which can engage and provide a driving force to at least a portion of the clutch plate when the bar tightening knob is turned. When in a tightening state, the plurality of clutch teeth can impart a force upon the clutch plate which can result in the radial movement of the clutch plate. When in a clutch state, the plurality of clutch teeth can impart a force upon the clutch plate which is sufficient to result in a clutching. In the clutch state, the force on the clutch plate does not result in radial movement of the clutch plate.

The chain bar tightening knob can have a chain bar tightening knob handle which can be pivoted to achieve a recessed state.

In an embodiment, a method of positioning a chain bar on a chainsaw can have the steps of: securing a chain bar to a chainsaw housing; positioning a chain cover over at least a portion of the chain bar so that the chain bar is located between the chain cover and the chainsaw housing; and providing a clutch system for applying a force against at least a portion of a chain bar, the force being limited by the clutch system.

The method of positioning a chain bar can use a clutch system which has a tightening knob, as well as the additional steps of: rotating the tightening knob in a first direction to increase the force applied to the chain bar; and communicating the force by at least a portion of the chain cover to the chain bar. Optionally, the method can use a clutch system which has a clutch plate having pawls with an inclined face, and the tightening knob can have corresponding teeth to the pawls. In an embodiment, the teeth can respectively have an inclined face, so that when the tightening knob is rotated in the first direction and a predetermined force level is reached, the clutching system is activated and the pawls rotate past the teeth.

In another embodiment, a method of chain bar positioning can have the steps of: applying a force against at least a portion of a chain bar; the force being limited by a clutch mechanism; and the force securing the at least a first portion of the chain bar at a location between at least a portion of a chain bar backstop and at least a portion of a chain cover. The method of chain bar positioning can further use the step of communicating the force by at least a portion of the chain cover to the chain bar. The method can also use the step of pressing at least a portion of the chain cover against at least a portion of the chain bar. Additionally, the method can use the step of communicating the force by at least a portion of the clutch mechanism to the chain bar. Optionally, the method of chain bar positioning can use the step of communicating the force by at least a portion of the clutch plate connector to the chain bar.

In an embodiment, method of chain bar positioning can activate the clutch to free the chain bar from receiving a tightening or pressing force above a torque of 20 in-lbf. In another embodiment, the method can activate the clutch to free a chain bar tightening knob to turn without imparting a tightening or pressing force above a torque of 20 in-lbf to the chain bar.

In an embodiment, the method can position the chain bar at the location between at least a portion of an oil feed to the chain bar and at least a portion of the chain cover. The chain bar can be located between at least a portion of a source of oil feed and at least a portion of the clutch mechanism. Optionally, the method of chain bar positioning can position the chain bar at a location which is between at least a portion of a source of oil feed and at least a portion of a clutch plate connector.

In an embodiment, a method for tightening a chain bar can have the steps of: applying a force to at least a portion of a chain bar; and the force communicated from a clutch mechanism to the at least a portion of a chain bar. The method for tightening a chain can further comprise the step of having the bar tightening knob communicate a first force to the clutch mechanism which communicates the force the clutch mechanism to the at least a portion of a chain bar when the clutch mechanism is in a tightening state.

The method for tightening a chain bar can further use a bar tightening knob which can communicate a first force to the clutch mechanism when in a tightening state, and which does not communicate the force to the at least a portion of a chain bar when the clutch mechanism is in a clutch state. The method for tightening a chain bar can also use the steps of providing the clutch mechanism having a clutch plate; and using the clutch plate to communicate the force to the at least a portion of a chain bar.

In an embodiment, the method can further comprise the step of providing a bar tightening knob having at least a portion of a clutch mechanism. The method can use a chain cover having at least a portion of a clutch mechanism. The method for tightening a chain bar can have the step of providing a chain cover having at least a portion of a bar tightening knob and at least a portion of a clutch mechanism.

In an embodiment, the method for tightening a chain bar can use the step of applying the force by pressing at least a portion of the chain cover against the at least a portion of a chain bar. In another embodiment, the method for tightening a chain bar can directly communicate at least a portion of the force from at least a portion of the chain cover to the at least a portion of a chain bar. In yet another embodiment, the method for tightening a chain bar can have the further step of indirectly communicating at least a portion of the force from at least a portion of the chain cover to the at least a portion of a chain bar.

In an embodiment, the method for securing a chain bar can apply a force to at least a portion of a chain bar, which force can be communicated from a clutch mechanism to the at least a portion of a chain bar. Additionally, the method for tightening a chain bar can have the steps of: providing the clutch mechanism having a connecting member adapted to screw onto a tensioning post; screwing the connecting member onto the tensioning post; and the clutch limiting application of the force to at least a portion of a chain bar.

In an embodiment, a chainsaw can have a chain bar tensioning system which can have an offset member configured to position a tensioning post. The offset member can be guided by a tensioning guide and driven by a tensioning drive member adapted to drive a movement of the offset member. The tensioning drive member can be located at an offset distance from the guide bar. In an embodiment, the tensioning drive member can have a tensioning shaft which is adapted to drive a movement of the offset member. In another embodiment, the tensioning drive member can have a rack and pinion adapted to drive a movement of the offset member.

In an embodiment, the tensioning guide can have a guide bar and an offset distance between the tensioning drive member and the guide bar. For nonlimiting example, the offset distance can have a value in a range of from 0.25 in to 5.0 in, or greater. In an embodiment, the offset distance can be a proximal offset distance having a value in a range of from 0.25 in to 5.0 in, or greater. In an embodiment, the offset distance can be a centerline offset distance having a value in a range of from 0.25 in to 5.0 in, or greater.

The chain bar tensioning system can have a tensioning post which can project from the offset member and which can have a travel distance of 0.25 in, or greater, or a value in a range of from 0.25 in to 4 in. The chain bar tensioning system can also have a tensioning drive member adapted to impart a torque to the tensioning post in a range of 1.0 in-lbf to 50 in-lbf.

In an embodiment, the chainsaw can have an oil cap having an oil cap body which can have at least one lock channel Optionally, the lock channel can have one or more of a detent which can reversibly allow clearance for a locking member's motion across a respective detent. In an embodiment, the oil cap can generate a sound when an operator moves the oil cap into a locked position. In an embodiment, the movement of an adapter post across a detent into the channel cavity can generate a sound greater than 30 dB, or in a range of from 30 dB to 80 dB, such as 30 dB, or 40 dB, or 50 dB, or 60 dB, or 80 dB. In an embodiment, the detent can move out of a resting position adjacent to an adapter post of an oil reservoir. The lock channel can also have a detent clearance which is less than a channel mouth dimension. The detent can optionally form part of a channel cavity into which the adapter post can be reversibly secured.

BRIEF DESCRIPTION OF THE DRAWINGS

The present invention in its several aspects and embodiments solves the problems discussed above and significantly advances the technology of chainsaws. The present invention can become more fully understood from the detailed description and the accompanying drawings, wherein:

FIG. 13B1 is a front view of an oil bottle adapter;

FIG. 14D1 is a close up of a first embodiment of a lock channel;

FIG. 14D2 is a side view of a second embodiment of a lock channel;

Herein, like reference numbers in one figure refer to like reference numbers in another figure.

DETAILED DESCRIPTION OF THE INVENTION

The chainsaw technologies disclosed herein are compact, reliable, easy to operate and efficient to maintain. For example, a chain bar tightening clutch system can use a compact and reliable bar tightening knob, a low profile chain cover can allow a chainsaw operator to make cuts close to a fixed obstacle and a chain bar tensioning system provides a new compact method for positioning a tensioning post to achieve a chain tension. An oil cap is also disclosed which has a lock channel, provides ease of operator use, has a leak-free closure and produces a sound as an audible indication of when the oil cap transitioned from an unlocked state to a locked state.

Chainsaw and Chainsaw Systems (e.g. FIGS. 1A-1D)

Figure 1A:
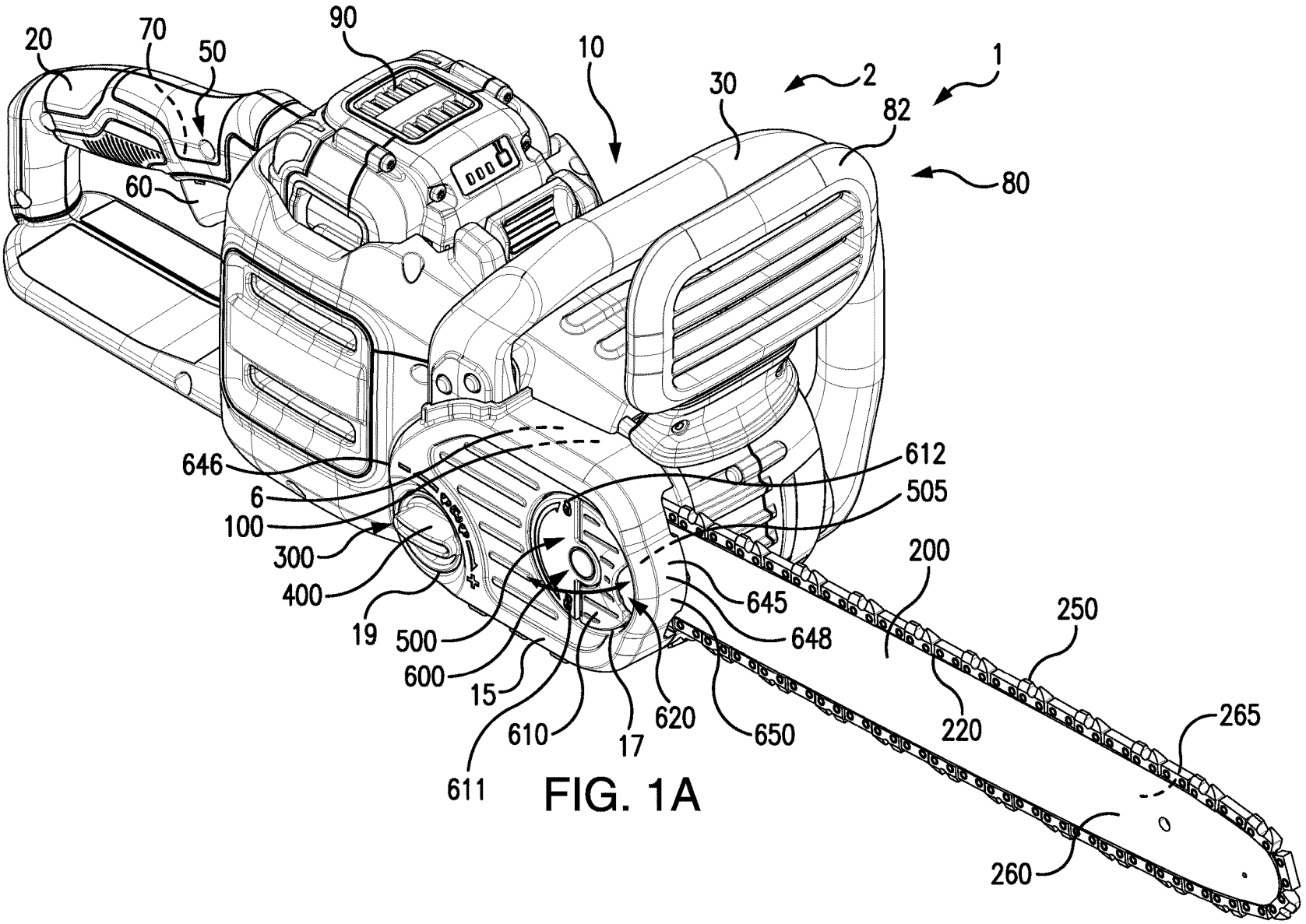
FIG. 1A is a perspective view of a chainsaw.

FIG. 1A is a perspective view of a chainsaw 1. The chainsaw 1 can have a motor 6 which can drive the chain 250. The chainsaw 1 can be powered by a one, or more, of variety of means such as but not limited to gas, electric, pneumatic or other means. If electric power is used, then the chainsaw 1 can be a cordless chainsaw 2, or a corded chainsaw having a power cord. FIG. 1A shows a cordless chainsaw 2 which can be powered by a battery pack 90.

The cordless chainsaw 2 can have a rear handle 20 and a forward handle 30 each configured to be gripped by an operator's hand. A trigger assembly 50 can have a trigger 60 and an actuator 70 which can trigger the motor 6 to rotate and drive a transmission assembly 100 which can turn a sprocket 230 (FIG. 1D) and can drive the chain 250 slideably along a chain guide groove 220 of a chain bar 200. The chain guide groove 220 can guide at least a portion of the chain 250. The chain bar 200 can have a chain bar first surface 260 and a chain bar second surface 265. The cordless chainsaw 2 can also have a housing 10 which can cover parts of cordless chainsaw 2, such as but not limited to, the motor 6, the transmission assembly 100. The housing 10 can form at least a portion of the rear handle 20 and forward handle 30.

The chain 250 can be configured to slideably move along the chain guide groove 220 and can have a chain tension provided at least in part by a chain bar tensioning system 300. The chain bar tensioning system 300 can have a tensioning post 310 (FIG. 1C) which can be used to position the chain bar 200 relative to the sprocket 230 and tensioning the chain against both the sprocket 230 (FIG. 2D) and at least a portion of the chain bar 200.

FIG. 1A shows a chain tensioning knob 400 of the chain bar tensioning system 300 which can be used by an operator to apply a desired tension to the chain 250 and which can be configured to rotate within tensioning knob port 19 of a chain cover 645. The chain cover can have a wide variety of shapes and dimensions. FIG. 1A shows an embodiment of the chain cover 645 which is a low profile chain cover 650. The chain cover 645 can have a chain cover proximal end 646 and a chain cover distal end 648.

Figure 7A:
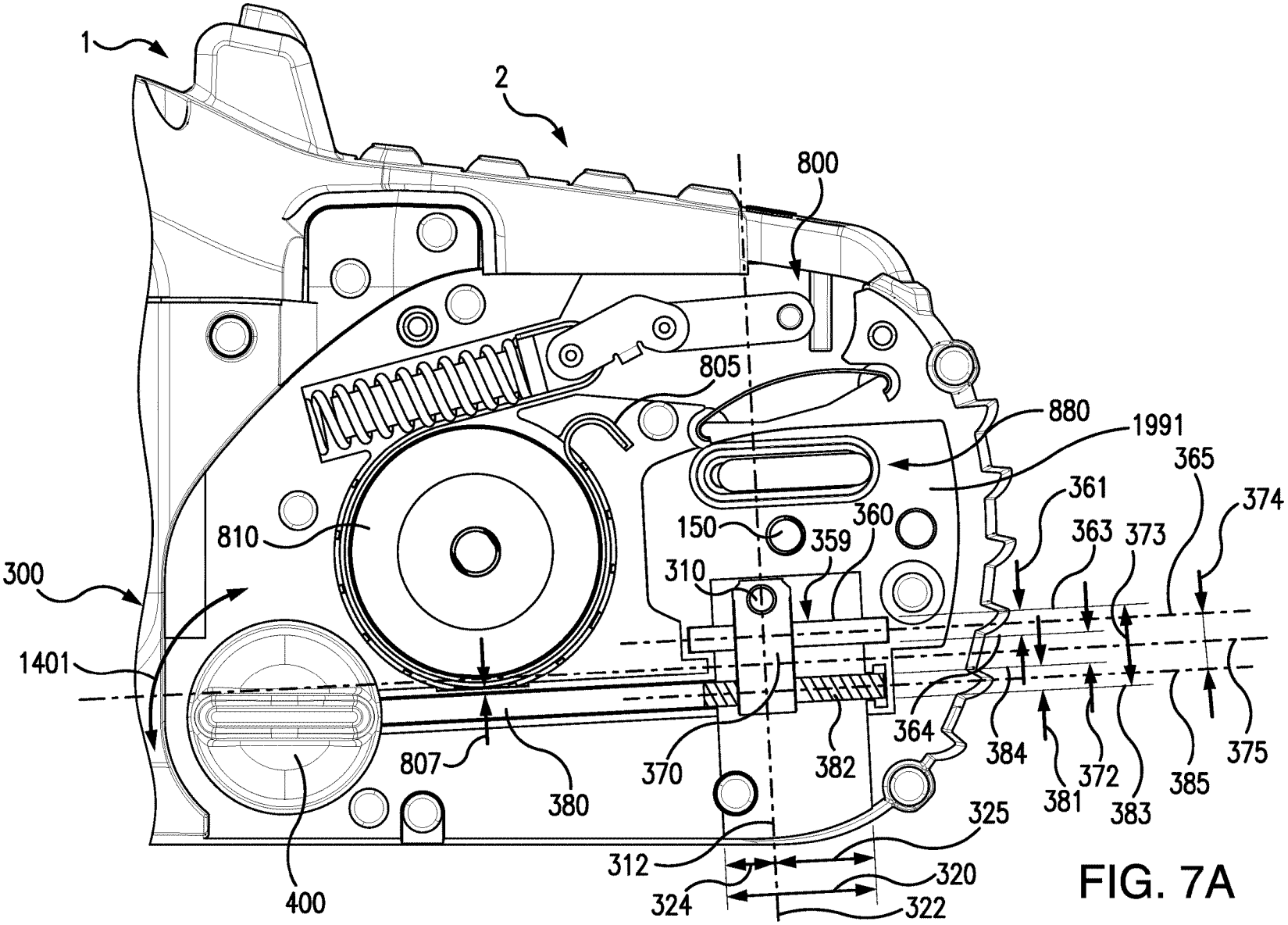
FIG. 7A is a sectional view showing a front view of the chain bar tensioning system.

Referring to FIGS. 1A and 7A, the cordless chainsaw 2 can have a chainsaw braking system 80 to brake the rotation of the chain 250. The chainsaw braking system 80 can have a hand guard 82 which can be attached to a brake arm 800 (FIG. 7A). A chain brake band 805 can be secured to the brake arm 800, and can wrap around a drum 810 which can be rotational and can be fixed to the sprocket 230. During operation, if the chainsaw were to unintentionally jump back toward the user, the user's hand on the front handle 30 would push the hand guard 82 forward, pulling the brake arm 800 forward and causing the chain brake band 805 to tighten around the drum 810, thereby braking its rotation and stopping the movement of chain 250. In order to again use the chainsaw, the user would have to reset the hand guard 82 by pulling it back into its release position, and loosening the chain brake band 805. In an embodiment, the sprocket 230 can be integral to the drum 810.

FIG. 1A also shows a chain bar tightening clutch system 500 having a bar tightening clutch assembly 505. The chain bar tightening clutch system 500 can have a bar tightening knob 600 and a tightening knob handle 610 which can pivot from a recessed state to a projecting state by pivoting means such as a tightening knob hinge 612. In FIG. 1A, the tightening knob handle 610 is configured to provide a finger access 620 when in a recessed state. Arrow 611 shows the reversible movement of the tightening knob handle 610 which can pivot from a recessed state to a projecting state. The bar tightening knob 600 can be configured to be rotatable within at least a portion of a bar tightening port 17 of the chain cover 645.

Figure 1B:
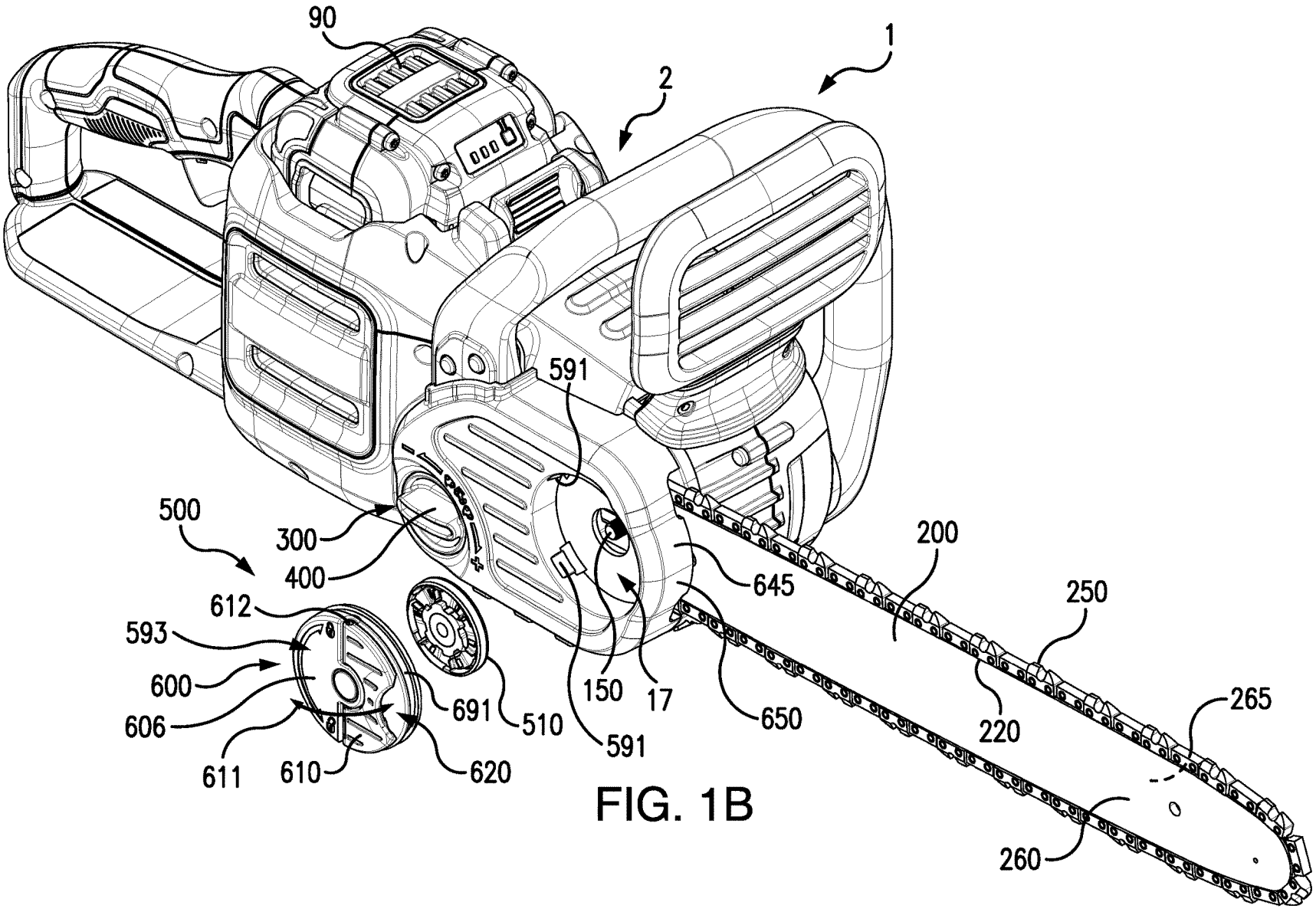
FIG. 1B is an exploded view of a chain bar tightening clutch system.

FIG. 1B is an exploded view of a chain bar tightening clutch system 500 having a bar tightening knob 600 and a clutch plate 510. FIG. 1B also shows the bar tightening bolt 150. Optionally, the bar tightening knob 600 can have a retaining means to maintain the bar tightening knob 600 in the bar tightening port 17 when it is turned and/or when the chain cover 645 is removed. In an embodiment, the bar tightening knob 600 retaining means can be a knob retaining groove 691. In the embodiment of FIG. 1B, the bar tightening port 17 comprises a plurality of knob retaining hooks 591 which can frictionally engage the knob retaining groove 691 such that the knob retaining groove 691 can be turned in the bar tightening port 17. The bar tightening knob 600 can be maintained in the bar tightening port 17 when it is turned and/or when the chain cover 645 is removed. In an embodiment, the plurality of knob retaining hooks 591 and the knob retaining groove 691 are adapted such that the bar tightening knob 600 can be reversibly snapped in and out of the bar tightening port 17 by means of the knob retaining groove 691 and the plurality of the knob retaining hooks 591. One or a plurality of the retaining hook 591 can be used, such as 1 to n, where n is a large number, e.g. n=1 to 50, of the knob retaining hooks 591. One or more of other retaining members or means can also be used, such as bearings, pins, projections, securing members, connectors, screw threads or other means. In an embodiment, the chain cover 645 can have four of the retaining hooks 591 which can engage the knob retaining groove 691.

Figure 1C:
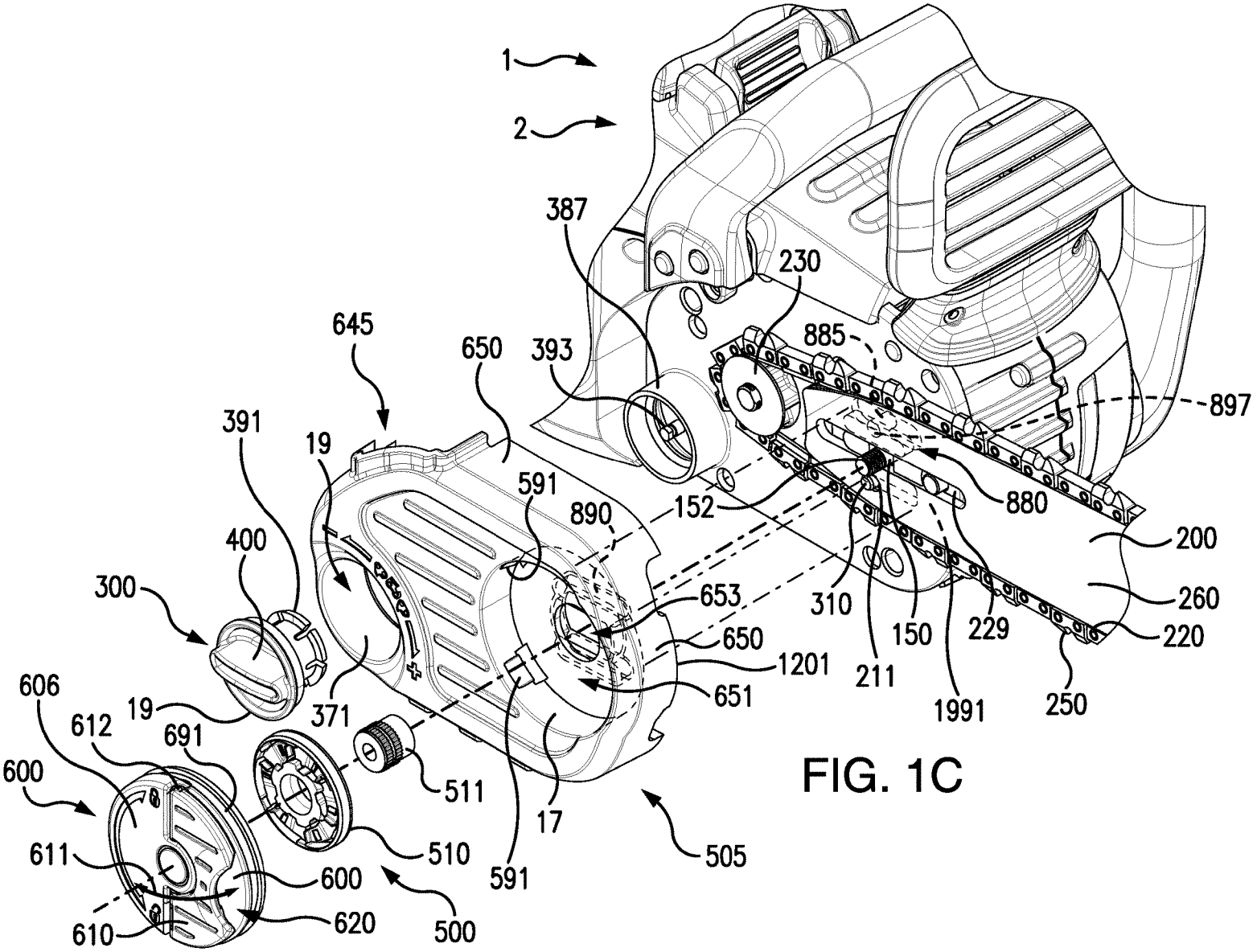
FIG. 1C is an exploded view of a chain bar tightening clutch system assembly.

FIG. 1C is an exploded view of a chain bar tightening clutch system assembly 505 and the chain bar tensioning system 300. The chain bar 200 can be moved by on operator during its placement to achieve a desired positioning of the chain bar 200 relative to the sprocket 230 and/or the bar tightening bolt 150, or other part of cordless chainsaw 2, until the assembly is tightened and/or tensioned to prevent such movement. The chain bar 200 can be configured such that at least a portion of the bar tightening bolt 150 passes through the chain bar tensioning groove 229. When an operator positions the chain bar 200, the chain bar tensioning groove 229 can allow the chain bar 200 to be moved, slid or positioned relative to the sprocket 230 and the bar tightening bolt 150. During placement, the chain bar 200 can be positioned for tightening, can be maintained, or can be removed and replaced by removing the chain bar 200 from the tool.

In an embodiment, the bar tightening bolt 150 has a bolt threads 152 portion which project beyond the chain bar first surface 260 toward a clutch plate connector 511 which can be screwed onto the bolt threads 152. The chain bar 200 can be configured to have an oil seal system 880 which can provide a chain oil to the chain 250 by means of flowing the chain oil through an oil port 885 and through the body of the chain bar 200. In an embodiment the chain bar 200 can have one or more internal passages positioned in communication with the oil port 885 and the chain guide groove 220, which are located inside of the chain bar 200 between at least a portion of the chain bar first surface 260 and a portion of the chain bar second surface 265 and which provide oil to the chain 250.

A first oil seal portion 890 can be pressed against a portion of the chain bar first surface 260 and over the oil port 885. For example, the first oil seal portion 890 can seal the chain bar oil inlet port 897 which passes through the chain bar first surface 260 and chain bar second surface 265. The sealing of the chain bar oil inlet port 897 on the chain bar first surface 260 while allowing the chain bar oil inlet port 897 to receive oil from the oil port 885 through the chain bar second surface 265 allows oil to pass through the one or more internal passages to the chain guide groove 220 and to the chain 250. Optionally, the first oil seal portion 890 can be a separate sealing member or can be an integral portion of the low profile chain cover 650.

The low profile chain cover 650 can be configured such that at least a portion of the bar tightening bolt 150 and the bolt threads 152 project through a bolt opening 651 and into the clutch cavity 653 of the bar tightening port 17. In an embodiment, the clutch plate 510 can be rotatably affixed to the bar tightening bolt 150 by means of affixing the clutch plate 510 to the clutch plate connector 511 and affixing the clutch plate connector 511 to the bar tightening bolt 150. In an embodiment, the clutch plate connector 511 can be screwed onto the bar tightening bolt 150 to provide a tightening force to position the chain bar 200, as well as can be unscrewed and removed from the bar tightening bolt 150 to allow for positioning, maintenance or removal of the chain bar 200.

Optionally, the clutch plate connector 511 can be an integral part of the clutch plate 510. The clutch plate connector 511 can be attached to the bar tightening bolt 150 by a broad variety of means such as, but not limited to, a frictional fit, a lock and key, a connecting system or screw threads. Optionally, the clutch plate 510 can be insert molded onto the clutch plate connector 511 which can form one integral part as shown in the example of FIG. 2C. The clutch plate connector 511 can have threads and can be screwed onto the bar tightening bolt 150 by means of the bolt threads 152. In an embodiment, the clutch plate connector 511 can have a connector threads 509 (FIG. 2C) which can mate with and be screwed onto the bolt threads 152 of the bar tightening bolt 150 to tighten a portion of the chain bar tightening clutch system 500 and/or a portion of the chain cover 645, or the low provide chain cover 650, against the chain bar 200, as well as tightening the chain bar 200 against a chain bar backstop 1991 (FIG. 1D).

Figure 8:
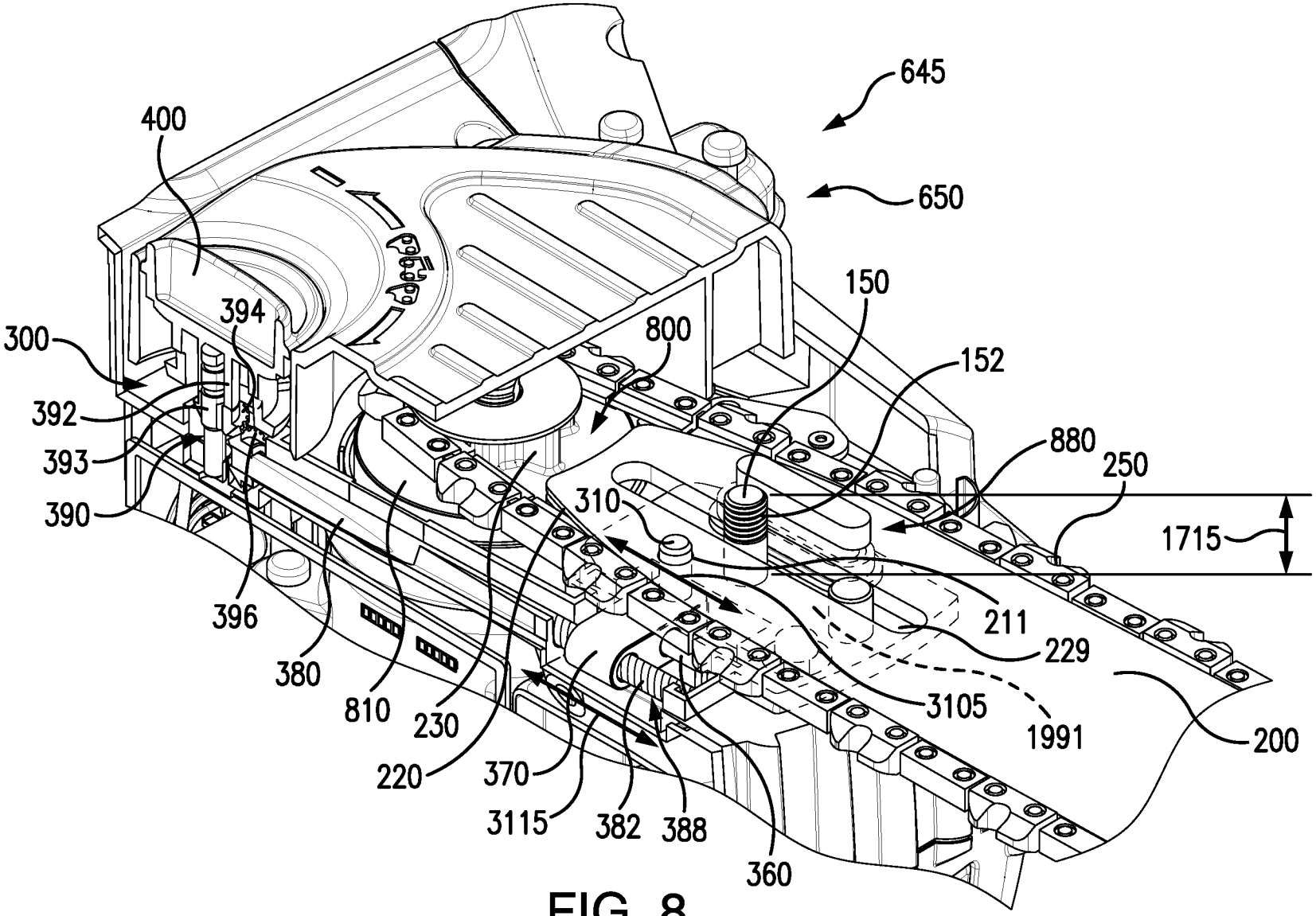
FIG. 8 is a sectional view showing a side view of the chain bar tensioning system.

FIG. 1C also shows the chain bar tensioning system 300. The chain tensioning knob 400 has a chain tensioning knob body 391 which can have at least a portion rotatably inserted into a tensioning knob sleeve 387. The tensioning knob sleeve 387 can project at least in part into the tensioning knob port 19. Optionally, at least a portion of the chain tensioning knob body 391 can pass through the tensioning knob port 19 and into the tensioning knob sleeve 387. A tensioning knob drive shaft 393 can be rotatably driven by a force imparted to the tensioning knob connector 392 (FIG. 8). In an embodiment the tensioning knob drive shaft 393 can be inserted into the tensioning knob connector 392. Optionally, the tensioning knob drive shaft 393 can be inserted into the tensioning knob connector 392 can fit together by lock and key. Optionally, the tensioning knob connector 392 can be integral to the tensioning knob 400. When an operator turns the chain tensioning knob 400, the tensioning knob connector 392 can cause the tensioning knob drive shaft 393 to turn. Optionally, the chain tensioning knob 400 can be reversibly, or permanently, coupled to the tensioning knob drive shaft 393 which can rotate when the chain tensioning knob 400 is turned which can tighten a portion of the chain bar tightening system 300. Optionally, the tensioning knob drive shaft 393 can be integral to the chain tensioning knob 400.

Figure 1D:
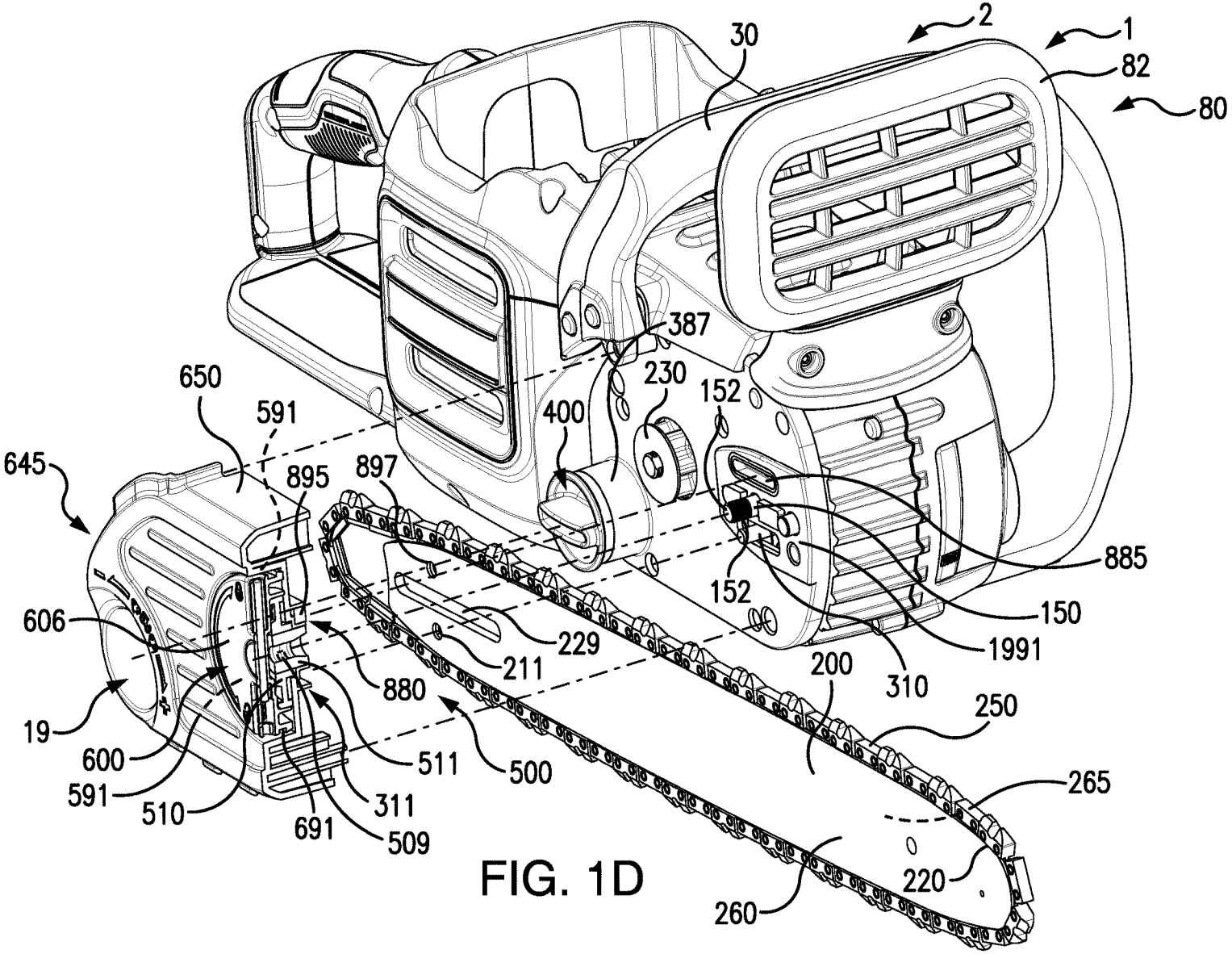
FIG. 1D is an exploded view of the chain bar tightening clutch system, oil seal system and tensioning post channel.

FIG. 1D is an exploded view of the chain bar tightening clutch system 500, oil seal system 880 and tensioning post channel 311. In the example of FIG. 1D, the chain bar tightening clutch system 500 has the bar tightening knob 600 having the clutch plate 510 insert molded around the clutch plate connector 511. At least a portion of the clutch plate connector 511 is configured to screw onto the bolt threads 152 of the bar tightening bolt 150. As the bar tightening knob 600 is turned to screw the clutch plate connector 511 onto the bar tightening bolt 150, at least a portion of the low profile chain cover 650 is brought into frictional contact with the chain bar first surface 260. As the bar tightening knob 600 is turned to continue to screw the clutch plate connector 511 onto the bar tightening bolt 150, the frictional contact of the low profile chain cover 650 with the chain bar first surface 260 and the forces imparted by turning the bar tightening knob 600 impart a force which frictionally contacts the chain bar second surface 265 against the chain bar backstop 1991.

The bar tightening knob 600 can continue to be turned by an operator to reach a clutch set point at which the chain bar 200 is frictionally secured between at least a portion of the low profile chain cover 650 and the chain bar backstop 1991 with a desired force, which can be the clutch set point after which the clutch can activate to an active clutch state. In an embodiment, if the operator turns the bar tightening knob 600 to impart a force greater than the clutch set point, then the clutch plate 510 will clutch and the active clutching will allow the bar tightening knob 600 to turn without further tightening of the chain bar 200. In an embodiment, when a clutch force is reached, an active clutch state can occur and the clutching can avoid the part or portion of the chain bar tightening system 300 from imparting undesired and/or excess force and can avoid overtightening upon the chain bar 200.

In an embodiment, a portion of the chain cover 645 can contact a portion of the chain bar 200 and impart a tightening force. Optionally, a member which is not the chain cover 645 can be used to contact the chain and/or impart a tightening force. For example, a part or portion of the chain bar tightening system 300, such as the clutch plate connector 511, or other member, or interface, could impart force against the chain bar 200.

The example of FIG. 1D also shows the configuration of oil seal system 880 in which oil port 885 provides oil to chain bar oil inlet 897 and can sealed by an oil seal 895. In the embodiment, of FIG. 1D, as the low profile chain cover 650 can be pressed against the chain bar 200 which can be pressed against the chain bar backstop 1991, the oil seal 895 can be pressed against the oil port inlet 897 of the chain bar first surface and the chain bar second surface 265, also having an oil port inlet 897 opening, can be pressed against the chain bar backstop 1991. When the chain bar second surface is pressed against the oil port 885 and the oil seal 895 is pressed against the oil port inlet 897 opening of the chain bar first surface 260, a sealed oil supply system to the chain can be formed. The chain oil can then pass from the oil port 885, into the oil port inlet 897 through one or more passageways in the chain bar and to the chain 250. In this example, the tightening of the chain cover 650 by means of turning bar tightening knob 600 seals the oil feed system which provides oil to the chain 250.

FIG. 1D also shows a configuration which aligns a tensioning post channel 311 with the tensioning post 310, at least a part of which can project into and can move within the tensioning post channel 311.

In an example of operation, the chain bar tightening clutch system 500 can be used to impart a limited force which presses upon the chain bar 200 to establish a preliminarily position the chain bar 200 desired by an operator relative to the sprocket 230. Then, the operator can use chain bar tensioning system 300 to finalize the position of the chain bar 200. In an embodiment, when the operator has established a preliminary position for the chain bar 200, the operator can then use chain bar tensioning system 300 to move the chain bar toward or away from the sprocket 230 as desired to achieve a final position of the chain bar 200. After that, the operator can use the chain bar tightening clutch system 500 can be used to achieve a final tightening of the low profile chain cover 650 and the chain bar backstop 1991 against the chain bar 200.

Optionally, the operator can use chain bar tensioning system 300 concurrently with the chain bar tightening clutch system 500 to achieve a final tightening of the low profile chain cover 650 and the chain bar backstop 1991 against the chain bar 200 at a desired chain bar position. As another option, the operator can use chain bar tensioning system 300 concurrently with the chain bar tightening clutch system 500 separately, or in sequence to achieve a desired tightening and chain bar 200 position. In yet another option, the operator can use the use chain bar tensioning system 300 concurrently with the chain bar tightening clutch system 500 iteratively or in a desired sequence or cycle to secure the chain bar 200 in a desired position at a desired tightness.

In an embodiment, the desired tightness is set by the clutching of the clutch plate and can be a tightness set by a manufacturer. Thus, the tightness imparted upon the chain bar 200 by the chain bar tightening clutch system 500 can be a set value. This can be any value to which the clutch is designed to activate.

In another example of operation, the chain bar tensioning system 300 can be used to position the chain bar 200 relative to the sprocket 230, and then the chain bar tightening clutch system 500 can be used to achieve a desired tightening of the low profile chain cover 650 and the chain bar backstop 1991 against the chain bar 200.

In an embodiment, the chain bar tensioning system 300 and the chain bar tightening clutch system 500 can be operated independently of one another. In another embodiment, the chain bar tensioning system 300 and the chain bar tightening clutch system 500 can be operated concurrently.

Numeric values and ranges herein, unless otherwise stated, are intended to have associated with them a tolerance and to account for variances of design and manufacturing. Thus, a number is intended to include values "about" that number. For example, a value X is also intended to be understood as "about X". Likewise, a range of Y-Z, is also intended to be understood as within a range of from "about Y-about Z". Unless otherwise stated, significant digits disclosed for a number are not intended to make the number an exact limiting value. Variance and tolerance is inherent in mechanical design and the numbers disclosed herein are intended to be construed to allow for such factors (in non-limiting e.g., ±10 percent of a given value). Example numbers disclosed within ranges are intended also to disclose sub-ranges within a broader range which have an example number as an endpoint. A disclosure of any two example numbers which are within a broader range is also intended herein to disclose a range between such example numbers. When a series of example numbers are disclosed, unless otherwise stated, numbers between such example numbers are also intended to be disclosed. The claims are likewise to be broadly construed regarding their recitations of numbers and ranges.

Clutch Plate & Chain Bar Tightening Clutch System (e.g. FIGS. 2A-6)

Figure 2A:
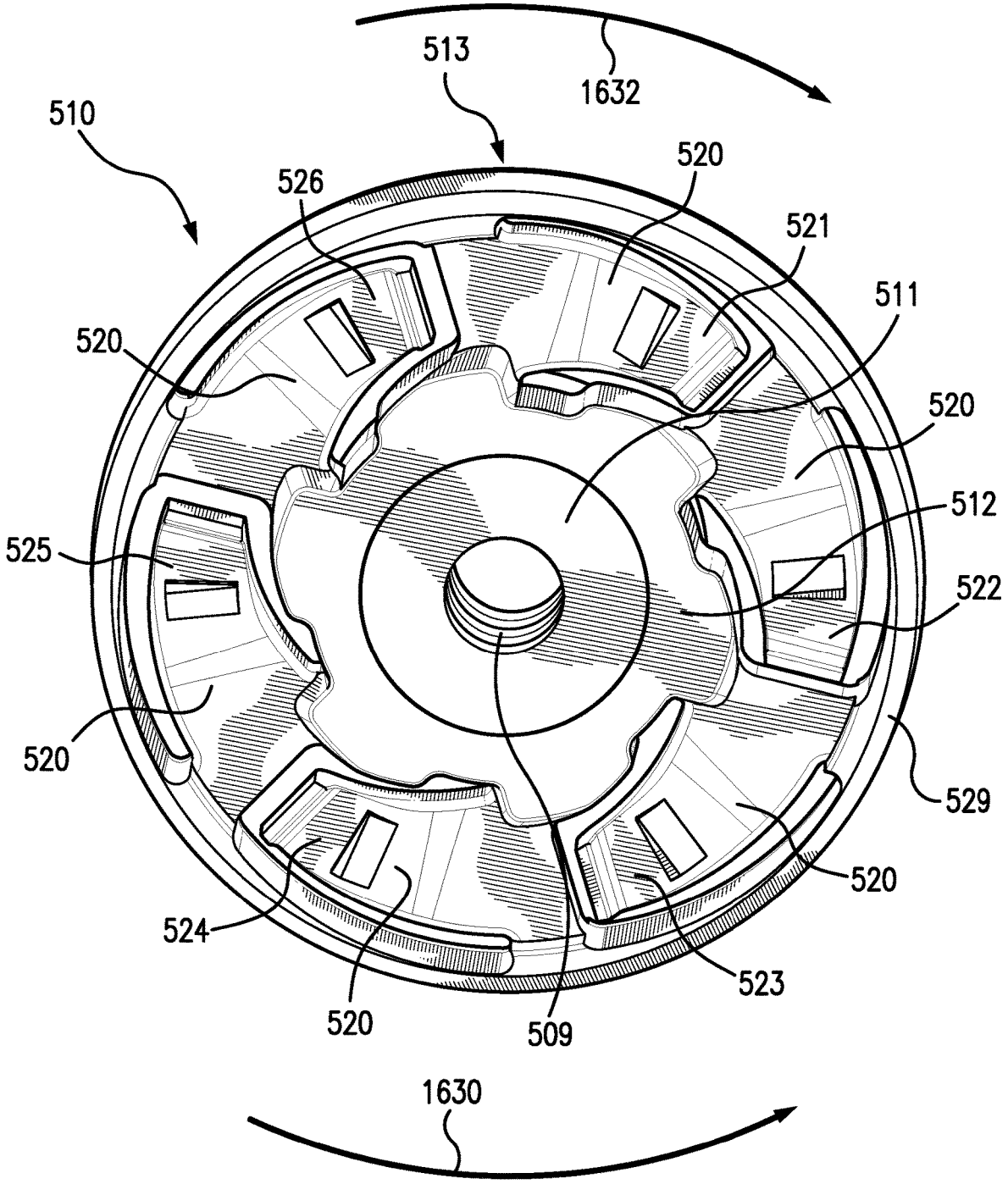
FIG. 2A is a front view of the clutch plate.

FIG. 2A is a front view of the clutch plate 510 of the chain bar tightening clutch system 500. The clutch plate 510 can have a clutch plate core 512 interfaced with a clutch plate connector 511. Optionally, the clutch plate connector 511 can be integral to the clutch plate 510. In an embodiment, the clutch plate 510 can be formed around at least a portion of the clutch plate connector 511, such as by extrusion molding. FIG. 2A shows a plurality of the spring FIG. 520 extending from the clutch plate core 512 to a clutch plate rim 529 which extends around the circumference 513 of the clutch plate 510. This disclosure is not limited to the number of the spring fingers 520 which can be used, the number can range from 1 to a large number, such as 50, or more; e.g. 1 . . . n spring fingers, in which n can range from 1 to a large number, e.g. 1, 2, 3, 4, 5, 6, 7, 8, 9, 10, 25, or 50 spring fingers. FIG. 2A shows a clutch plate having 6 of the spring fingers 520, e.g.: first spring finger 521, second spring finger 522, third spring finger 523, fourth spring finger 524, fifth spring finger 525 and sixth spring finger 526. In an embodiment, each spring finger 520 can have a pawl 526.

FIG. 2A shows that the clutch plate 510 can be turned in a tightening direction 1632 or a release direction 1630.

When the clutch plate 510 is turned in the tightening direction 1632 the clutch plate connecter 511 can be screwed onto the bar tightening bolt 150 to tighten at least a portion of the chain bar tightening clutch system 500 (in the present embodiment, the chain cover 645) against at least a portion of the chain bar. The clutch plate 510 can be turned and screwed onto the bar tightening bolt 150 until the clutch is activated. The activation of the clutch can stop the clutch plate 510 from turning to additionally screw onto the bar tightening bolt 150 and can stop additional tightening of the chain bar tightening clutch system 500 upon the chain bar 200.

The clutch plate 510 can also be rotated in a release direction 1630 which unscrews the clutch plate connecter 511 from the bar tightening bolt 150 and loosens the pressure from the chain bar 200. Optionally, the clutch plate connector can be unscrewed from the from the bar tightening bolt 150 to allow removal of the chain bar tightening clutch system 500 and chain cover 645 from the cordless chainsaw 2.

The clutch plate 510 and/or the spring finger 520, or any other portion, can be made at least in part or wholly of a metal, a polymer, a plastic, a reinforced polymer, a reinforced plastic, a ceramic, a cured resin, a thermoplastic or other material suitable for the uses described herein. In an embodiment, the clutch plate 510 and/or the spring finger 520 can be made at least in part of a 15% glass fiber reinforced, heat stabilized, black polyamide 6 resin for injection molding, such as Zytel® 73G15HSL BK363 (E.I. DuPont de Nemours & Co., 1007 Market St Wilmington, Del., 19898 United States (302) 774-1000). The clutch plate 510 and/or the spring finger 520 can optionally be made at least in part of a carbon fiber reinforced polymer. The percent of material reinforcement can vary widely to satisfy the uses disclosed herein.

Figure 2B:
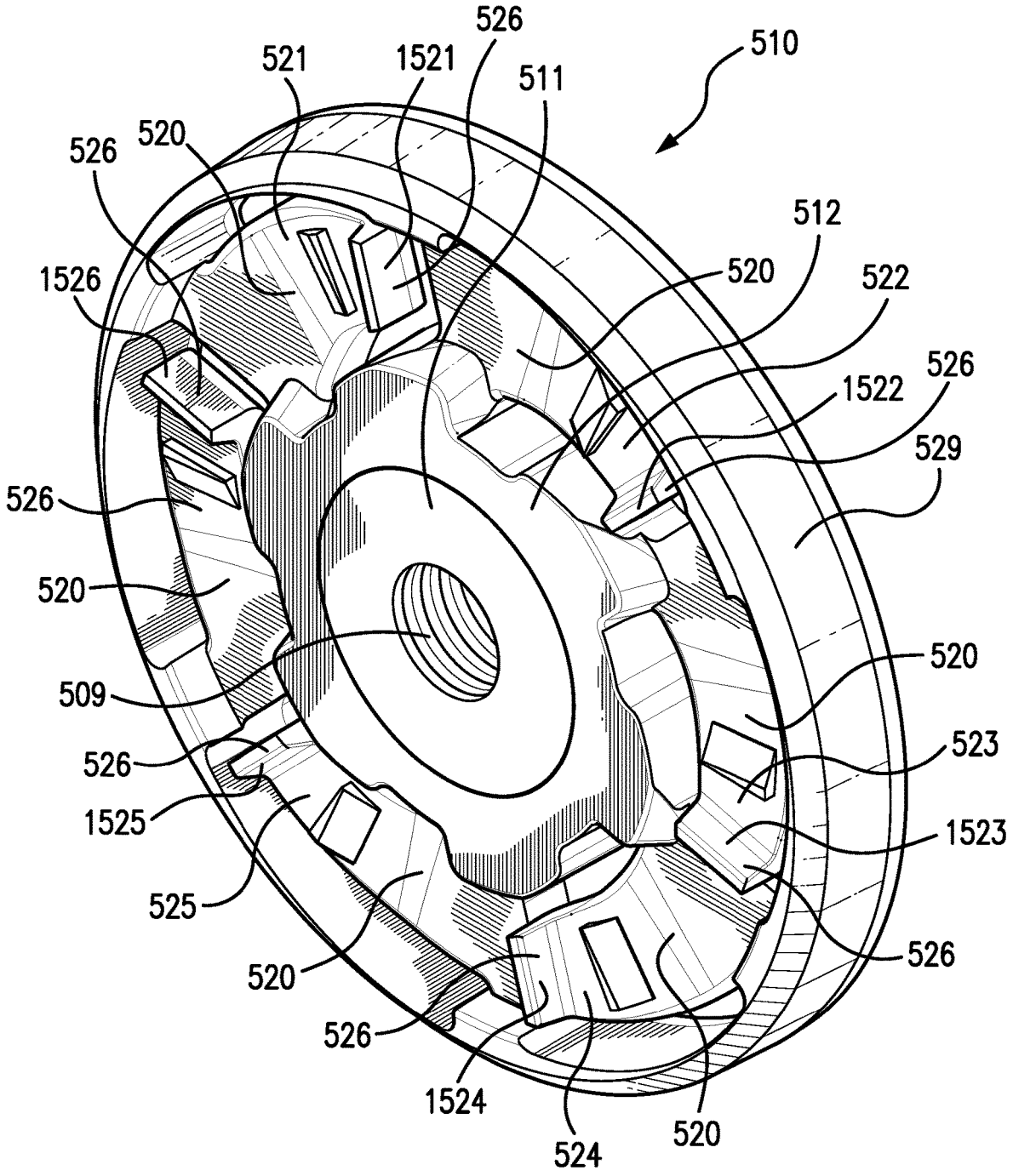
FIG. 2B is a perspective view of the front of the clutch plate.
Figure 2C:
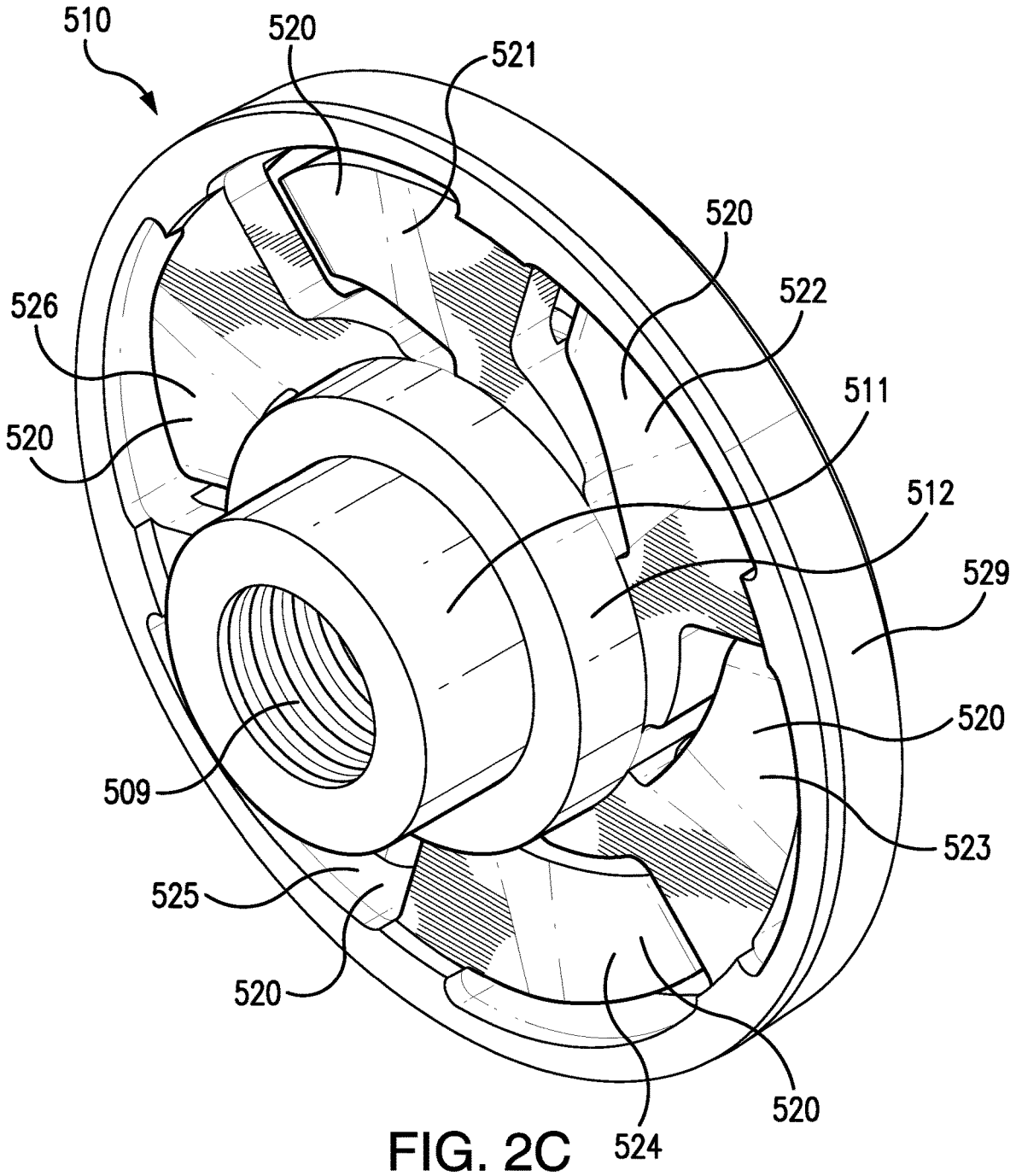
FIG. 2C is a perspective view of the back of the clutch plate.

FIG. 2B is a perspective view of the front of clutch plate 510 showing each of the spring finger 520 members having a pawl 526. In nonlimiting example, the first spring finger 521 has a pawl 1521; the second spring finger 522 has a pawl 1522; the third spring finger 523 has a pawl 1523; the fourth spring finger 524 has a pawl 1524; the fifth spring finger 525 has a pawl 1525; and the sixth spring finger 526 has a pawl 1526.

FIG. 2C is a perspective view of the back of the clutch plate 510 showing the backside of each of the first spring finger 521, the second spring finger 522, the third spring finger 523, the fourth spring finger 524, the fifth spring finger 525 and the sixth spring finger 526. FIG. 2C also shows portions of the clutch plate core 512 and the clutch plate connector 511.

Figure 3A:
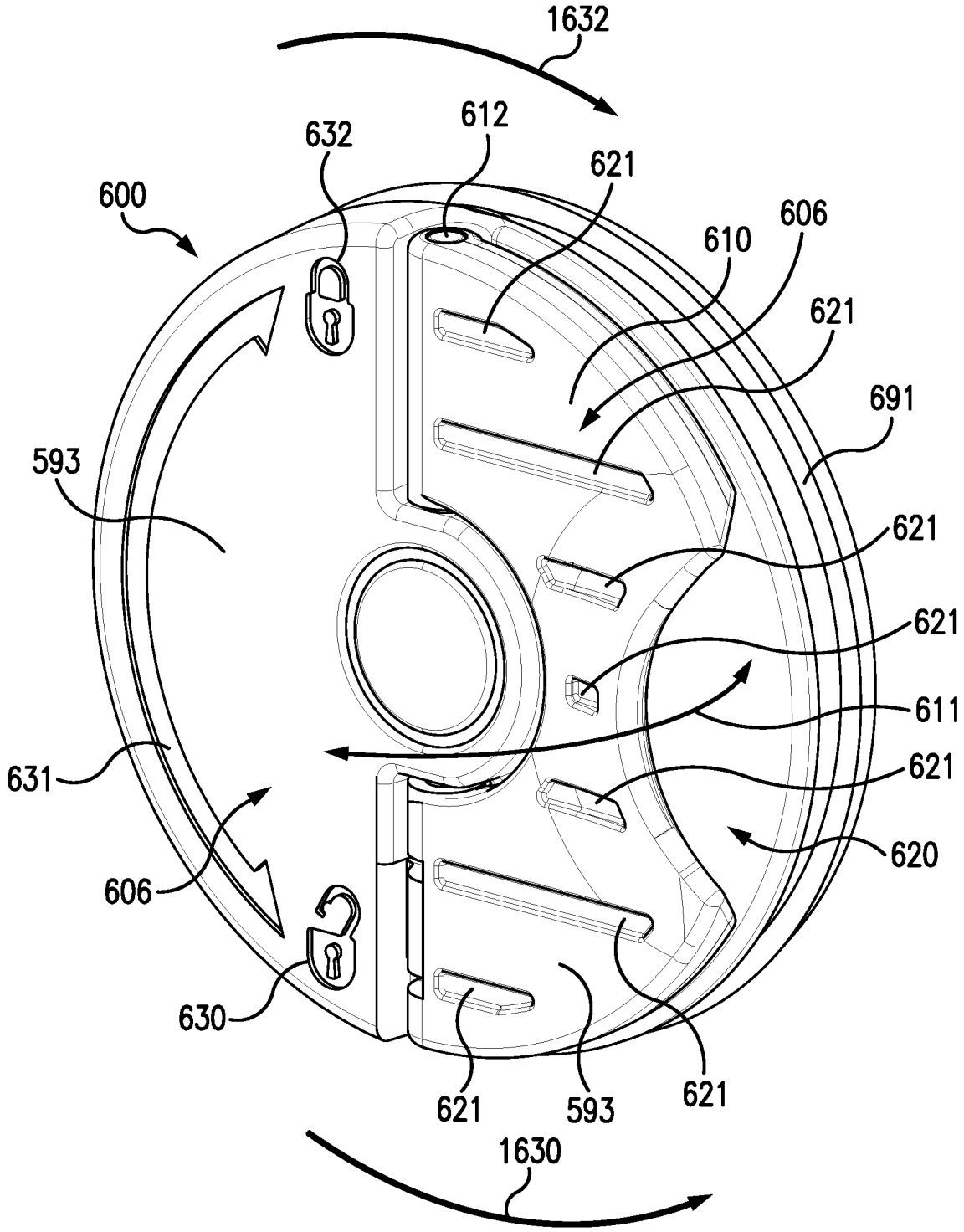
FIG. 3A is a perspective view of the front of the bar tightening knob.

FIG. 3A is a perspective view of the front of the bar tightening knob 600. The bar tightening knob 600 can have a tightening knob handle 610 which can pivot from a recessed state to an projecting state, as shown by arrow 611, by pivoting means such as a tightening knob hinge 612. Optionally, tightening knob handle 610 can be configured to provide a finger access 620 when in a recessed state.

Optionally, the bar tightening knob 600 can bear symbols or markings which an operator can view and/or feel during use of the bar tightening knob 600. In nonlimiting example, the bar tightening knob 600 can have an unlocked symbol 630 adjacent to a directional arrow symbol 631 with an arrowhead pointing the direction of rotation to unlock the bar tightening knob 600. The bar tightening knob 600 can have a locked symbol 632 adjacent to a directional arrow symbol 631 with an arrowhead pointing the direction of rotation to lock the bar tightening knob 600. Optionally, the tightening knob handle 610 can have on or more of a handle slot 621 which the operator can feel when touching the tightening knob handle 610. The number of the handle slot 621 provides a visual and tactile indication of which portion of the knob is the tightening knob handle 610 portion, as well as providing a gripping surface when turning and/or rotating the tightening knob handle 610.

In an embodiment, the bar tightening knob 600 can be turned in a tightening direction 1632 which can screw the clutch plate connector 511 onto the bolt threads 152. This can tighten the clutch plate 510 against the chain cover 645 which can press against at least a portion of the chain bar 200, such as the chain bar first surface 260. In an embodiment, the clutch plate connector 511 can press against at least a portion of the chain bar 200, such as the chain bar first surface 260.

In an embodiment, the bar tightening knob 600 can be rotated in a release direction 1630. Rotating the bar tightening knob 600 in a release direction 1630 can cause the inner clutch teeth 561 and the outer clutch teeth 571 (FIG. 3B) to press upon one or more of a pawl back face 519 causing the clutch plate 510 and clutch plate connector 511 to rotate in the release direction 1630 and release the tightening pressure from the chain bar 200 and allow removal of the chain cover 645, as well as the bar tightening knob 600.

Figure 5A:
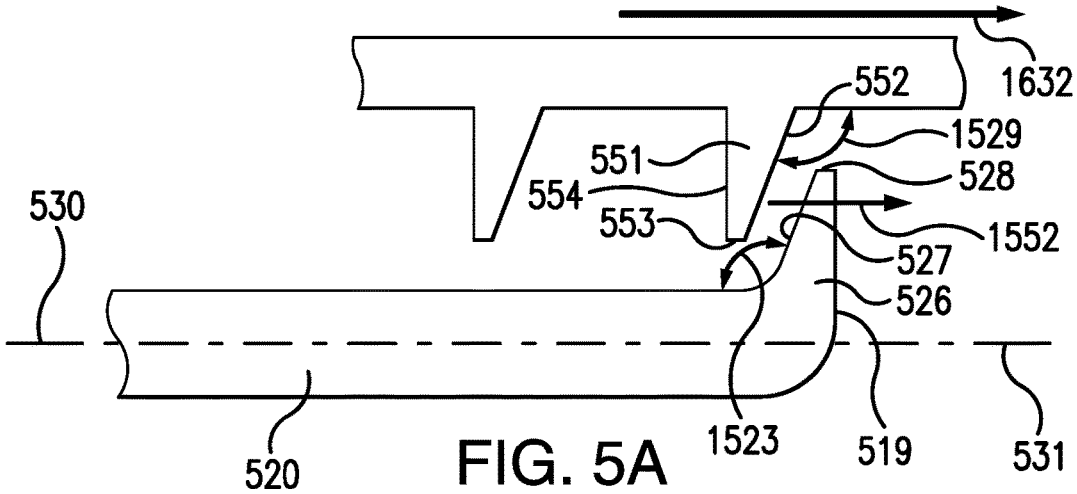
FIG. 5A is a close up view showing a clutch tooth moving toward a pawl face.
Figure 5B:
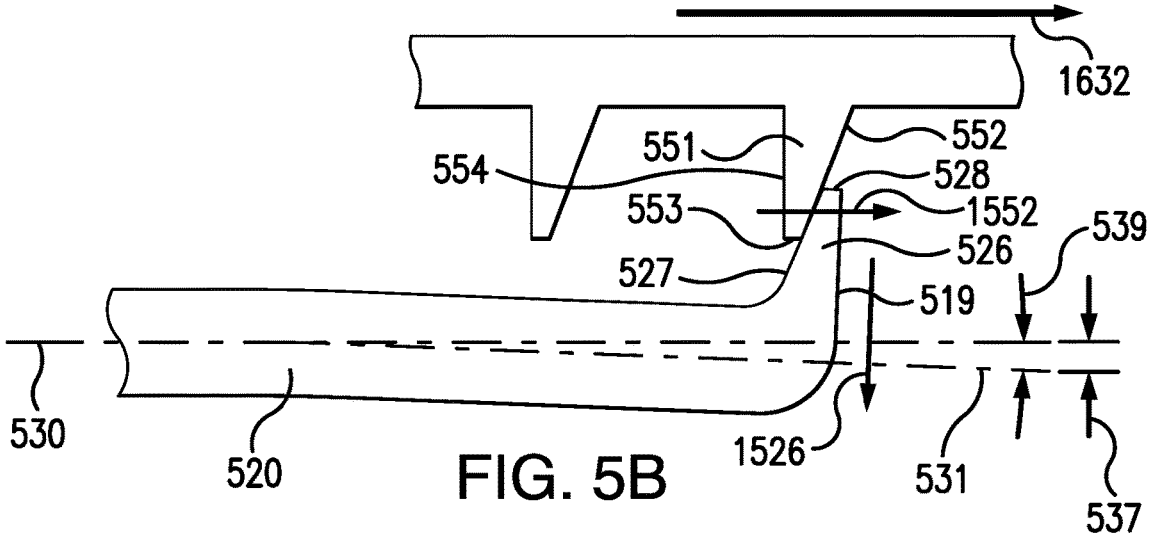
FIG. 5B is a close up view showing a tooth contact face making reversible contact with a pawl face and displacing the spring finger by a deflection angle.
Figure 5C:
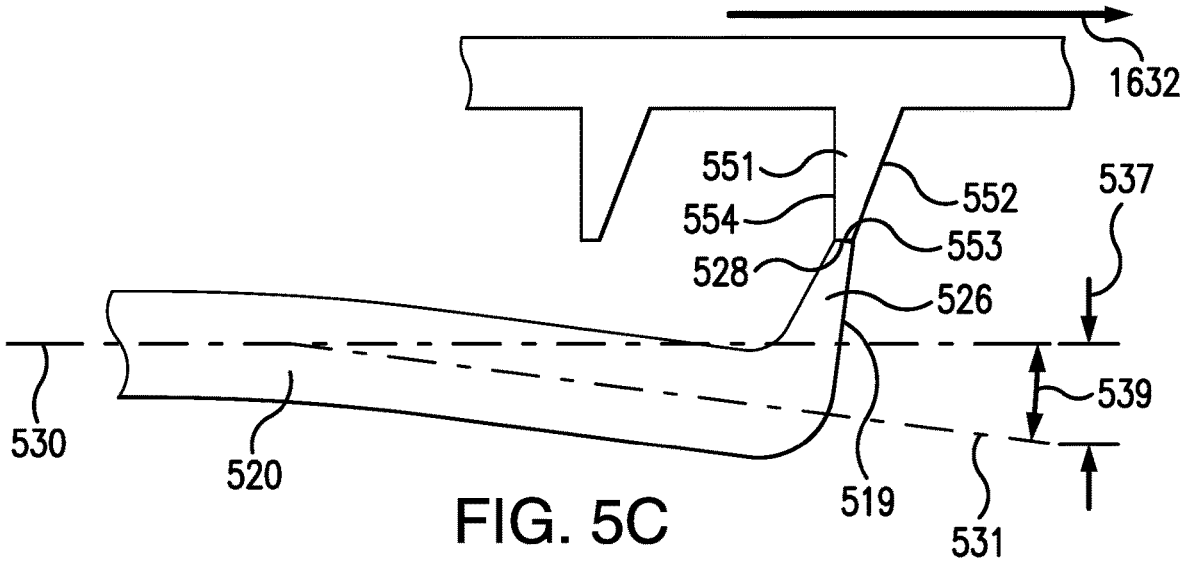
FIG. 5C is a close up view of the pawl at a deflection angle to allow the clutch tooth to pass across the pawl tip.
Figure 5D:
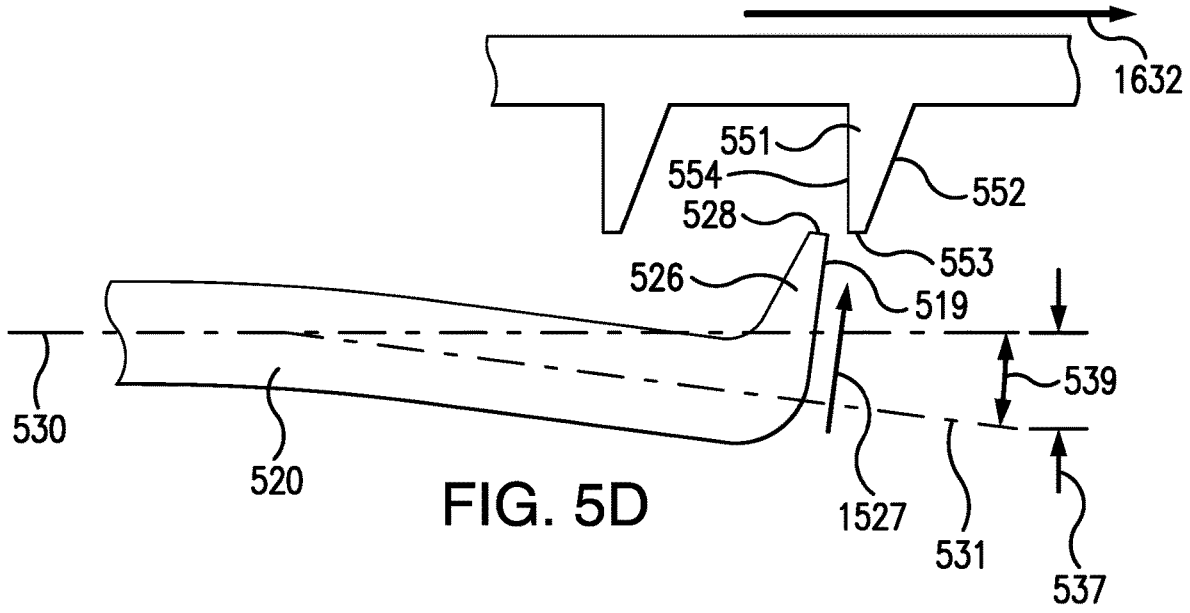
FIG. 5D is a close up view of the clutch tooth moving away from the pawl of the spring finger.
Figure 5E:
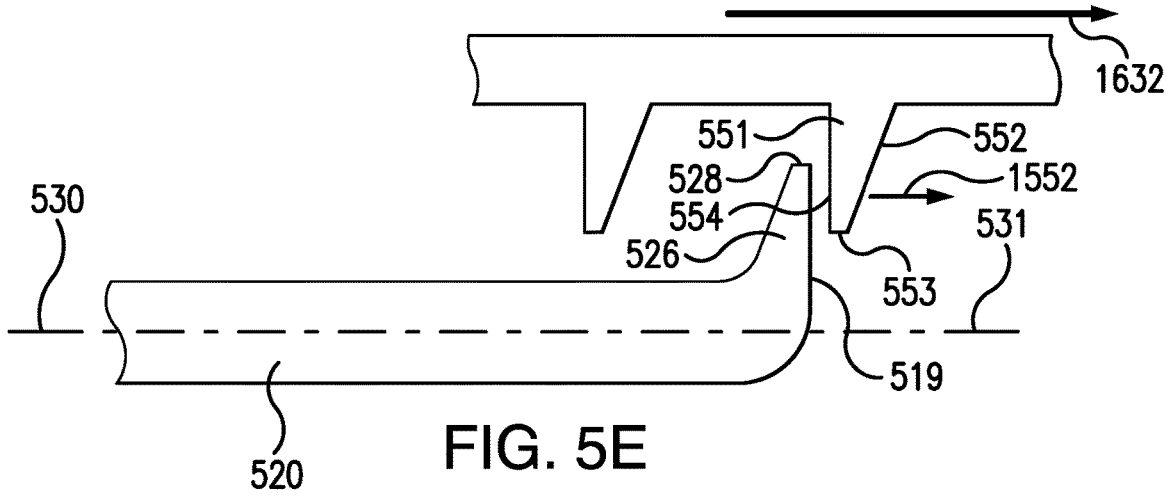
FIG. 5E is a close up view of the pawl of the spring finger having returned to its rest position.
Figure 5F:
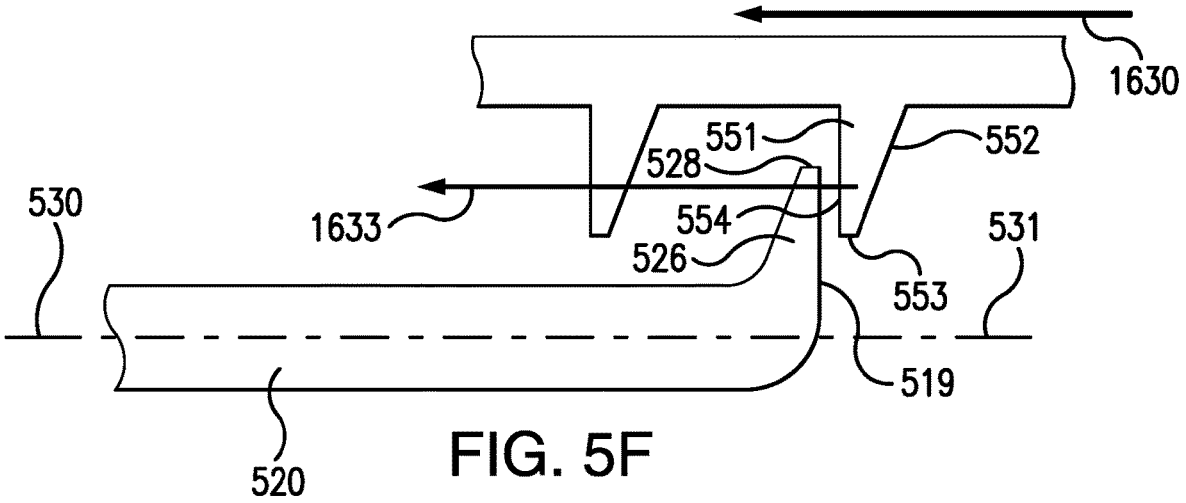
FIG. 5F shows a clutch teeth release motion which can turn the clutch plate and unscrew it from the bar tightening bolt.

FIG. 5F shows a clutch teeth 500 release motion which can turn the clutch plate 510 to unscrew it from the bar tightening bolt 150. The clutch teeth 500 can cause the clutch plate 510 to turn in the release direction 1630 which move a tooth release face 579 of a clutch tooth 551 into contact with the pawl back face 519 of the pawl 523 and impart a motion to the clutch plate 510 through pushing the pawl 526 in a release direction 1630 which is also in the direction of a release force arrow 1633. The movement of the pawl in the direction of the release force arrow 1633 can cause the clutch plate 510 to move in the direction of the pawl 526 and also move the clutch plate connector 511 to unscrew from the bolt threads 152.

In an embodiment, multiple clutch teeth 500 can force multiple pawls 526 to move and turn the clutch plate 510 such that the clutch plate connector 511 unscrews from the bolt threads 152 of the bar tightening bolt 150. Optionally, the bar tightening clutch assembly 505 can be unscrewed from the bar tightening bolt 150 until it is free of connection to the bar tightening bolt 150. The freeing of the bar tightening clutch assembly 505 from connection to the bar tightening bolt 150 can achieve the removal of the chain cover 645 from the cordless chainsaw 2.

Figure 6:
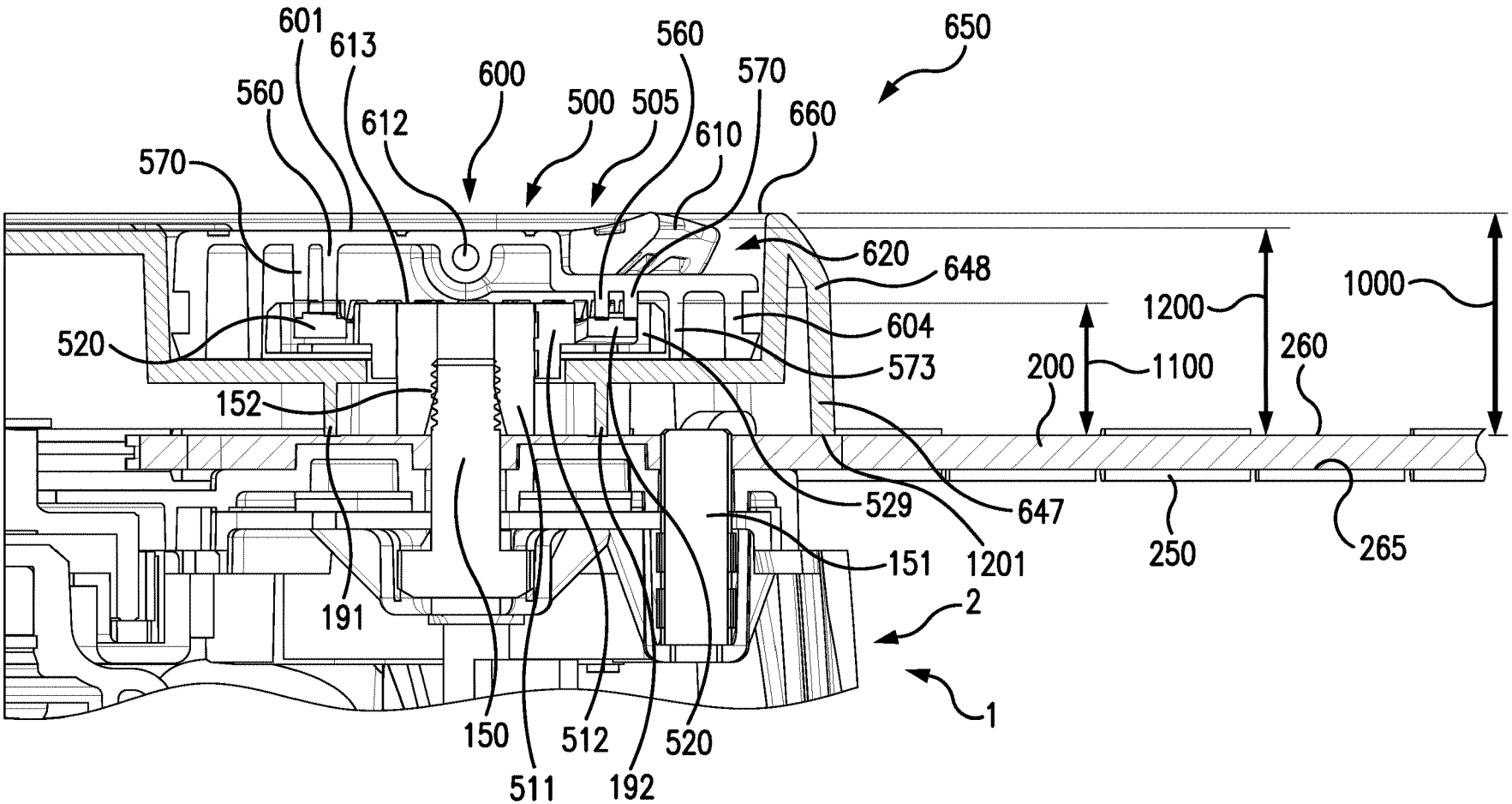
FIG. 6 is a sectional view showing the chain bar tightening clutch system in an engaged position.

In an embodiment, the bar tightening knob 600 can be configured such that the bar tightening knob handle 610 and knob surface 606 are each located between a chain cover surface 660 (FIG. 6) and the chain cover bar face 1201 which can be in contact with the chain bar first surface 260 when the chain cover 645 is in a tightened state as shown in FIG. 6. This configuration herein is referred to as the "subflush" arrangement of the bar tightening knob handle 610 and knob surface 606 in that the members are located between the chain cover surface 660 and the chain cover bar face 1201 (FIG. 1C, FIG. 6). This allows the chain cover to rest upon the chain cover surface 660, if desired, without having to find a resting surface which can accommodate a protrusion of a portion of the bar tightening knob 600 beyond the chain cover surface 660 in a direction away from the chain cover bar face 1201 or the chain bar 200.

Thus, in a tightened state the tightening knob face height 1200 can be measured either from the chain cover bar face 1201 or the chain bar first surface 260 to the chain cover surface 660. When the chain cover 645 is removed from the cordless chainsaw 2, the tightening knob face height 1200 can be measured the chain cover bar face 1201 to the chain cover surface 660.

In an embodiment, together the bar tightening knob handle 610 when in its recessed state as shown in FIG. 6 and knob surface 606 can together form a tightening knob recessed surface 593 which can be subflush to chain cover surface 660. The tightening knob recessed surface 593 represents the combined surfaces of the bar tightening knob handle 610 when in its recessed state and knob surface 606 proximate to chain cover surface 660, but located between the chain cover surface 660 and the chain cover bar face 1201.

Figure 3B:
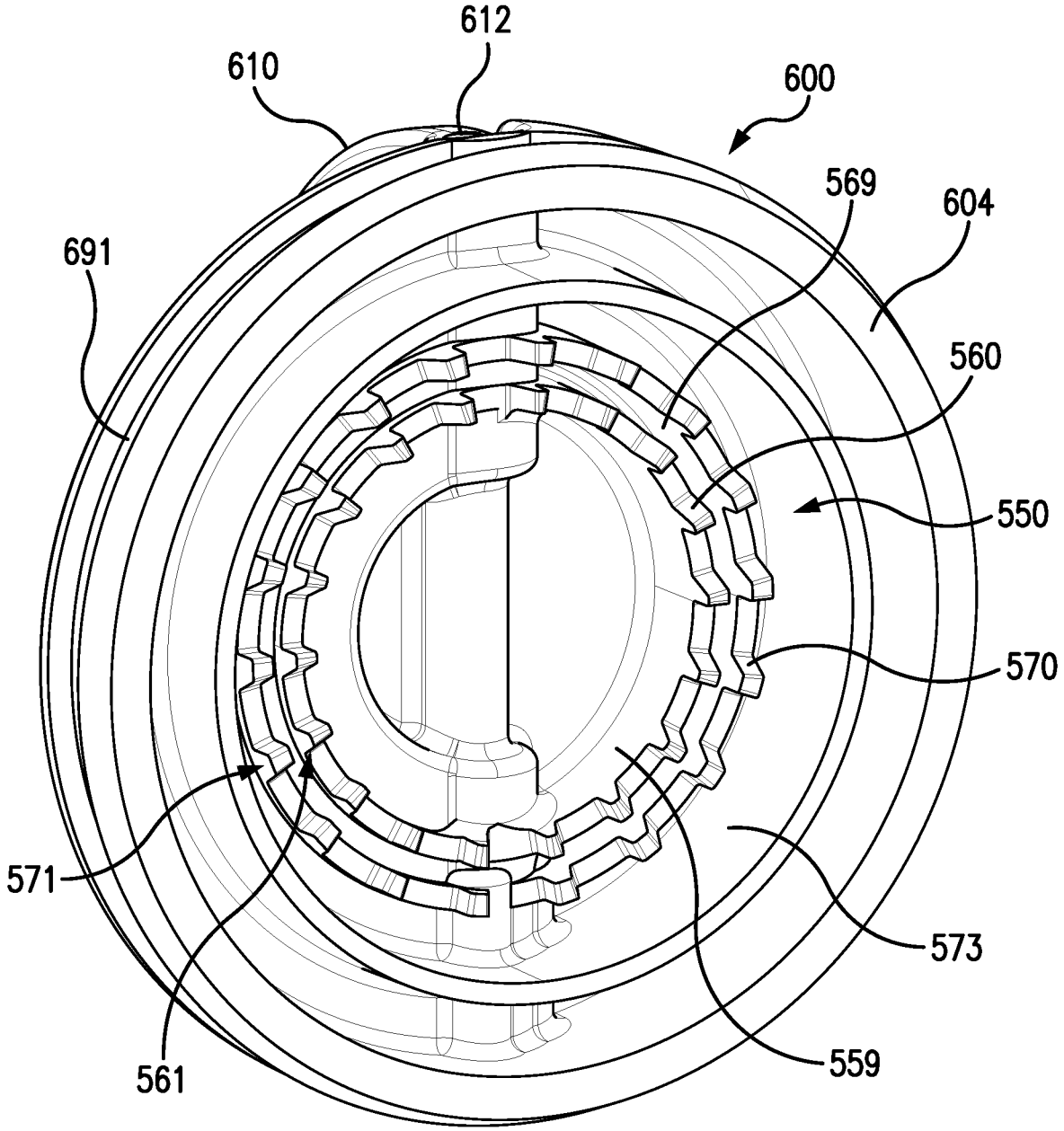
FIG. 3B is a perspective view of the back of the bar tightening knob.

FIG. 3B is a perspective view of the back of the bar tightening knob 600. FIG. 3B shows an inner row 559 of a number of an inner clutch tooth 560 which constitute inner clutch teeth 561. An outer row 569 of number of an outer clutch tooth 570 constitute outer clutch teeth 571. This disclosure is not limited to the number of teeth or type of teeth present in either row of teeth. The number of teeth in the inner row 559 or in the outer row 569 can range from 1 to 100, or greater, e.g. 3, 5, 6, 10, 15, 20, 25, 30, 50, 75, or 100. In another embodiment, the teeth can be in a single row, or staggered, or arranged in another manner which interacts with the clutch plate.

FIG. 3B also shows a knob guide wall 573 which can be configure to circumferentially surround the clutch plate 510 (FIG. 2A) which can have the clutch plate rim 529 at least in part coaxially inserted within the knob guide wall 573 such that at least a portion of the knob guide wall 573 overlaps at least a portion of the clutch plate rim 529. A bar tightening knob body 604 (FIG. 4A) can be configured to be inserted at least in part within the clutch cavity 653 (FIG. 1C).

Figure 4A:
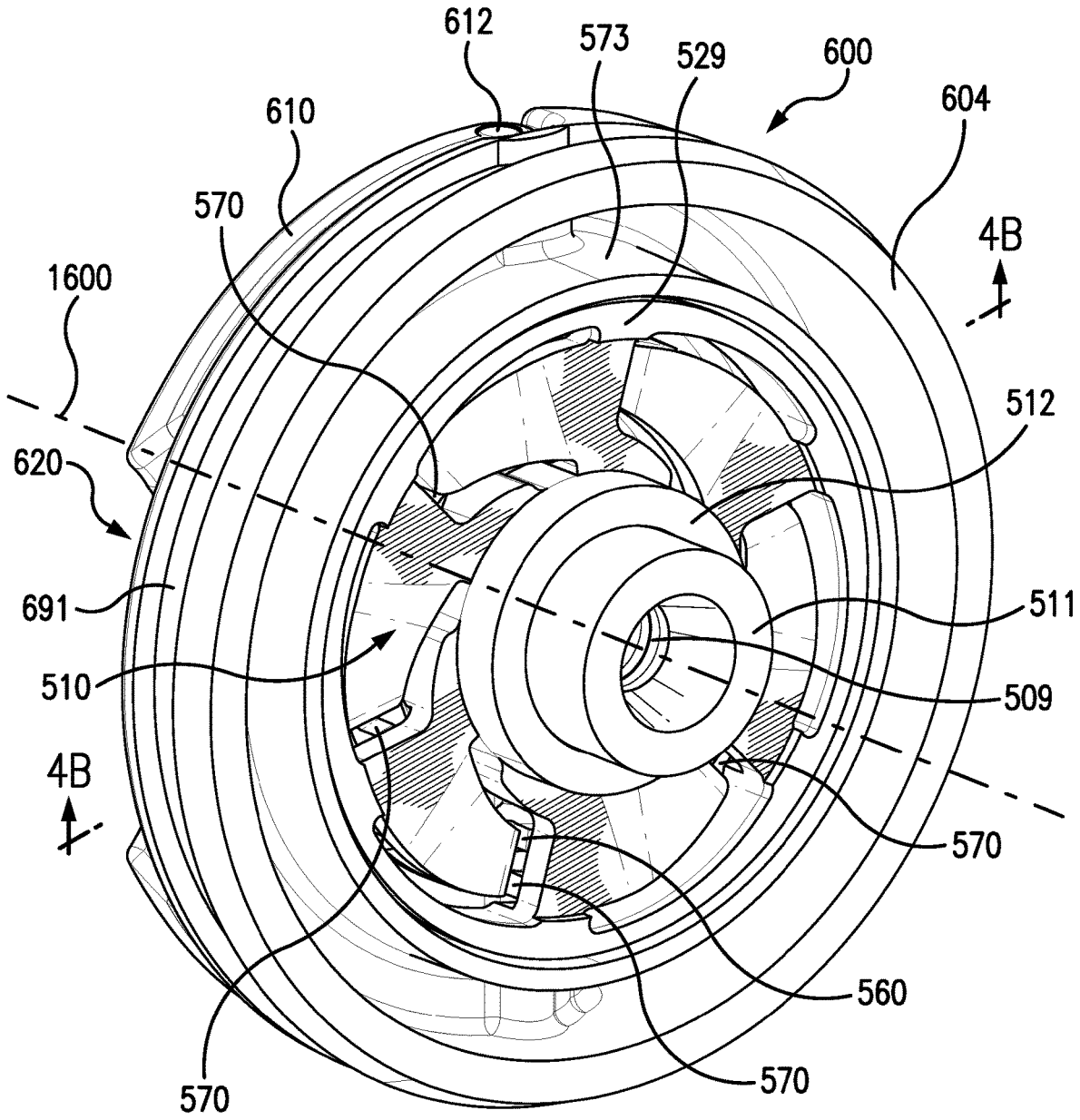
FIG. 4A is an isometric view of the back of the clutch plate when the bar tightening knob is in an engaged position.

FIG. 4A is an isometric view of the back of the clutch plate 510 when the bar tightening knob is in an engaged position. In FIG. 4A, the section shows an example of an assembly having a clutch plate 510 secured within the knob guide wall 573 and coaxial to a bar tightening axis 1600. The bar tightening knob body 604 is also coaxial to the bar tightening axis 1600.

Figure 4B:
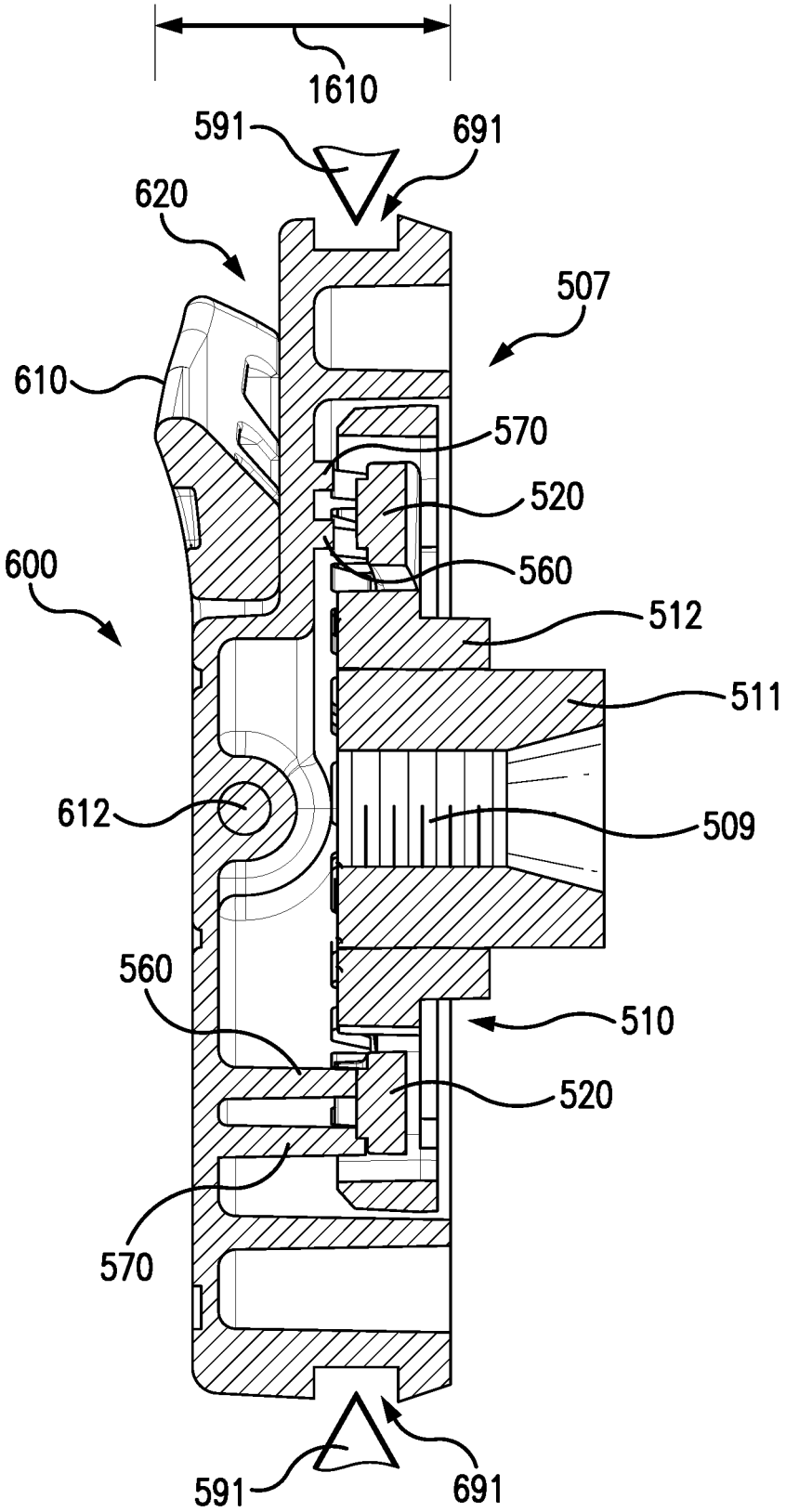
FIG. 4B is a cross sectional view of the clutch mechanism when the bar tightening knob is in an engaged position.

FIG. 4B is a sectional view of the clutch mechanism 507 when the bar tightening knob is in an engaged position. In this example, the bar tightening knob handle 610 is in a recessed state and the bar tightening knob 600 is engaged with the clutch plate 510. A number of an inner clutch tooth 560 are shown interacting with a number of spring fingers 520 and a number of an outer clutch tooth 570 are also shown interacting with a number of spring fingers 520.

FIGS. 5A-5E show an embodiment of the interaction of a clutch tooth 551 with a pawl 526. The examples of FIGS. 5A-5E apply to the interaction of the inner clutch teeth 561 and/or the outer clutch teeth 571. FIG. 5A is a close up view showing a clutch tooth 551 moving toward the pawl face 527 of a pawl 526 of a spring finger 520. In the example of FIG. 5A, the tooth contact face 552 moves in the direction of tooth movement arrow 1552 toward the pawl face 527 of the pawl 526. The pawl 526 can have a pawl back face 519 and a pawl tip 528. The clutch tooth 551 can have a clutch tooth tip 553 and a clutch tooth back face 554. FIG. 5A also shows the spring finger centerline plane 530 which is coplanar to the spring finger centerline 531. FIG. 5A shows the spring finger 520 in its resting state and with no deflection from the spring finger centerline plane 530.

FIG. 5A illustrates a tooth angle 1529 which in an embodiment can have an angle equal to or greater than 90°, or in a range of 90° to 160°, or 90° to 125°, or 90° to 110°, or 90° to 105°, such as 95°, 105°, 110° or 125°, or greater. In an embodiment the tooth angle 1529 is different from the pawl angle 1523. In nonlimiting example, the tooth angle 1529 can be 125°.

In an embodiment, a pawl angle 1523 can be the same or different than the tooth angle. The pawl angle 1523 can have an angle equal to or greater than 90°, or in a range of 90° to 160°, or 90° to 125°, or 90° to 110°, or 90° to 105°, such as 95°, 105°, 110° or 125°, or greater. In an embodiment the pawl angle 1523 is different from the tooth angle 1529. In nonlimiting example, the pawl angle 1523 can be 120°, or 125°.

The deflection angle 539 can range from zero when the spring finger 520 is at a resting state to a maximum value which allows the clutch tooth tip 553 and the pawl tip 528 to clear and pass one another. For example, the deflection angle 539 can have a value in the range from 0° to 75°, or 0° to 66°, or 0° to 33°, or 0° to 15°, or 0° to 10°, or 0° to 5°, or 0° to 3°, such as 2°, 3°, 7°, 10°, or 15°, or greater.

FIG. 5B is a close up view showing a tooth contact face 552 making contact with a pawl face 527 and displacing the spring finger 520 by a deflection angle 539. In this example, the contact of the pawl face 527 imparts a force upon the pawl face 527 which can cause a radial movement of the spring finger 520 and pawl 526 in the direction of pawl displacement arrow 1526. The direction of pawl displacement as shown in FIG. 5B by pawl displacement arrow 1526 is away from spring finger centerline plane 530 forming a deflection angle 539. As the tooth contact face 552 imparts force and the deflection angle 539 increases the pawl face 527 slides along the tooth contact face 552 in the direction of pawl displacement arrow 1526 such that the pawl tip 528 moves toward the clutch tooth tip 553.

FIG. 5C is a close up view of the pawl at a deflection angle 539 allowing the clutch tooth 551 to pass across the pawl tip 528. In the example of FIG. 5C, the deflection angle 539 is at a maximum value when the clutch tooth tip 553 and the pawl tip 528 are tangential and passing one another.

The deflection angle 539 can correspond to a deflection distance 537. The deflection distance can be the distance between the spring centerline plane and the spring finger center line 531. The deflection distance 537 can range from zero when the spring finger 520 is at a resting state to a maximum value which allows the clutch tooth tip 553 and the pawl tip 528 to clear and pass one another. For example, the deflection distance 537 of a spring finger can have a value in the range from 0 mm to 150 mm, or greater, such as or 0 mm to 10 mm, or 0.5 mm to 5 mm, or 0 mm to 3 mm, or 0 mm to 2 mm. In nonlimiting example, the deflection distance 537 can have a value of 0.75 mm, 1 mm, 2 mm, 3 mm, 4 mm, 5 mm, 7 mm, 10 mm, or greater.

In an embodiment, the clutch can engage and allow one or more of a clutch tooth 551 to clear the pawl 526 at a torque in a range of 10 in-lbf to 150 in-lbf, or 10 in-lbf to 50 in-lbf, or 25 in-lbf to 35 in-lbf, or 20 in-lbf to 40 in-lbf, or 50 in-lbf to 75 in-lbf, or 50 in-lbf to 100 in-lbf, such as 10 in-lbf, or 15 in-lbf, or 25 in-lbf, or 50 in-lbf, or 75 in-lbf. In an embodiment, the clutch set point can result in clutch action when the torque exceeds a clutch set point which prevents overtightening of a portion of the tensioning system or chain cover against the chain bar and/or of the chain bar against the chain bar backstop 1991.

FIG. 5D is a close up view of the clutch tooth 551 moving away from the pawl 526 of the spring finger 520. In the example of FIG. 5D, once the clutch tooth tip passes the pawl tip 528, then the pawl 526 will return to its resting position by moving in the direction of a pawl return arrow 1527 to achieve a configuration in which at least a part of the pawl back face 519 is moving toward a location adjacent to the clutch tooth back face 554. During the return step depicted in FIG. 5D, the deflection angle can reduced from its maximum value to a lesser value, reducing the value toward zero.

FIG. 5E is a close up view of the pawl 526 of the spring finger 520 having returned to its rest position. In this resting state, the clutch tooth 551 has cleared the pawl 526 and the spring finger centerline plane 530 is coplanar with the spring finger centerline 531, and the deflection angle 539 is zero.

FIG. 6 is a sectional view showing the chain bar tightening clutch system 500 in an engaged position. In an embodiment, the chain bar tightening clutch system 500 can serve to secure the chain bar 200 between at least a portion of a member of the bar tightening clutch system assembly 505 and the chain bar backstop 1991, or other member. In the example of FIG. 6, the bar tightening clutch system assembly 505 can have an assembly of the bar tightening knob 600, the clutch plate 510 and the clutch plate connector. In an embodiment, the bar tightening clutch system assembly 505 can also include at least a portion of the chain cover 645. As shown in FIG. 6, a portion of the chain cover 645 can be tightened against the chain bar.

In an embodiment, the bar tightening clutch system assembly 505 can be removable from the chainsaw to allow replacement, positioning or maintenance of the chain bar 200. In another embodiment, tightening clutch system assembly 505 can be loosened to allow for positioning or maintenance of the chain bar 200.

In the embodiment shown in FIG. 6, the bar tightening clutch system assembly 505 can be integral to the low profile chain cover 650 and can be removed from the bar tightening bolt 150 to allow for replacement or repair of the chain bar 200 and the chain 250. In an embodiment, the bar tightening clutch system assembly 505 can have a bar tightening knob 600, a chain bar tightening clutch system 500 and a means to reversibly tighten, loosen and/or remove the bar tightening clutch system assembly 505 from the bar tightening bolt 150 and/or from exerting a force against the chain bar 200.

FIG. 6 shows the bar tightening clutch system assembly 505 in an assembled state in which the chain bar 200 has been secured by means of the tightening of at least a portion of the low profile chain cover 650 against the chain bar first surface 260. In the example embodiment of FIG. 6, each of a proximal center rib 191, a distal center rib 192 and the chain cover distal end rib 647 are shown imparting a force and/or pressing against a chain bar first surface 260 when in an engaged and/or tightened position.

The tightening of the low profile chain cover 650 achieves a chain cover height 1000 which has a low profile, such as in a range of 0.25 in to 3.0 in, such as or 0.5, 0.75 in, 1.0 in, 1.25 in, 1.5 in, 1.75 in, 2.0 in or 2.5 in. In an embodiment, the chain cover height 1000 can be in a range of from 5 mm to 100 mm, such as 10 mm, 15 mm, 20 mm, 25 mm, 50 mm, or 75 mm.

The bar tightening clutch system assembly 505 in an assembled state can have a tightening knob face height 1200 of equal to or less than the chain cover height 1000. For example, the knob face height 1200 can be in a range from 0.25 in to 3.0 in, such as 0.5 in, 0.75 in, 1.0 in, 1.25 in, 1.5 in, 1.75 in, 2.0 in or 2.5 in. The knob face height 1200 can be in a range of from 5 mm to 100 mm, such as 10 mm, 15 mm, 20 mm, 25 mm, 50 mm, or 75 mm.

The bar tightening clutch system assembly 505, in an assembled state, can have a clutch place face 613 having a clutch face place height 1100 of equal to or less than the knob face height 1200. In an embodiment, the clutch face height 1100 can be in a range of from 0.25 in to 3.0 in, such as or 0.5 in, 0.75 in, 1.0 in, 1.25 in, 1.5 in, 1.75 in, 2.0 in or 2.5 in. In an embodiment, the clutch face height 1100 can be in a range of from 5 mm to 100 mm, such as 10 mm, 15 mm, 20 mm, 25 mm, 50 mm, or 75 mm.

In an embodiment, the chain cover height 1000 can be in a range of 0.25 in to 2.0 in, or less; the knob face height 1200 can be in a range of from 0.25 in to 1.75 in, or less; and the clutch face height 1100 can be in a range of 0.25 in 1.5 in, or less. In another embodiment, the chain cover height 1000 can be in a range of 0.25 in to 1.5 in, or less; the knob face height 1200 can be in a range of 0.25 in to 1.25 in, or less; and the clutch face height 1100 can be in a range of 0.25 in to 1.0 in, or less. In yet another embodiment, the chain cover height 1000 can be in a range of 0.25 in to 1.25 in, or less; the knob face height 1200 can be in a range of 0.25 in to 0.75 in, or less; and the clutch face height 1100 can be in a range of 0.25 in to 0.5 in, or less.

In an embodiment, the ratio of the chain cover height 1000 to the knob face height 1200 is in a range of 1:1 to 2:1, or 1:1 to 3:1, or 1:1 to 4:1.

Chain Bar Tensioning System (e.g. FIGS. 7A-10B)

FIG. 7A is a sectional view showing a front view of the chain bar tensioning system 300. In an embodiment, the chain bar tensioning system 300 can have a tensioning post 310 which can extend from an offset member 370 and which can be used to position the chain bar 200 and provide tension to the chain 250 (FIG. 8). The offset member 370 bearing the tensioning post 310 can be moved by an operator along a tension traveling range 320 by a tensioning shaft 380. The tensioning shaft 380 can be turned to cause the threaded screw end 382 of the tensioning shaft 380 to drive the offset member 370. The offset member 370 can be moved along an offset guide 359, which in this embodiment can be the offset guide bar 360. The offset guide 359 can be a guide means such as the offset guide bar 360, a guide slot, a housing feature providing a guide, a track, or a guide member.

The use of the offset member 370 achieves a compactness of design of the chain bar tensioning system 300 by allowing the tensioning shaft 380 to be configured adjacent to a portion of the drum 810. The tensioning shaft 380 can be driven by rotating chain tensioning knob 400 in either direction as shown by tensioning arrow 1401 (e.g. clockwise or counterclockwise).

In an embodiment, the offset guide bar 360 can have an offset guide centerline 365. The tensioning shaft 380 can have a tensioning shaft centerline 385. In an embodiment, the offset guide centerline 365 can be configured at a distance from the tensioning shaft centerline 385 which can be a centerline offset 374. In an embodiment, the centerline offset 374 can have a value in a range of 0.1 in to 4 in, or 2.0 in to 3.5 in, or 1.0 in to 2.5 in, or 1.0 in to 2.0 in, or 0.5 in to 1.5 in, or 0.25 in to 1.0 in; such as 0.25 in, or 0.5 in, or 1.0 in, or 1.5 in, or 2.0 in, or 2.5 in, or 3.0 in, or 3.5 in. In another embodiment, the centerline offset 374 can have a value in a range of 3 mm to 100, or 50 mm to 75 mm, or 25 mm to 50 mm, or 15 mm to 40 mm, or 10 mm to 30 mm, or less.

Optionally, the chain tensioning knob 400 can be subflush to chain cover surface 660. In an embodiment, the chain tensioning knob can also have a pivotable handle portion which can be recessed into the tensioning knob port 19.

As shown in FIG. 7A, a portion of the chain brake system 800 is located along the offset system centerline between the chain tensioning knob 400 and the offset member 370. In the example of FIG. 7A a portion of each of the chain tensioning knob 400, the chain brake system 800 and the offset member 370 are at least in part along the offset system centerline 375.

The offset guide bar 360 can have an offset guide diameter 361, an offset guide distal tangent 361 and an offset guide proximal tangent 364. The tensioning shaft 381 can have a tensioning shaft diameter 381, a tensioning shaft distal tangent 383 and a tensioning shaft proximal tangent 384.

The chain bar tensioning system 300 can have a distal offset 373 which can be the distance between the offset guide distal tangent 361 and the tensioning shaft distal tangent 383. In an embodiment, the distal offset 373 can have a value in a range of 0.25 in to 6 in, or 0.25 in to 2.0 in, or 0.25 in to 1.75 in, or 0.25 in to 1.5 in, or 0.25 in to 1.0 in, or 0.25 in to 0.75 in, or 0.25 in to 0.5 in, or 0.25 in to 0.4 in. In another embodiment, the distal offset 373 can have a value in a range of 5 mm to 100 mm, or 10 mm to 75 mm, or 10 mm to 50 mm, or 15 mm to 35 mm, 15 mm to 30 mm, 10 mm to 20 mm, or 5 mm to 15 mm, or 5 mm to 10 mm, or less.

The chain bar tensioning system 300 can have a proximal offset 372 which can be the distance between the offset guide proximal tangent 364 and the tensioning shaft proximal tangent 384. In an embodiment, the proximal offset 372 can have a value in a range of 0.25 in to 6 in, or 0.25 in to 2.0 in, or 0.25 in to 1.75 in, or 0.25 in to 1.5 in, or 0.25 in to 1.0 in, or 0.25 in to 0.75 in, or 0.25 in to 0.5 in, or 0.25 in to 0.4 in. In another embodiment, the proximal offset 372 can have a value in a range of 5 mm to 100 mm, or 25 mm to 75 mm, or 10 mm to 50 mm, or 10 mm to 35 mm, or 10 mm to 25 mm, or 5 mm to 15 mm, or 5 mm to 10 mm, or less.

FIG. 7A also shows the offset member 370 which has an offset member travel centerline 322 which can move along a tensioning travel range 320. As shown in FIG. 7A, the offset member 370 can travel at least a part of tightening distance 324 or a loosening distance 325. In a static state, the offset member travel centerline 322 is located at a distance along the tensioning travel range 320, which can have a distance value for tightening distance 324 and a distance value for loosening distance 325. In an embodiment, the tensioning travel range 320 can be the sum of the tightening distance 324 or the loosening distance 325.

In an embodiment, the tensioning travel range 320 can have a value in a range of 0.25 in to 6 in, or 0.25 in to 2.0 in, or 0.5 in to 1.75 in, or 0.5 in to 1.5 in, or 0.25 in to 1.0 in, or 0.25 in to 0.75 in, or 0.25 in to 0.5 in, or 0.25 in to 0.4 in. In another embodiment, the tensioning travel range 320 can have a value in a range of 5 mm to 100 mm, or 10 mm to 75 mm, or 10 mm to 50 mm, or 5 mm to 30 mm, or 5 mm to 25 mm, or 5 mm to 20 mm, or 5 mm to 10 mm, or less.

In an embodiment, the tightening distance 324 can have a value in a range of 0.25 in to 6 in, or 0.25 in to 2.0 in, or 0.25 in to 1.75 in, or 0.25 in to 1.5 in, or 0.25 in to 1.0 in, or 0.25 in to 0.75 in, or 0.25 in to 0.5 in, or 0.25 in to 0.4 in. In another embodiment, the tightening distance 324 can have a value in a range of 5 mm to 100 mm, or 10 mm to 75 mm, or 10 mm to 50 mm, or 5 mm to 30 mm, or 5 mm to 25 mm, or 5 mm to 20 mm, or 5 mm to 10 mm, or less.

In an embodiment, the loosening distance 325 can have a value in a range of 0.25 in to 6 in, or 0.25 in to 2.0 in, or 0.25 in to 1.75 in, or 0.25 in to 1.5 in, or 0.25 in to 1.0 in, or 0.25 in to 0.75 in, or 0.25 in to 0.5 in, or 0.25 in to 0.4 in, or 0.25 in to 0.3 in. In another embodiment, the loosening distance 325 can have a value in a range of 5 mm to 100 mm, or 5 mm to 75 mm, or 5 mm to 50 mm, or 5 mm to 35 mm, or 5 mm to 30 mm, or 5 mm to 25 mm, or 5 mm to 20 mm, or 5 mm to 15 mm, or 5 mm to 10 mm, or 5 mm to 8 mm, or less.

In an embodiment, a chain brake clearance 807 can be provided between a portion of the chain brake band 805 and the tensioning shaft proximal tangent 384. The chain brake clearance can have a value which ranges from a tangential contact of 0 mm, or can be in a range of less than 0.01 in to 4 in, or greater. In a nonlimiting example, the chain brake band clearance 807 can have a value in a range of 1 mm to 25 mm, such as 3 mm, 4 mm, 5 mm, 10 mm, or greater.

In another embodiment, a chain brake clearance 807 can be provided between a portion of the drum 810 and the tensioning shaft proximal tangent 384. The chain brake clearance can have a value which ranges from a tangential contact of 0 mm, or can be in a range of less than 0.01 in to 4 in, or greater. In the example of FIG. 10B, the chain brake band clearance 807 can have a value in a range of 1 mm to 25 mm, such as 3 mm, 4 mm, 5 mm, 10 mm, or greater.

Figure 7B:
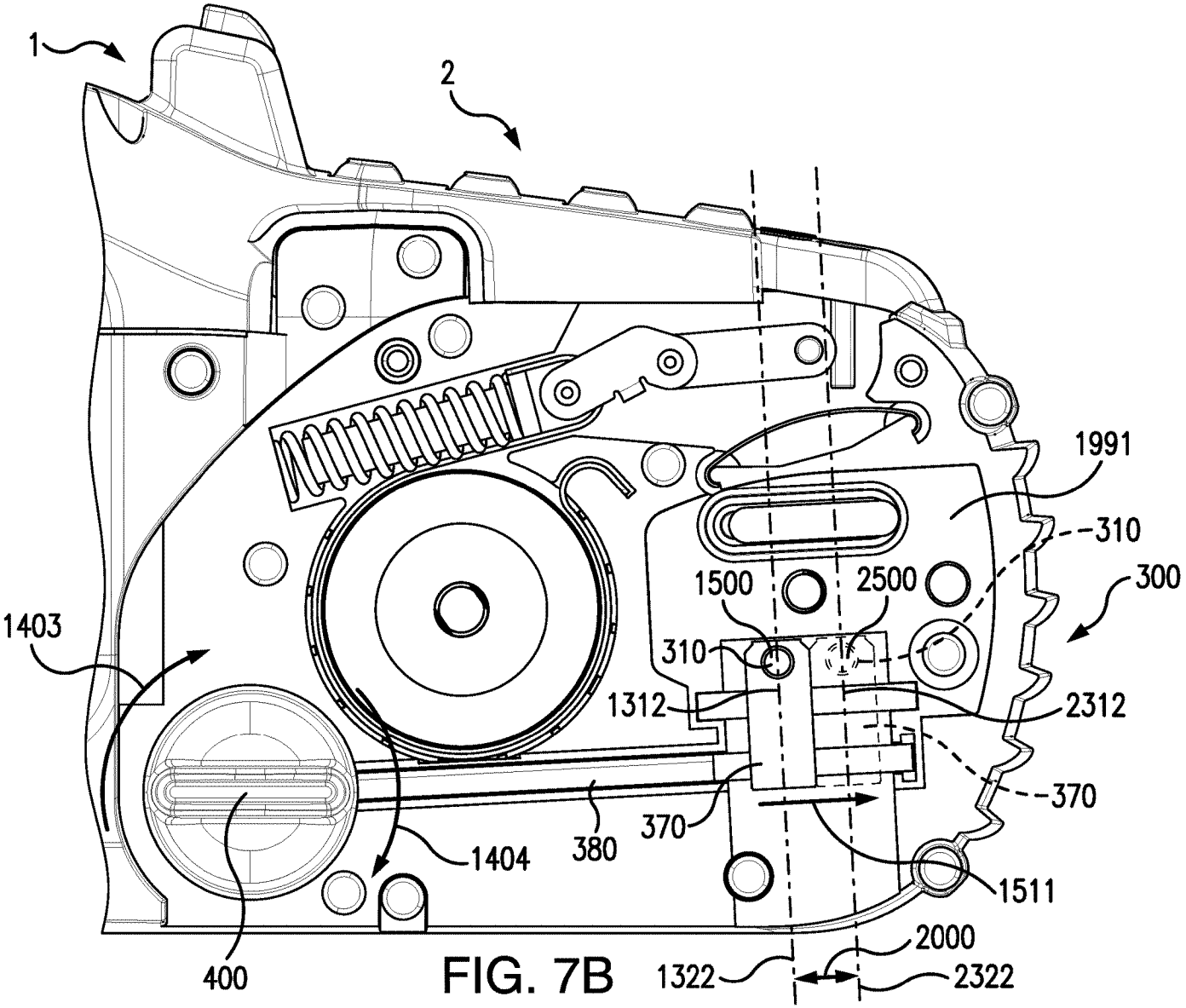
FIG. 7B is a sectional view showing an example of the motion of the chain bar tensioning system.

FIG. 7B is a sectional view showing an example of the motion of the chain bar tensioning system 300. In the example of FIG. 7B, the chain tensioning knob 400 can be turned and/or rotated in the direction of a rotation arrow 1403 or a rotation arrow 1404 through a set of gears rotates the tensioning shaft 380 which moves the offset member 370 which moves the tensioning post 310 from a tensioning post first position 1500 to a tensioning post second position 2500 in the direction of arrow 1511. In the example of FIG. 7B, the tensioning post 310 can have a first tensioning post travel centerline 1312 when in the tensioning post first position 1500 and a second tensioning post travel centerline 2312 when in the tensioning post second position 2500. In the example of FIG. 7B, the distance between the first tensioning post travel centerline 1312 and the second tensioning post travel centerline 2312 is a travel distance 2000.

In an embodiment, the travel distance 2000 can have a value in a range of 4 in, or less; or 2.5 in, or less; or 2.0 in, or less; or 1.75 in, or less; or 1.5 in, or less; or 1.0 in, or less; or 0.75 in, or less; or 0.5 in, or less; such as 0.25 in, or 0.5 in, or 0.75 in, or 1.0 in, or 1.25 in, or 1.5 in, or 1.75 in, or 2.0 in, or 2.5 in, or 3.0 in, or 3.5 in. In another embodiment, the travel distance 2000 can have a value in a range of 125 mm, or less; or 75 mm, or less; or 50 mm, or less; or 40 mm, or less; or 35 mm, or less; or 30 mm, or less; or 25 mm, or less; or 20 mm, or less.

FIG. 8 is a sectional view showing a side view of the chain bar tensioning system 300. The sectional view of FIG. 8 shows the chain tensioning knob 400 having a tensioning knob drive shaft 392 which drives a tensioning transmission system 390 which has a tensioning drive shaft 393 and a tensioning shaft 380. The tensioning knob drive shaft 392 can be engaged to tensioning drive shaft 393 which has a drive miter gear 394 which meshes with and drives output miter gear 396. The output miter gear 396 can turn the tensioning shaft 380 causing the threads of threaded screw end 382 to move the offset member 370 along the offset guide bar 360 which bears the tensioning post 310. In an embodiment, the threaded screw end 382 can be a threaded drive portion 388 of the tensioning shaft 380.

As shown in FIG. 8, the movement of the offset member 370 in either direction of motion shown in offset direction arrow 3115 moves the tensioning post 310 along blade movement direction arrow 3105. A motion of the chain bar 200 away from sprocket 230 increases tension on the chain 250. A motion of the chain bar 200 toward sprocket 230 decreases tension on the chain 250.

Figure 9:
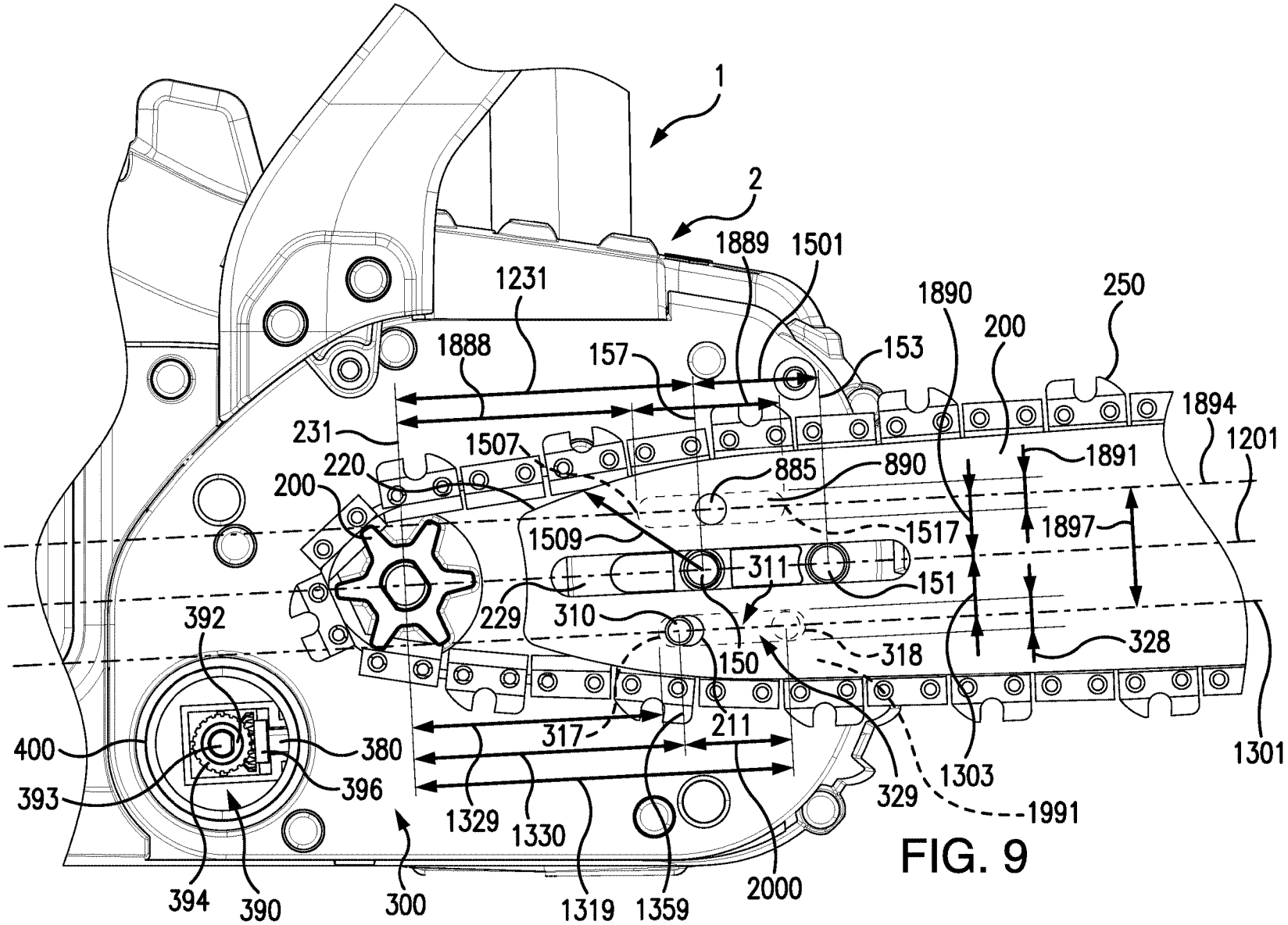
FIG. 9 is a sectional view showing the miter gears of a tensioning transmission system.

FIG. 9 is a sectional view showing the miter gears of a tensioning transmission system 390. In the embodiment of FIG. 9, the tensioning drive shaft 392 can include the tensioning drive shaft 393 which can have the drive miter gear 394. The drive miter gear 394 can be meshed to output miter gear 396 which drives tensioning shaft 380. The example of FIG. 9 shows dimensions of the chain bar tensioning system 300, such as sprocket centerline to a tensioning post centerline distance 1330, which can have a value which can vary according to the offset member centerline 1359 position along the travel distance 2000. In an embodiment, the value of the tensioning post centerline distance 1330 can be in a range of from 1.0 in to 6 in, or 1.5 in to 4 in, or 2.0 in to 3 in, such as 1.75 in, 2.0 in, 2.25 in, 2.5 in, 2.75 in, 3 in, 3.25 in, 3.5 in, or 4 in. The tensioning post centerline distance 1330 can be determined by the operator to be located at a point in the tensioning post guide range 329 along the travel distance 2000.

A tensioning post range guide 329 of the tensioning post channel 311 can extend from sprocket centerline to tensioning post range guide proximal end distance 1329 to a sprocket centerline to tensioning post range guide distal end distance 1319. The tensioning post channel 311 can have a tensioning post guide range width 328 and a tensioning post channel centerline 1301.

The example of FIG. 9 shows a chain bar centerline 1201 from which distances of regarding the tensioning post channel 311 and the oil slot 890 are indicated. An oil slot centerline to chain bar centerline distance 1890 is shown extending between the chain bar centerline 1201 and the oil slot centerline 1894. In an embodiment, the oil slot centerline to chain bar centerline distance 1890 can have a value of 0.25 in, or greater, such as in a range of from 0.25 in to 1 in, or 0.25 in to 0.5 in to 0.75 in, or 0.4 in to 0.75 in, or 0.45 in to 0.55 in, such as 0.45 in, or 0.50 in, or 0.51 in, 0.52 or 0.55 in.

The oil slot 890 can have an oil slot width 1891 which can have a value in a range of from 0.05 in to 0.5 in, or 0.1 in to 0.3 in, or 0.1 in to 0.25 in, such as 0.1 in, 0.12 in, 0.2 in, or 0.3 in. The oil slot length 1889 can extend between the oil slot proximal end 1507 and the oil slot distal end 1517.

The offset guide to chain bar centerline distance 1303 is shown extending between the chain bar centerline 1201 and the tensioning post channel centerline 1301. In an embodiment, the offset guide to chain bar centerline distance 1303 can have a value of 0.25 in, or greater, such as in a range of from 0.25 in to 1.5 in, or 0.25 in to 1.0 in, or 0.25 in to 0.5 in to 0.75 in, or 0.4 in to 0.75 in, or 0.45 in to 0.55 in, such as 0.45 in, or 0.48 in or 0.50 in, or 0.51 in, 0.52, or 0.55 in.

In an embodiment, an oil slot centerline to tensioning post channel centerline distance 1897 can have a value of 0.5 in, or greater, or in a range of 0.5 in to 3.0 in, or 0.5 in to 2.5 in, or 0.5 in to 1.5 in, or 0.5 in to 1.0 in, such as 0.7 in, 0.8 in, 0.9 in, or 1.0 in, 1.1 in, or 1.25 in.

FIG. 9 also shows the guide post to bar tightening bolt distance 1501 which can be the distance between the bar tightening bolt centerline 157 and the guide post centerline 153. In an embodiment, bar tightening bolt distance 1231 can have a value in a range of 0.5 in to 3 in, such as 1.20 in, 1.35 in, or 1.25 in to 1.31 in, or 1.28 in to 1.33 in, or 1.35 in or 1.5 in. In an embodiment, the sprocket centerline to a bar tightening bolt distance 1231 is greater than 1.2 in, such as 1.30 in, or 1.305 in, or 1.31 in.

In an embodiment, the sprocket centerline to bar tightening bolt distance 1231 can be the distance between the sprocket centerline 231 and the bar tightening bolt centerline 157. The bar tightening bolt distance 1231 can have a value in a range of 1.0 in to 6 in, or 1.5 in to 5 in, or 1.5 in to 3 in, or 1.5 in to 2.5 in, such as 1.75 in, or 2.0 in, or 2.25 in, or 2.5 in. In an embodiment, the bar tightening bolt distance 1231 is greater than 1.75 in, such as 1.98 in, 2.0 in, or 2.01 in, or 2.05 in.

The sprocket centerline to oil slot distance 1888 can be the distance from the sprocket centerline 231 to the oil slot distal end 1507. In an embodiment, the sprocket centerline to oil slot distance 1888 can be less than 5 in and varies according to the location of the tensioning post centerline distance 1330 which positions the chain bar 200 relative to the sprocket 230. In an embodiment, the sprocket centerline to oil slot distance 1888 can have a value in a range of from 0.5 in to 5 in, or 0.5 in to 3.5 in, or 1 in to 2.5 in, such as 1 in, 1.5 in, 2 in, or 3.0 in.

The bar tightening bolt to chain bar outer radius 1509 is shown. In an embodiment, the bar tightening bolt to chain bar outer radius 1509 can have a value which is equal to or greater than 1 in, or in a range of 1.0 in to 8 in, or 3.0 in to 7.5 in, or 2.5 in to 6 in, or 3.0 in to 6 in, such as 2.0 in, 3.0 in, 4.0 in, 5.0 in or 6 in.

Figure 10A:
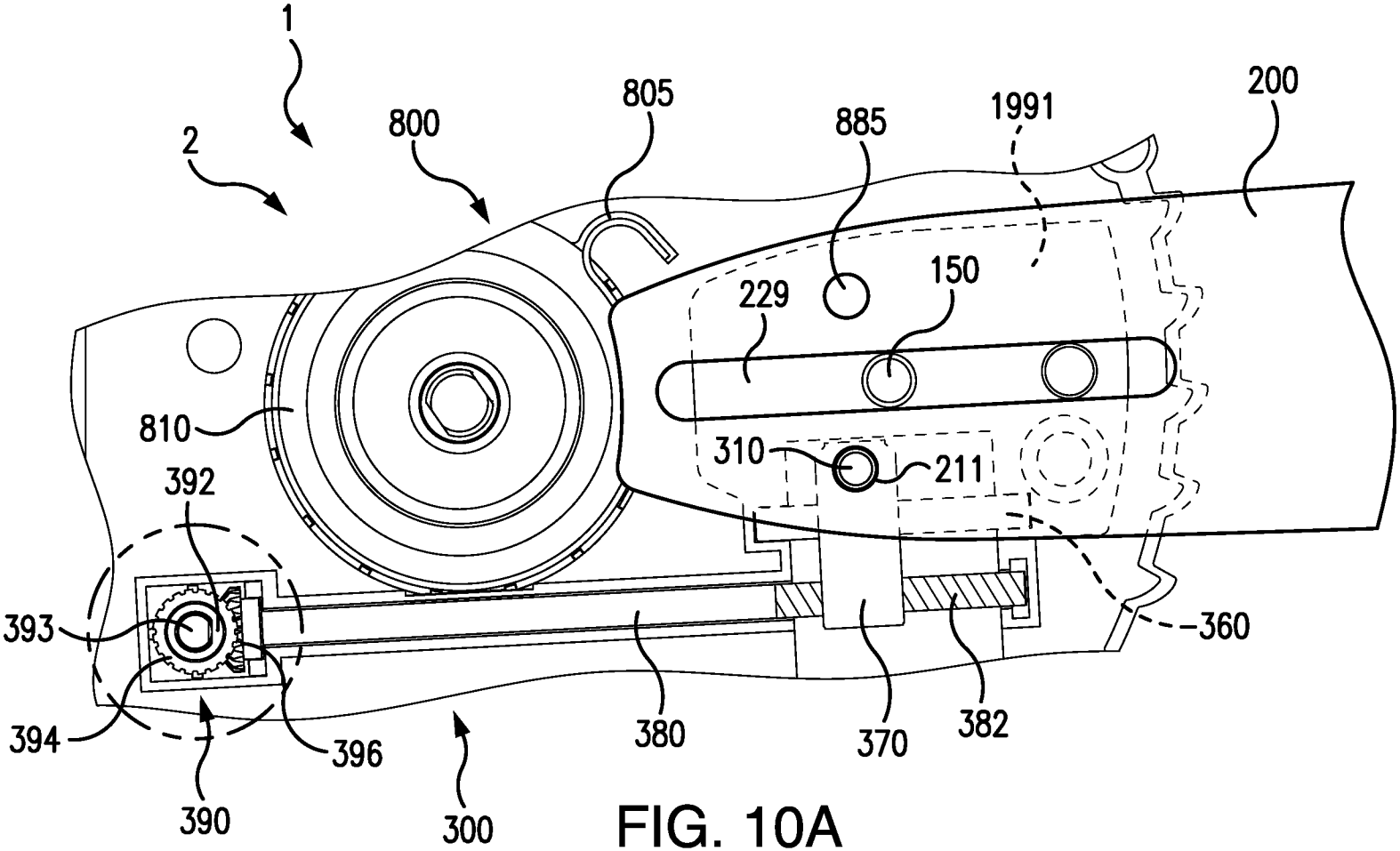
FIG. 10A is a sectional view showing a front view of the chain bar tensioning system and the miter gears of a tensioning transmission system.
Figure 10B:
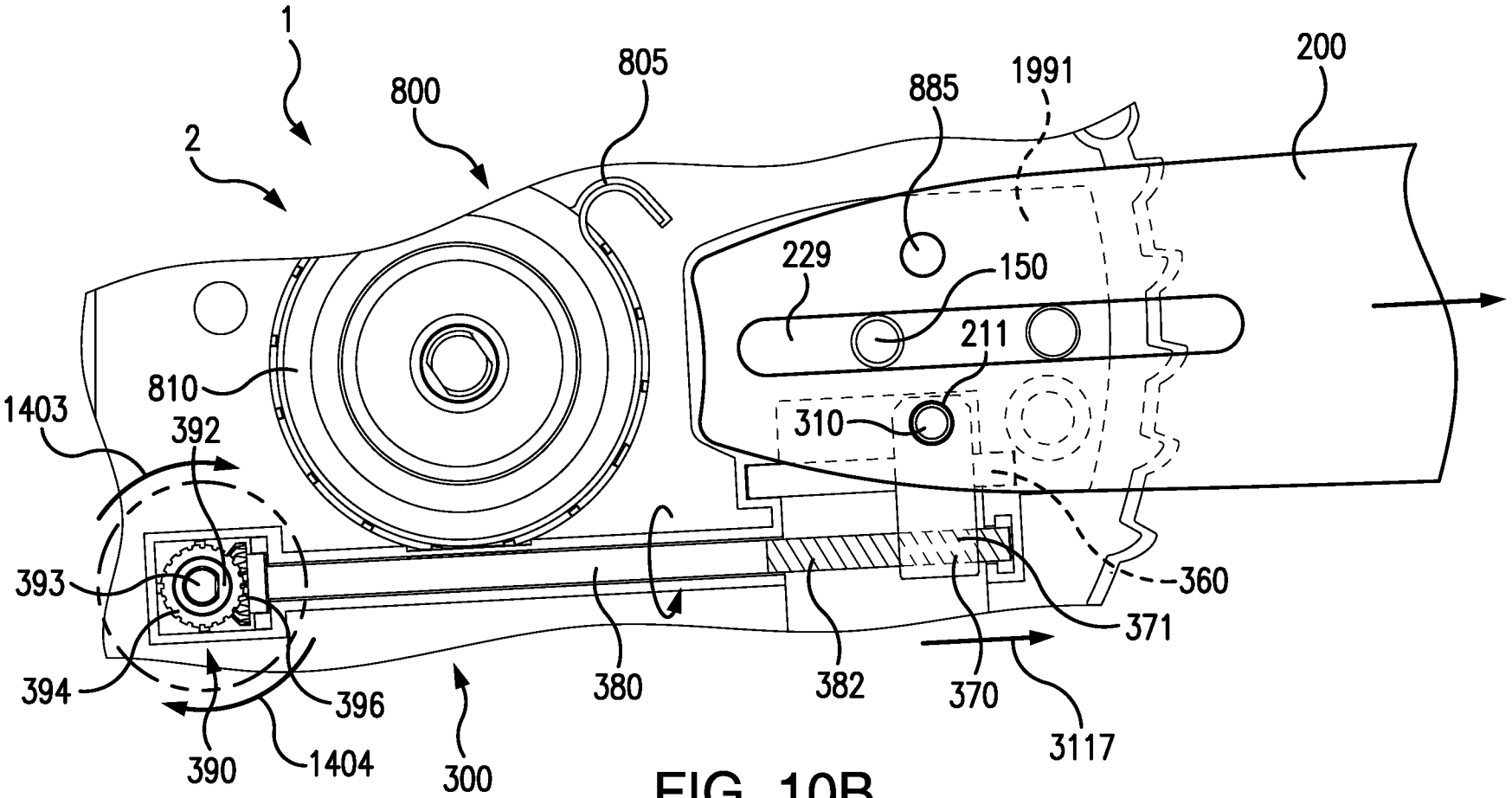
FIG. 10B is a sectional view showing a front view of the chain bar tensioning system and the motion of the tensioning shaft during an example of operation of the tensioning system.

FIG. 10A is a sectional view showing a front view of the chain bar tensioning system and the miter gears of a tensioning transmission system. FIG. 10A is a sectional view showing the tensioning shaft 380 having threaded screw end 382 which drives the offset member 370 which moves the tensioning post 310. In the example of FIG. 10A, the tensioning post 310 is positioned in a relaxed position such that a portion of the chain bar 200 overlaps a portion of the chain brake band 805 and drum 810 of the chain brake system 800. In this configuration, the chain 250 is untensioned and can be removed or replaced. FIG. 10B shows the tensioning post 310 moved to a position in which the chain 250 will be under tension, for example for use in chainsaw sawing operations.

FIG. 10B is a sectional view showing a front view of the chain bar tensioning system 300 and the motion of an example of operation of the tensioning system to increase tension on the chain 250. In the example of FIG. 10B, the rotation and/or turning of the chain tensioning knob 400 in the direction of a rotation arrow 1403 and a rotation arrow 1404 causes the transmission of force to drive the rotation of the tensioning shaft 380 which screws the threaded end against and/or into the offset member threads 371 of offset member 370 which causes the offset member 370 to move the tensioning post 310 away from the sprocket 230 in the direction of tensioning arrow 3117 which increases tension on a chain 250. When the chain 250 is properly tensioned for use, the chainsaw can be used for sawing operations.

Oil Cap (FIGS. 11-14F)

Figure 11:
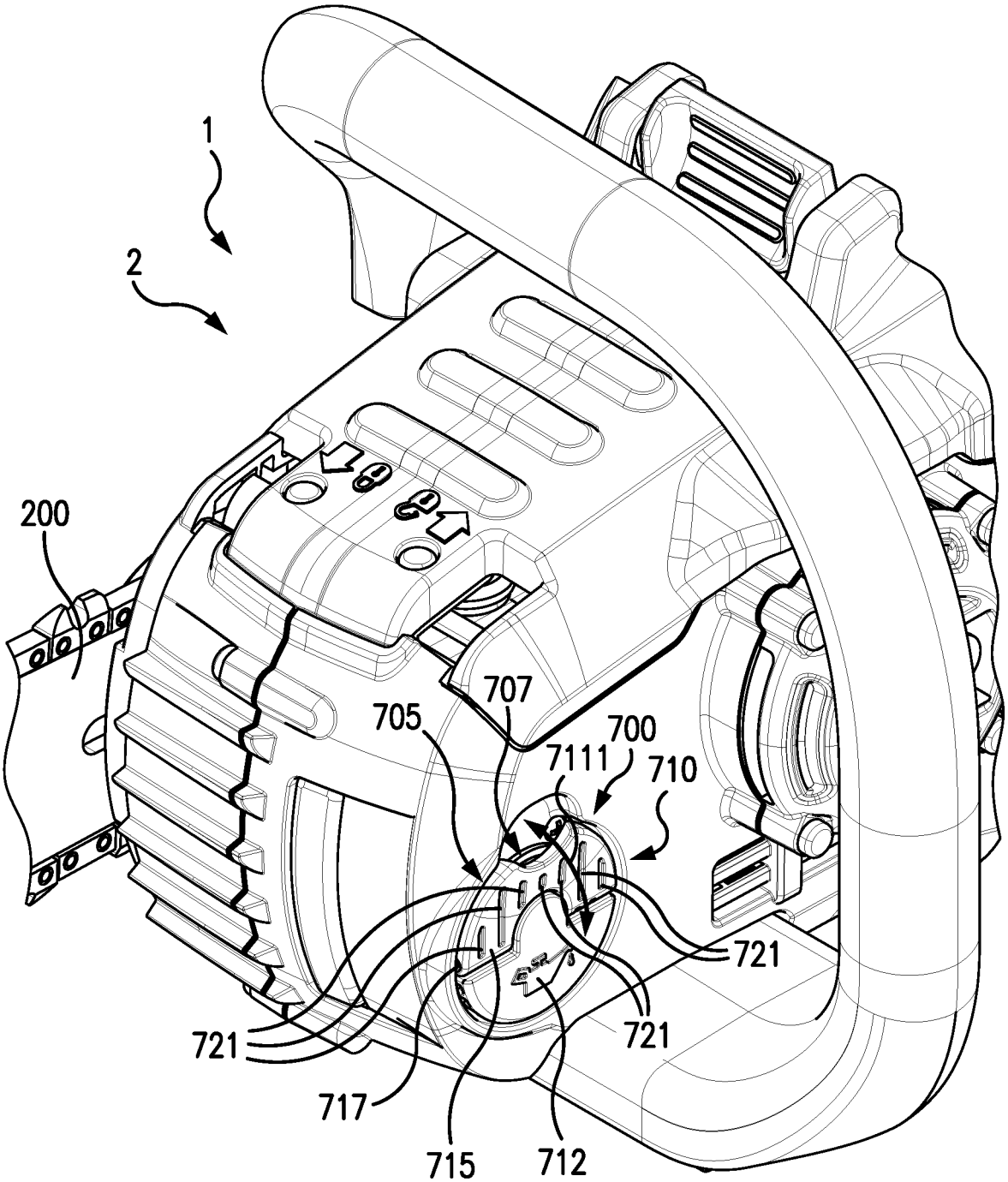
FIG. 11 is a perspective view of the chainsaw showing an oil cap.
Figure 12:
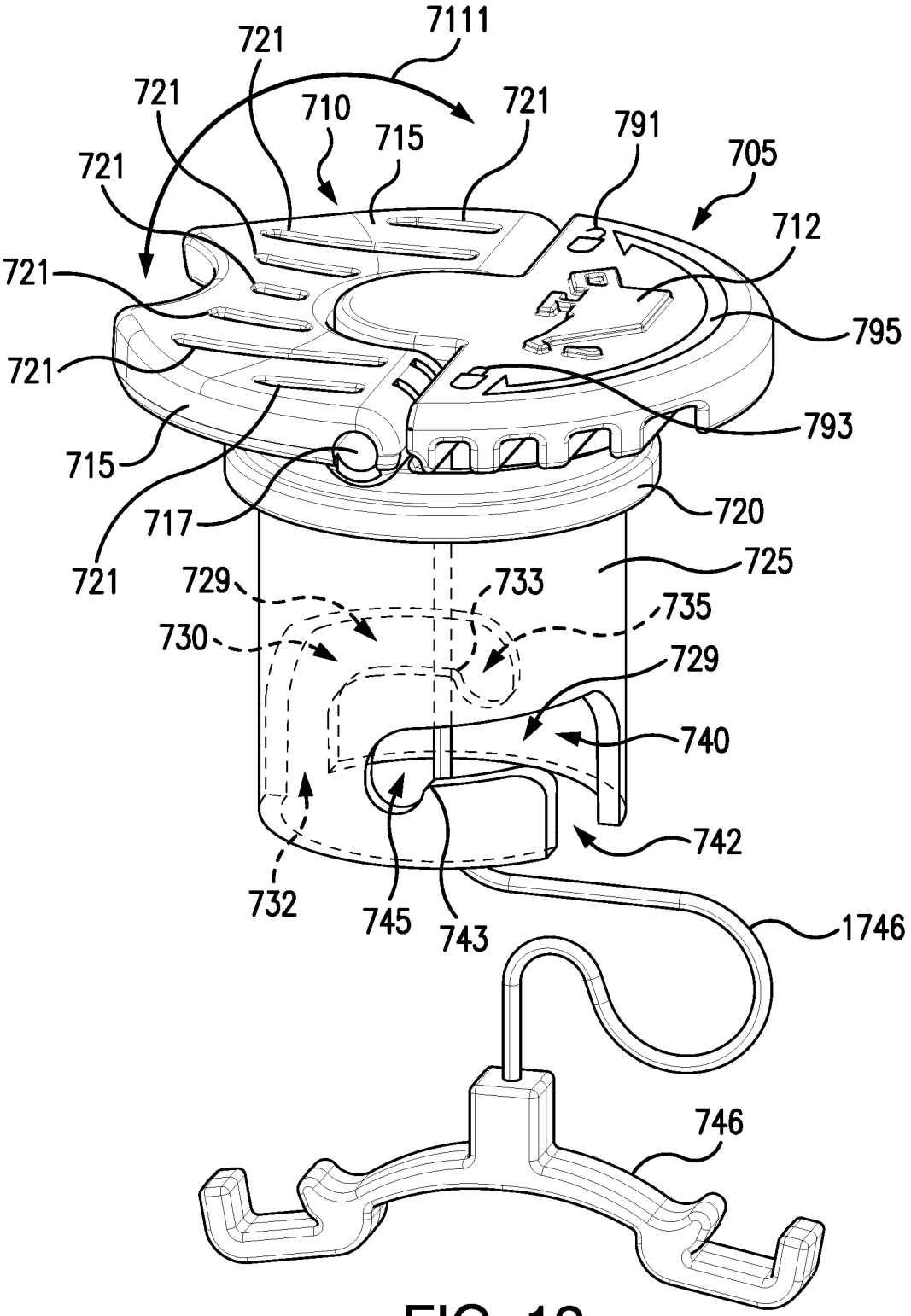
FIG. 12 is a perspective view of the oil cap assembly.

FIG. 11 is a perspective view of the chainsaw showing an oil bottle assembly 700 having an oil cap assembly 705 which can have an oil cap 710, and which has an oil cap handle 715 in its recessed state. The oil cap handle 715 can pivot from the recessed state to a projecting state, as shown by pivot arrow 7111, by a pivoting means such as an oil cap hinge 717. Optionally, the oil cap handle 715 can be configured to provide an oil cap finger access 707 when in a recessed state. Optionally, the oil cap 710 can bear symbols or markings which an operator can view and/or feel during use of the oil cap 710 (FIG. 12). As shown in FIG. 11, the oil cap 710 can show an oil can symbol 712. Optionally, the oil cap 710 can have one or more of a handle slot 721 which the operator can feel when touching and/or tightening the oil cap handle 715. The number of the oil cap handle slot 721 provides a visual and tactile indication of which portion of the oil cap 710 is the oil cap handle 715 portion, as well as providing a gripping surface when turning and/or rotating the oil cap handle 715.

FIG. 12 is a perspective view of the oil cap assembly 705. The example oil cap 710 shown in FIG. 12 can have the oil cap handle 715 which is pivotably attached by means of the oil cap hinge 717. The oil cap handle 715 can be reversibly pivoted in the directions shown by pivot arrow 7111. The oil cap can have an oil cap seal 720 which seals against leakage when the oil cap is in a locked and/or closed configuration against the oil bottle adapter 747 (FIG. 13B). The oil cap can have an oil cap body 725 which can have one or more of a lock channel 729. The example embodiment of FIG. 12 shows a first lock channel 730 and a second lock channel 740. The first lock channel 730 can have a first lock channel entry 732 and a first detent 733 adjacent to a first channel cavity 735. The second lock channel 740 can have a second lock channel entry 742 and a second detent 743 adjacent to a second channel cavity 745. Optionally, the oil cap 710 can have an oil bottle anchor 746 attached to the cap by an attachment means, such as a chain, member, anchor cord 1746, flexible member, or other connector. Optionally, one or more of a directional arrow 795 and/or symbols can be used with to illustrate the direction of rotation to unlock and/or lock the oil cap. In an embodiment, an unlock symbol 791 and a lock symbol 793 can be used.

In an embodiment, the oil cap 710 and/or the oil cap body 725 and/or oil cap seal 720, or other portion of the oil cap assembly 705, can be made at least in part or wholly of a metal, a polymer, a plastic, a reinforced polymer, a reinforced plastic, a ceramic, a cured resin, a thermoplastic or other material suitable for the uses described herein. In an embodiment, the oil cap 710 and/or the oil cap body 725 and/or oil cap seal 720, or other portion of the oil cap assembly 705, can be made at least in part of a 30% glass fiber reinforced, heat stabilized, black polyamide 6 resin for injection molding, such as DSM Akulon® N24-G6 PA6-GF30 (DSM, Het Overloon 1, 6411 TE Heerlen (NL), Tel. +31 (0)45 578 8111). In another embodiment, the oil cap 710 and/or the oil cap body 725 and/or oil cap seal 720, or other portion of the oil cap assembly 705, can be made at least in part of a carbon fiber reinforced polymer which can be 10% or greater by mass of carbon fiber. The percent of material reinforcement can vary widely to satisfy the uses disclosed herein.

Figure 13A:
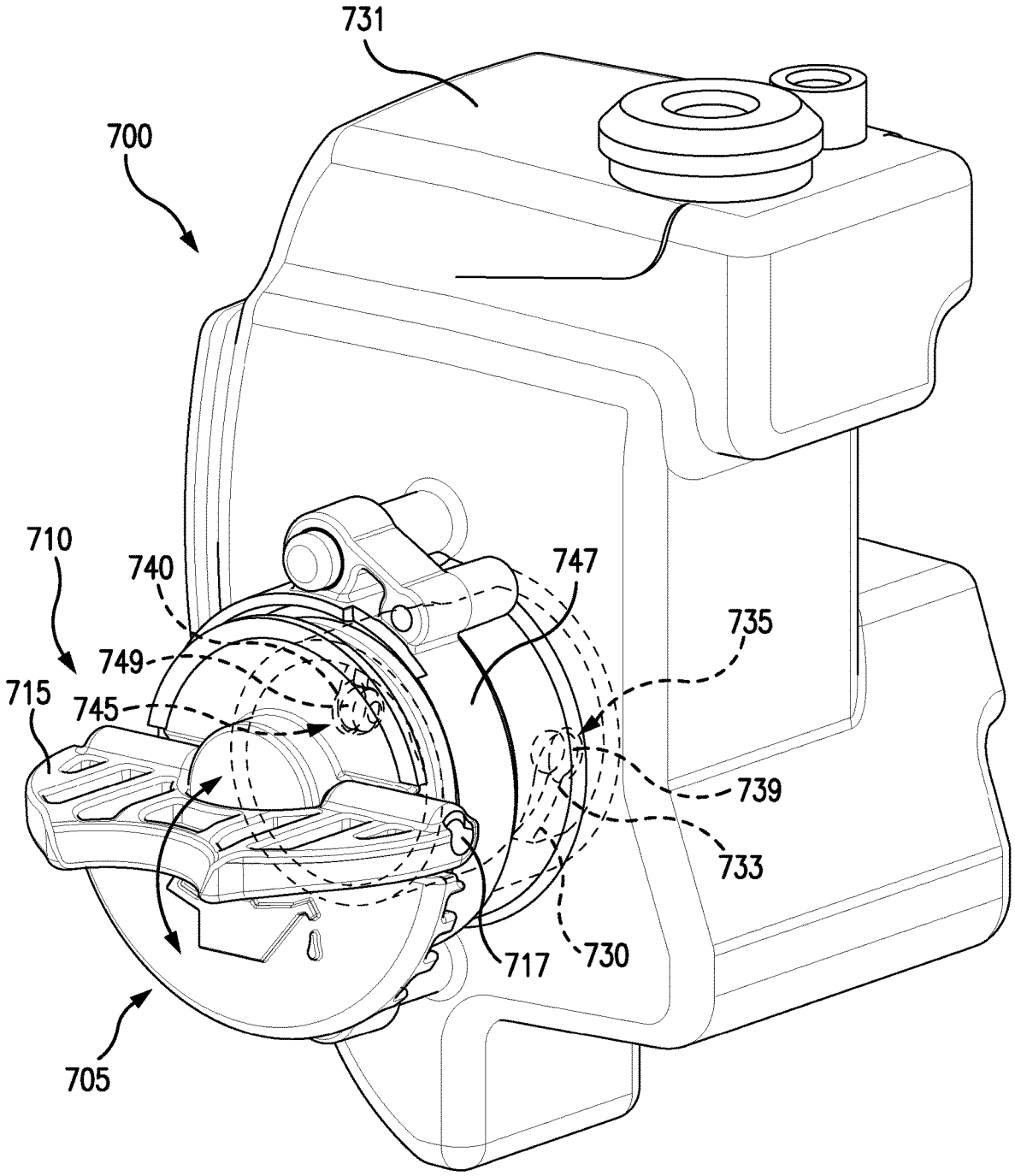
FIG. 13A is a perspective view in which the oil cap assembly has been inserted into the oil bottle adapter and is in a locked position.
Figure 13B:
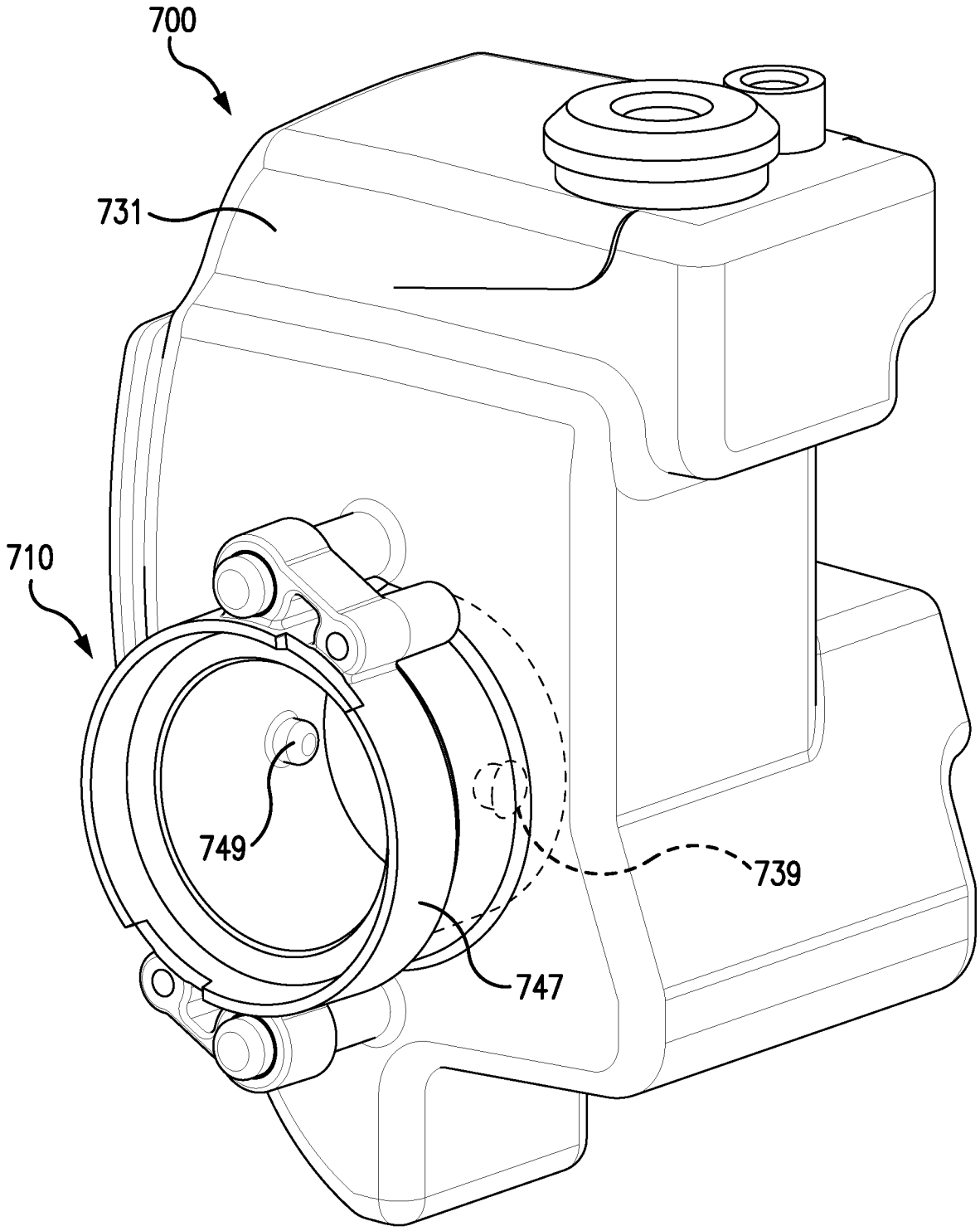
FIG. 13B is a perspective view of an oil bottle adapter sectioned to show a first adapter post and a second adapter post.

FIG. 13A is a perspective view in which the oil cap assembly 705 has been inserted into the oil bottle adapter 747 and is in a locked position. FIG. 13A shows the oil bottle assembly 700 having the oil cap assembly 705 in a locked position sealed against an oil bottle adapter 747 of oil bottle 731. The oil bottle 731 can be selected from a broad variety of oil reservoirs which can be used with an oil cap 710.

Figure 14A:
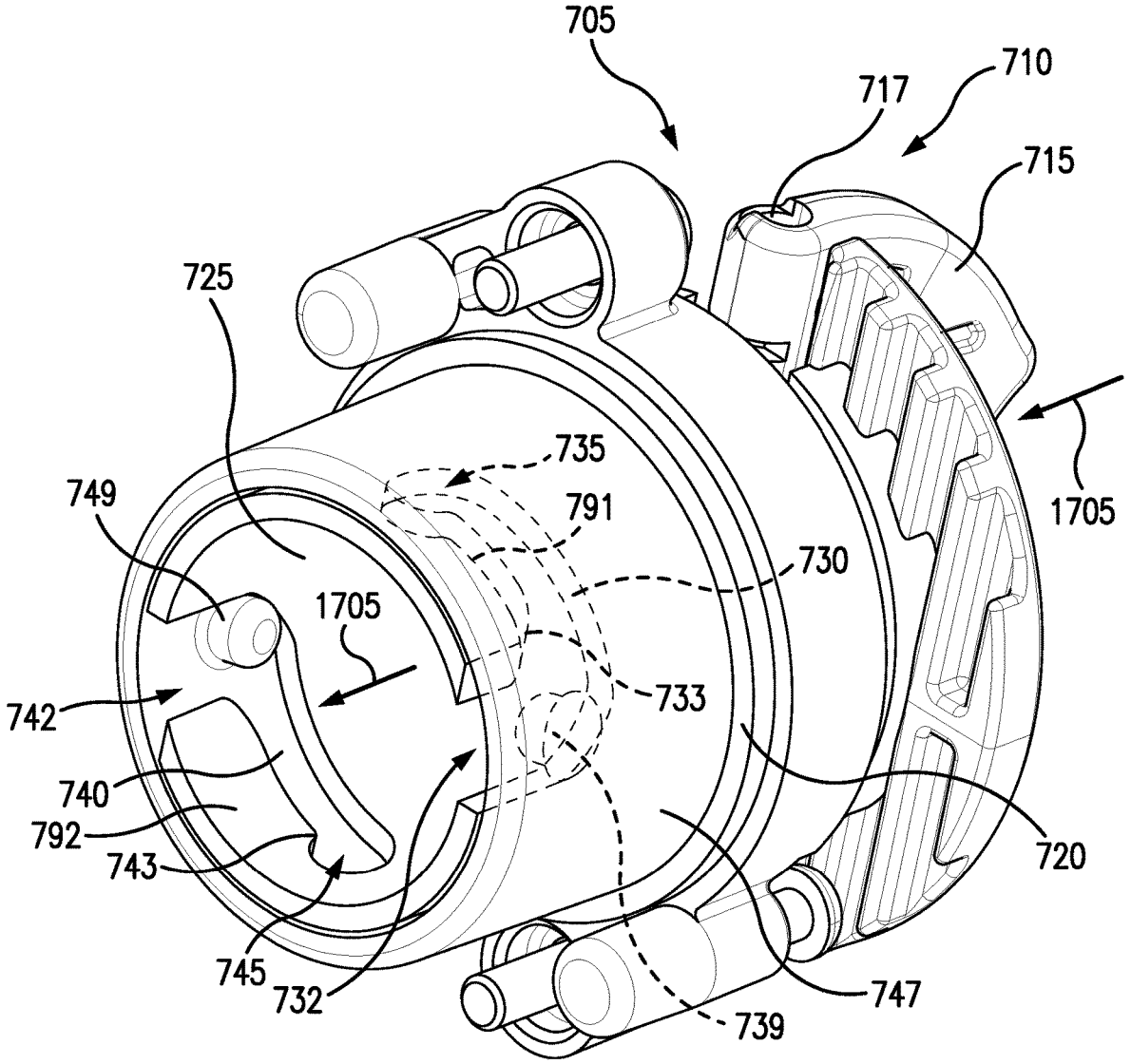
FIG. 14A is a perspective view from the bottom of an oil cap body inserted into an oil bottle adapter such that the first adapter post configured in the first channel entry and the second adapter post configured in the second channel entry.

FIG. 13A shows a first adapter post 739 configured in an engaged state and/or locked state with the first channel cavity 735 adjacent to the first detent 733. A second adapter post 749 is shown configured in an engaged state and/or locked state with the second channel cavity 745 adjacent to the second detent 743 (FIG. 14A).

FIGS. 13B and 13B1 is a perspective view and a front view, respectively of an oil bottle adapter 747 showing the first adapter post 739 and the second adapter post 749.

Figure 13C:
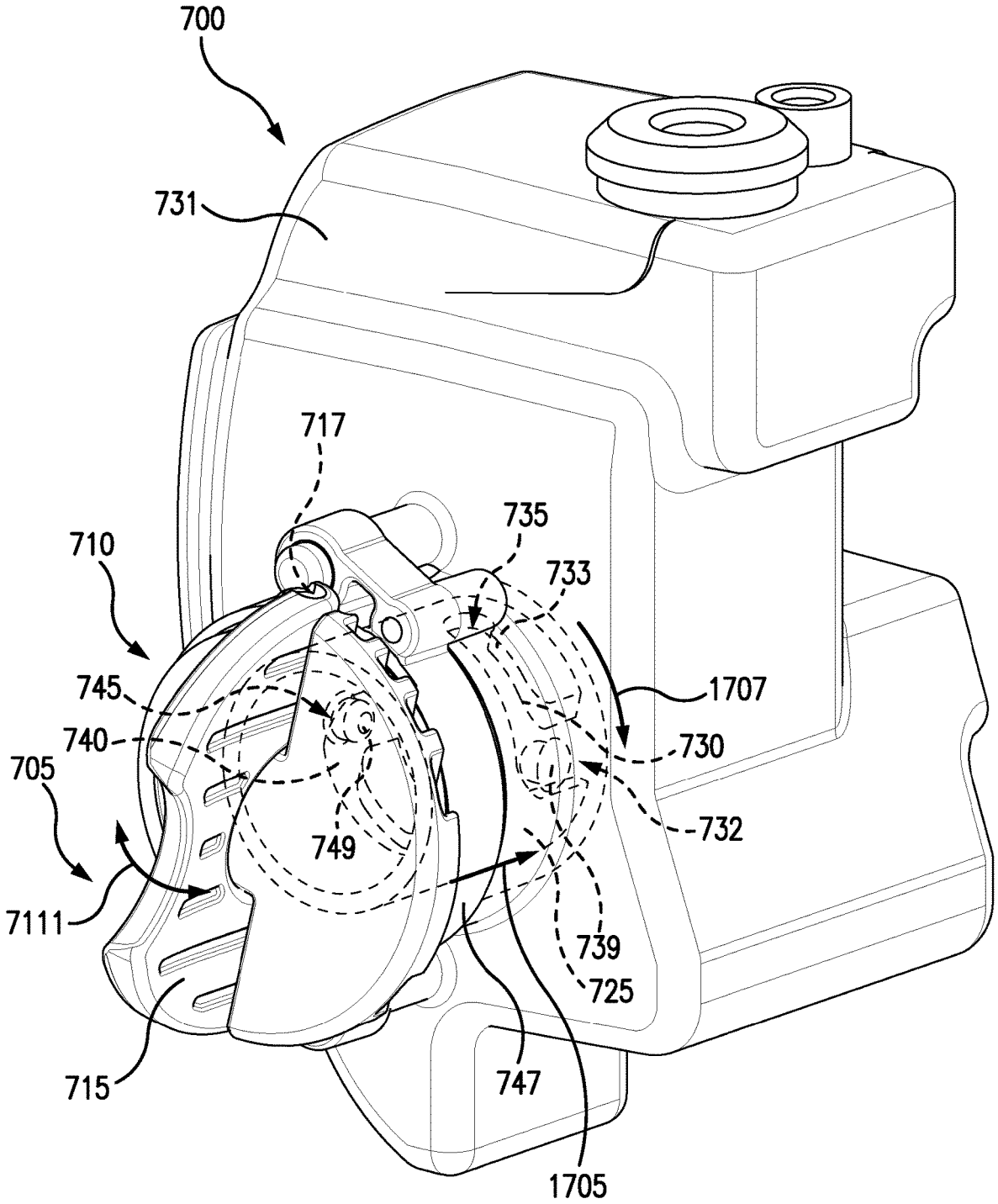
FIG. 13C is a perspective view of an oil bottle adapter sectioned to show the first adapter post configured in the first channel entry and the second adapter post configured in the second channel entry for rotation to achieve a locked position.

FIG. 13C is a perspective view of an oil bottle adapter configured to have the first adapter post 739 positioned in the first channel entry 732 and the second adapter post configured in the second channel entry 742 for rotation to achieve a locked position. FIG. 13C shows insertion arrow 1705 which illustrates the insertion of the oil cap body 725 into the oil bottle adapter 747. A locking direction arrow 1707 shows the rotational motion of the oil cap 710 which will move the first adapter post 739 along first lock channel 730 toward the first detent 733, as well as move the second adapter post 749 toward the second detent 743.

Figure 13D:
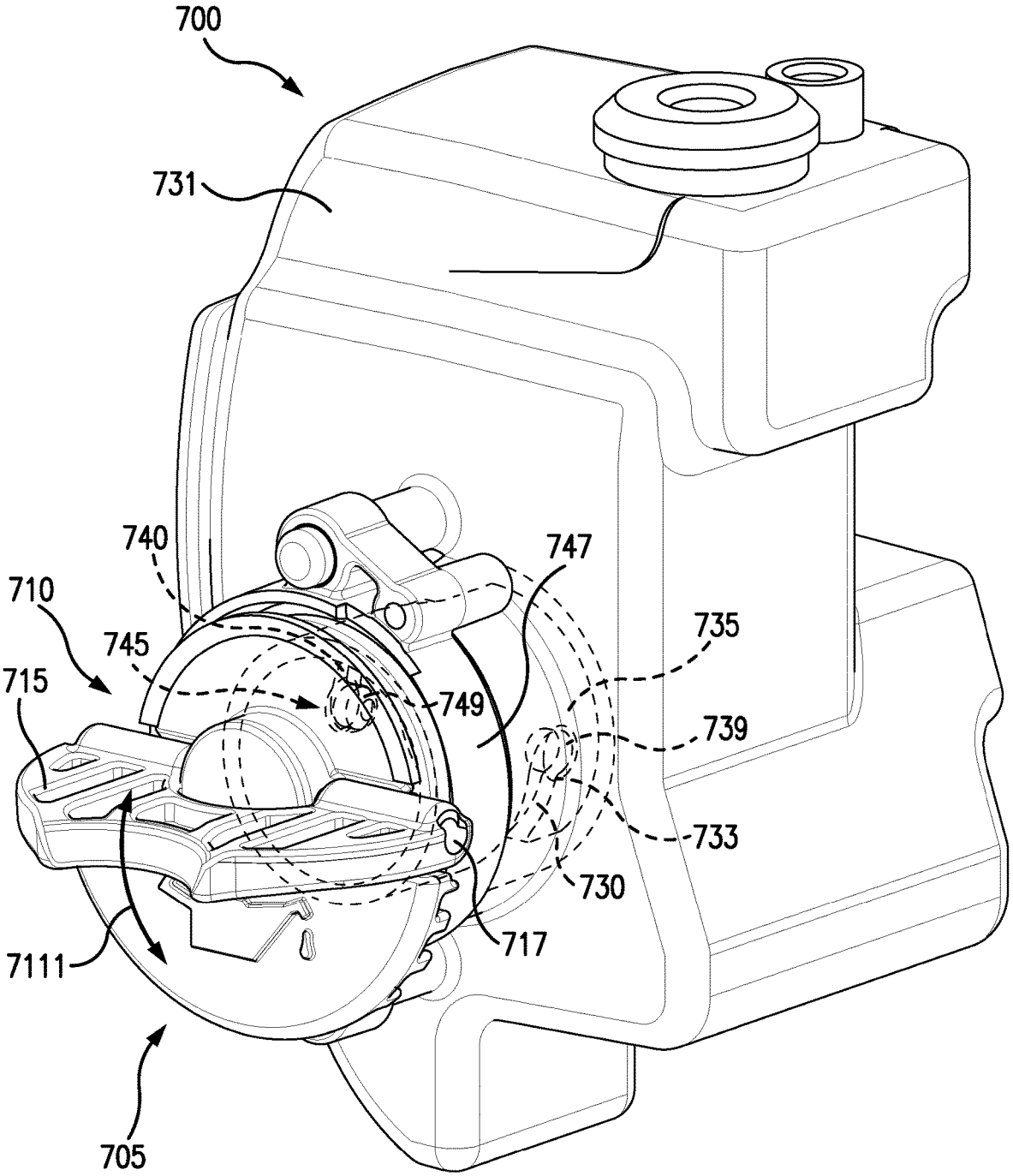
FIG. 13D is a perspective view in which the oil cap assembly has been rotated to achieve a locked configuration.

FIG. 13D is a perspective view in which the oil cap assembly 705 has been rotated to achieve a locked configuration. FIG. 13D is analogous to FIG. 13A, each of which shows a first adapter post 739 reversibly configured in an engaged state with the first channel cavity 735 adjacent to the first detent 733. A second adapter post 749 is shown reversibly configured in an engaged state with the second channel cavity 745 adjacent to the second detent 743.

FIG. 14A is a perspective view from the bottom of an oil cap body 725 inserted into the oil bottle adapter 747 such that the first adapter post 739 is configured in the first channel entry 732 and the second adapter post 749 is configured in the second channel entry 742. The example of FIG. 14A shows the oil cap 710 being inserted into the oil bottle adapter 747 in the direction of insertion arrow 1705. The use of the first adapter post 739 and the second adapter post 749 which each project from the oil bottle adapter 747 and assist the user in inserting the oil cap assembly 705 into the oil bottle 731 in a proper orientation such that the first adapter post 739 can enter into and pass through in the first channel entry 732 and the second adapter post 749 can enter into and pass through the second channel entry 742. When the first adapter post 739 is configured to enter a first lock channel 730 and the second adapter post 749 is configured to enter a second lock channel 740, then the oil cap assembly 705 has been inserted into the oil bottle adapter 747 and the operator can turn the oil cap assembly 705 to engage and lock the oil cap assembly 705 to the oil bottle 731 which will seal the oil bottle 731 by means of oil cap seal 720 from spilling and/or leaking oil from the oil bottle 731.

Figure 14B:
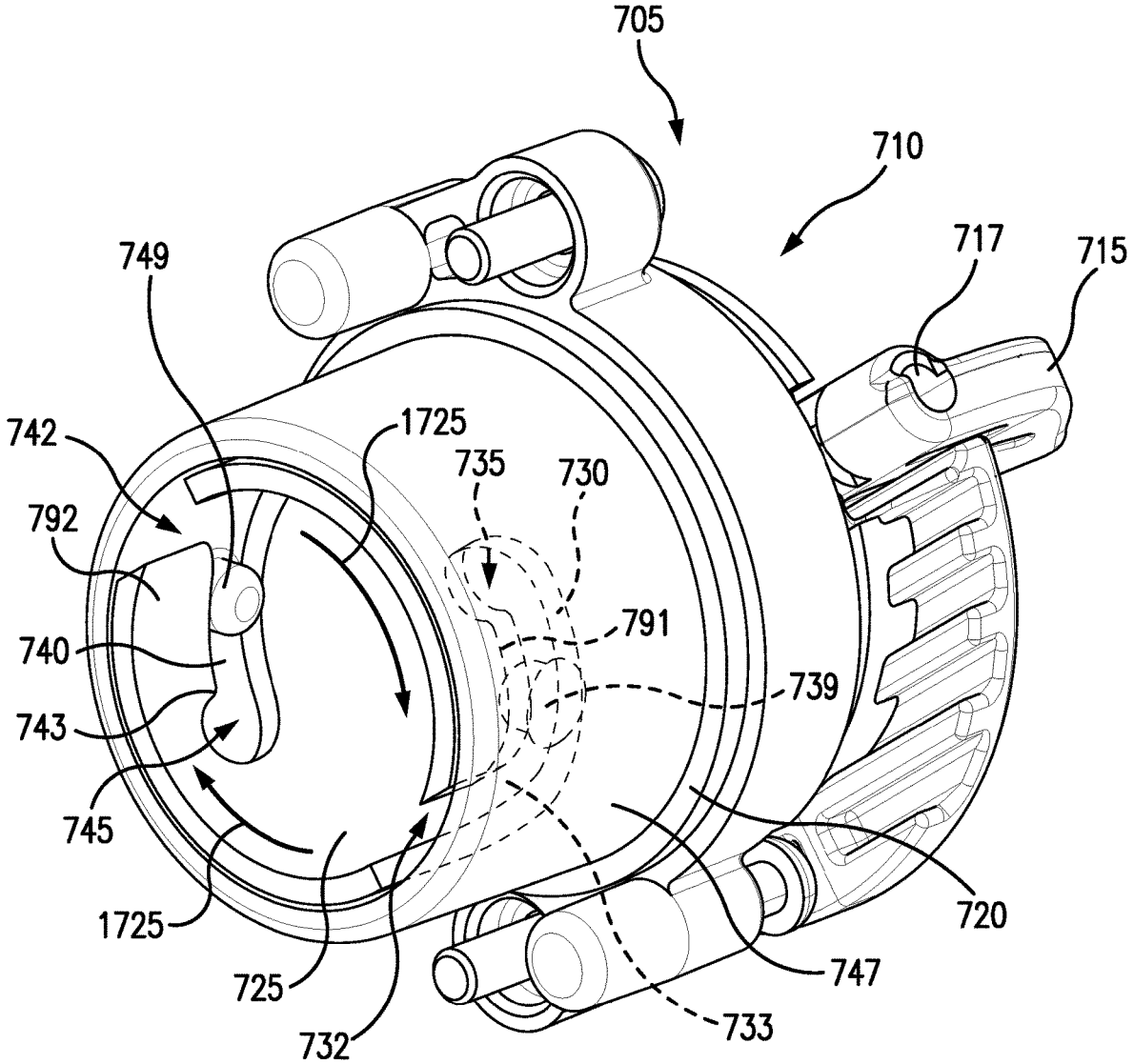
FIG. 14B is a perspective view from the bottom of an oil cap body inserted into an oil bottle adapter showing the oil cap assembly being rotated to move the first adapter post along the first channel and the second adapter post along the second channel.

FIG. 14B is a perspective view from the bottom of an oil cap body 725 inserted into an oil bottle adapter 747 showing the oil cap assembly 705 being rotated to move the first adapter post 739 along the first lock channel 730 and the second adapter post 749 along the second lock channel 740. In the example of FIG. 14B, the operator can rotate the oil cap assembly 705 in the direction of channel lock direction arrow 1725 which moves the first adapter post 739 along the first lock channel 730 toward the first detent 733 and the second adapter post 749 along the second lock channel 740 toward the second detent 743.

Figure 14C:
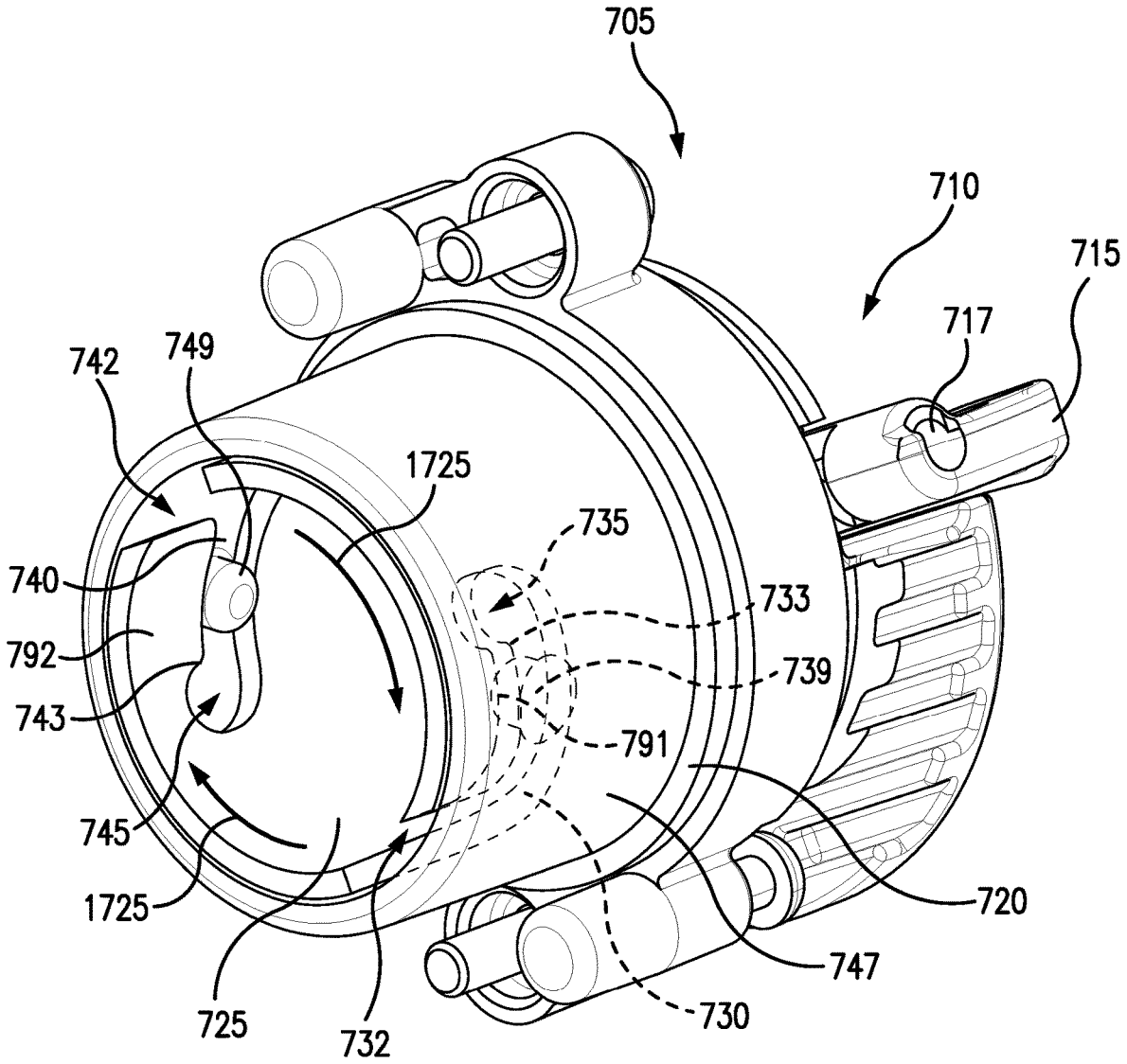
FIG. 14C is a perspective view from the bottom of an oil cap body inserted into an oil bottle adapter showing the oil cap assembly being rotated to move the first adapter post to approach the first detent and the second adapter post to approach the second detent.

FIG. 14C is a perspective view from the bottom of an oil cap body 725 inserted into an oil bottle adapter 747 showing the oil cap assembly 705 being rotated to move the first adapter post 739 to approach the first detent 733 and the second adapter post 749 to approach the second detent 743. In the example of FIG. 14C, the first adapter post 739 has been moved by the operator in the direction of channel lock direction arrow 1725 approximately one half of the length of the first lock channel 730 to approach the first detent 733, and the second adapter post 749 has been moved by the operator in the direction of channel lock direction arrow 1725 approximately one half of the length of the second lock channel 740 to approach the second detent 743.

Figure 14D:
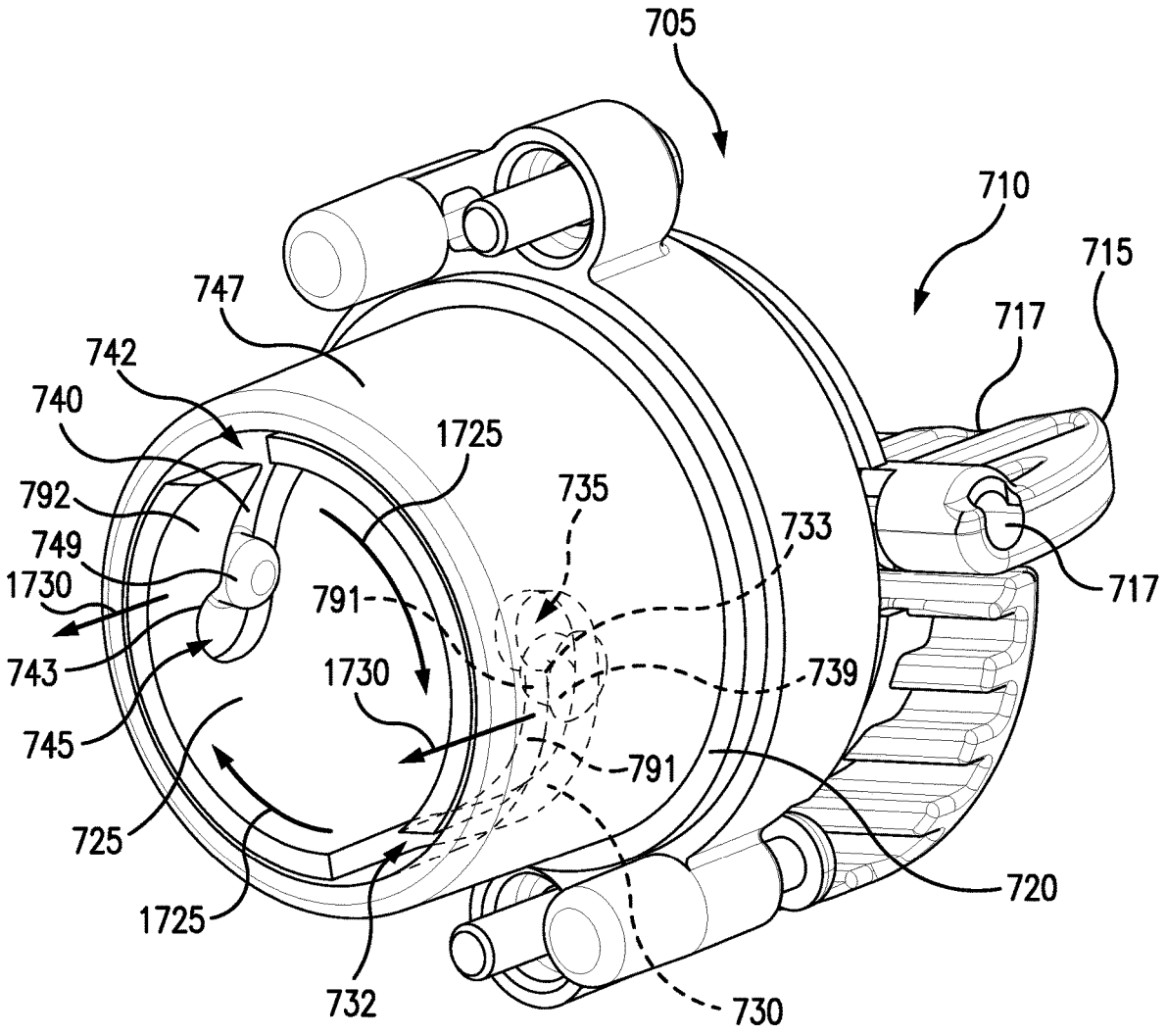
FIG. 14D is a perspective view from the bottom of an oil cap body inserted into an oil bottle adapter showing the oil cap assembly being rotated to move the first adapter post to reversibly frictionally contact and press against the first detent and the second adapter post to reversibly frictionally contact and the second detent.

FIG. 14D is a perspective view from the bottom of an oil cap body 725 inserted into an oil bottle adapter 747 showing the oil cap assembly 705 being rotated to move the first adapter post 739 to reversibly frictionally contact and press against the first detent 733 and the second adapter post 749 to reversibly frictionally contact and the second detent 743. In the example of FIG. 14D the first adapter post 739 is frictionally pressed against the first detent 733 and the second adapter post 749 is pressed against the second detent 743. At this point, the operator is imparting pressure to continue moving the oil cap assembly 705 in the direction of channel lock direction arrow 1725 and is meeting resistance to such motion from the first detent 733 and the second detent 743. In the example of FIG. 14D, the first adapter post 739 will meet resistance to motion in the direction of channel lock direction arrow 1725 from the first detent 733 and the second adapter post 749 will meet resistance to motion in the direction of channel lock direction arrow 1725 from the second detent 743.

To overcome resistance to movement in the direction of channel lock direction arrow 1725 of the oil cap assembly 705 by the first detent 733 and the second detent 743, the operator can impart an increased rotational force in the direction of channel lock direction arrow 1725. This will cause the first adapter post 739 to force the first detent 733 and first sound paddle 791 in the direction of clearance arrow 1730 and the second adapter post 749 to force the second detent 743 and second sound paddle 792 in the direction of clearance arrow 1730. The deformation of the oil cap body 725 to move the first detent 733 and second detent 743 to allow the respective clearance of the first adapter post 739 and second adapter post 749 builds up potential energy and/or a spring energy in the oil cap body 725. The deformation of the oil cap body 725 moving the first detent 733 and second detent 743 to allow the respective clearance of the first adapter post 739 and second adapter post 749 also moves the first sound paddle 791 and the second sound paddle 792 away from their resting state configuration in the general direction of clearance arrow 1730 and imparts a potential energy and/or spring energy in the respective first sound paddle 791 and the second sound paddle 792 as well as in the oil cap body 725.

When the first adapter post 739 is forced in the direction of channel lock direction arrow 1725 beyond and clears the first detent 733, the first adapter post 739 enters the first channel cavity 735. When the second adapter post 749 is forced in the direction of channel lock direction arrow 1725 beyond and clears the second detent 743, the second adapter post 749 enters the second channel cavity 745.

When the first adapter post 739 is forced in the direction of channel lock direction arrow 1725 beyond and clears the first detent 733, then the first detent 733 and the first sound paddle 791 can snap back and/or spring back into a resting state which releases the stored potential energy and/or spring energy through the return motion and generating sound. When the second adapter post 749 is forced in the direction of channel lock direction arrow 1725 beyond and clears the second detent 743, the second detent 743 and second sound paddle 792 snap back and/or spring back into a resting state which released the stored potential energy and/or spring energy through the return motion and generating sound.

The sound described herein as a "snap sound" can be generated by at least the first detent 733 and the first sound paddle 791 snapping back from an energized to a rest position. For example, in an embodiment, the release of energy from the first detent 733 and the first sound paddle 791 snapping back and/or springing back into a resting state can generate an audible and/or a snap sound letting the operator know that the oil cap assembly 705 is in a locked position. The release of energy from the second detent 743 and the second sound paddle 792 snapping back and/or springing back into a resting state can also generate a snap sound, or contribute to a combined snap sound from both the second detent 743 and the second sound paddle 792 generating sound concurrently, or in an overlapping sound event.

The snap sound can be generated by one or more detents and/or one or more respective paddles of the detents. For example, in an embodiment, the snap sound generated by the first detent 733 and the first sound paddle 791 snapping back and/or springing back into a resting state can have a sound level in a range of from 10 dB (decibels) to 150 dB, or 30 dB to 90 dB, or 40 dB to 80 dB, or 50 dB to 75 dB, or 50 dB to 90 dB, such as 40 dB, or 45 dB, or 50 dB, or 55 dB, or 60 dB, or 65 dB, or 70 dB, or 75 dB, or 80 dB. In an embodiment, the snap sound can be 50 dB, or 56 dB, or 60 dB, or 66 dB, or 70 dB, or 76 dB, or 80 dB. A release snap sound can have a value equivalent to the snap sound when the first adapter post 739 is unlocked from the first channel cavity 735 past the first detent 733 and into the first channel cavity 735.

The snap sound generated by the second detent 743 and the second sound paddle 792 snapping back and/or springing back into a resting state can have a sound level in a range of from 10 dB to 150 dB, or 30 dB to 90 dB, or 40 dB to 80 dB, or 50 dB to 75 dB, such as 40 dB, or 45 dB, or 50 dB, or 55 dB, or 60 dB, or 65 dB, or 70 dB, or 75 dB. In an embodiment, the snap sound can be 50 dB, or 56 dB, or 60 dB, or 66 dB, or 70 dB, or 76 dB, or 80 dB. A release snap sound can have a value equivalent to the snap sound when the second adapter post 749 is unlocked from the second channel cavity 745 past the second detent 743 and into the second channel cavity 745.

The snap sound generated together and/or in an overlapping fashion by the first detent 733 and the first sound paddle 791 and the by the second detent 743 and the second sound paddle 792 snapping back and/or springing back into a resting state can be combined to produce an oil cap snap sound which can have a sound level in a range of from 10 dB to 150 dB, or 30 dB to 90 dB, or 40 dB to 80 dB, or 50 dB to 75 dB, such as 45 dB, or 50 dB, or 55 dB, or 60 dB, or 65 dB, or 70 dB. In an embodiment, the snap sound can be 50 dB, or 56 dB, or 60 dB, or 66 dB, or 70 dB, or 76 dB.

In an embodiment, a snap sound or oil cap snap sound can also be generated when the oil cap assembly 705 is rotated to move one or more of an adapter post, e.g. the respective first adapter post 739 and second adaptor post 749, out of the locked position and past one or more respective detents, e.g. the first detent 733 and second detent 743. The lock release snap sound can have a combined sound level resulting from the release of one or more of an adapter post, e.g. one or both of the first adapter post 739 and second adaptor post 749 to unlock the oil cap assembly 705, in a range of from 10 dB to 150 dB, or 30 dB to 90 dB, or 40 dB to 80 dB, or 50 dB to 75 dB, such as 45 dB, or 50 dB, or 55 dB, or 60 dB, or 65 dB, or 70 dB. In an embodiment, the snap sound can be 50 dB, or 56 dB, or 60 dB, or 66 dB, or 70 dB, or 76 dB.

FIG. 14D1 is a close up view of a first embodiment of a lock channel 729. FIG. 14D1 shows a lock channel entry 1732 (e.g. first channel entry 732 and second channel entry 742) having a channel entry width 2742 into which passes an adapter post 2739 (e.g. first adapter post 739 and second adapter post 749). The adapter post 2739 meets the first channel edge 2760 in transition zone 2745 in which the direction of movement transitions from that of entry arrow 2942 to that of lock direction arrow 2929. In the example embodiment shown in FIG. 14D1, the first channel edge 2760 and the second channel edge 2770 are not parallel and are configured to have an average channel angle 2990. The average channel angle accounts for the optional curving and/or sloping of portions of each of the first channel edge 2760 and the second channel edge 2770.

The geometries of the first channel edge 2760 and the second channel edge 2770, as well as the average channel angle 2990 result in different distances between the first channel edge 2760 and the second channel edge 2770 along the lock channel length 2890 of lock channel 729. For example, the channel mouth dimension 2747 of the channel mouth 1747, is greater than the middle channel dimension 2749 of the middle channel region 1749.

The detent 2743 (e.g. first detent 733 and second detent 743) can provide a narrowing of the lock channel 729 just prior to the channel cavity 1735 (e.g. first channel cavity 735 and second channel cavity 745) or the detent 2743 can than a part of the channel cavity 1735. In FIG. 14D1 the detent 2743 has a detent height 2798 at the apex of the detent which produces a detent clearance 2799.

Optionally, as shown in the example of FIG. 14D1, the adapter post 2739 and the first channel edge 2760 can be configured to have an upper post clearance 2747. In this configuration, the adapter post 2739 can act by frictionally contacting the second channel edge 2770, but can be free of contact for at least part of the channel length from the first channel edge 2760. Optionally, in the region of the detent 2743 the adapter post 2739 can contact the second channel edge 2770 as it interacts with and passes across the detent 2743 through the detent clearance 2799.

In an embodiment, the lock channel 729 can have an average channel angle of 2990 which can have a value of 30°, or less, or in a range of from 0° to 30°, or 5° to 25°, or 8° to 25°, or 10° to 20°, or 10° to 15°, such as 5°, or 7°, or 10°, or 12°, or 15°. The lock channel 729 can also have a ramp angle 2991 which can have a value of 25°, or less, or in a range of from 0° to 25°, or 3° to 12°, or 5° to 10°, or 7° to 15°, or 10° to 15°, such as 5°, or 7°, or 8°, or 9°, or 10°, or 11°, or 12°. In an embodiment, a ramp rise 2993 can be measured prior to the detent having a value of 0 mm to 10 mm can be used, or 1 mm to 8 mm, or 3 mm to 6 mm, or 2 mm to 3 mm, such as 2 mm, 3 mm, 4 mm, 5 mm, 6 mm or 8 mm.

FIG. 14D2 is a side view of a second embodiment of a lock channel 729. In the example of FIG. 14D2, the lock channel 729 has the ramp angle 2991 and the ramp rise 2993, but does not show the detent 2743. The lock channel 729 of FIG. 14D2 is shown to have a channel cavity 1735 with a channel cavity diameter 1737, the middle channel region 1749 and the channel mouth 1747 which through which the adapter post 2739 can pass after entering the channel entry 1732. In the embodiment of FIG. 14D2, a lock channel height 1739 is shown, as well as the offset entry distance 1733, the ramp height 1734 and the cavity trough height 1736. FIG. 14D2 also shows an edge rise angle 2749 which can be measured form ramp base 2781 to the second edge 2783. Channel height 2747 can be measured from the first channel edge 2779 to the second edge 2783. The lock channel length 2890 is also shown.

Figure 14E:
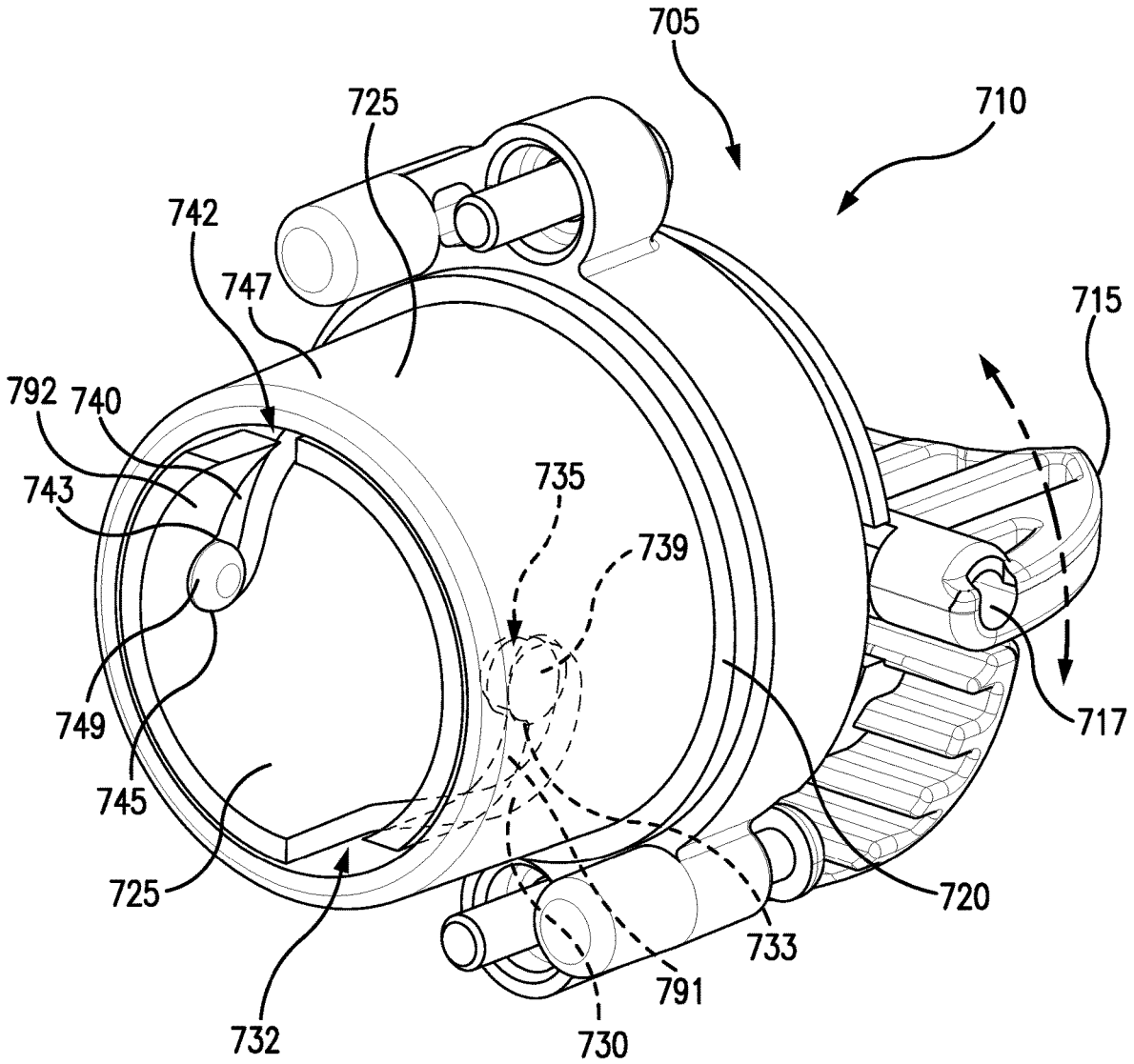
FIG. 14E is a perspective view from the bottom of an oil cap body inserted into an oil bottle adapter such that the first adapter post has moved past the first detent and into the first channel cavity and the second adapter post has moved past the second detent and into the second channel cavity.

FIG. 14E is a perspective view from the bottom of an oil cap body 725 inserted into an oil bottle adapter 747 such that the first adapter post 739 has moved past the first detent 733 and into the first channel cavity 735 and the second adapter post 749 has moved past the second detent 743 and into the second channel cavity 745. The configuration of FIG. 14E is the locked position for the oil cap assembly 705.

Figure 14F:
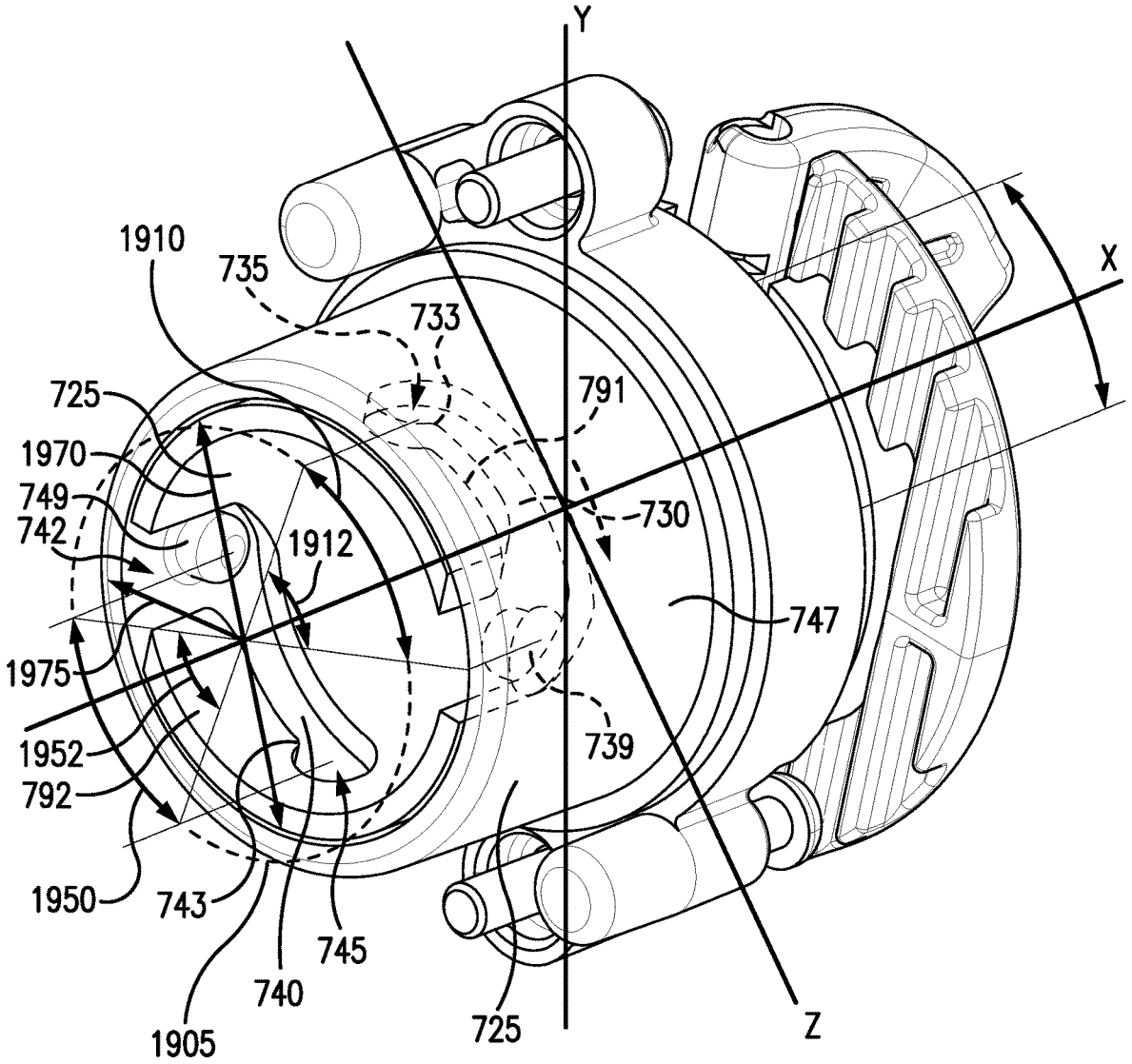
FIG. 14F is a perspective view from the bottom of an oil cap body showing an example of geometry associated with the process of engaging the oil cap assembly.

FIG. 14F is a perspective view from the bottom of an oil cap body 725 showing an example of geometry associated with the process of engaging the oil cap assembly 705 from an unlocked to a locked position. The example embodiment shown in FIG. 14F has two lock channels, i.e. a first lock channel 730 and a second lock channel 740. The oil cap body 725 has a body outer circumference 1905. The oil cap body 725 can have a number of a lock channel 729 which can range from 1 to n, where n can be a large number such as 10 or more. The number of lock channel 729 can be the same in geometry or different in geometry.

In the example of FIG. 14F, there are two of the lock channel 729 which can be located across from each other in the oil cap body 725, i.e. the first lock channel 730 having a first channel arc length 1910 and a first channel arc 1912, as well as the second lock channel 740 having a second channel arc length 1950 and a first channel arc 1952. In different embodiments, values of channel arc lengths and channel arcs can be the same or different for different lock channels.

In an embodiment, the first channel arc length 1910 can have a value which is a fraction of the oil cap body outer circumference 1905, such as a fraction in a range greater than zero and less than 50%. For example the first channel arc length 1910 can be ⅓, or ¼, or ⅕, or ⅙, or ⅛ of the length of the circumference. In one example, the oil cap 710 is a ¼ turn oil cap for which each channel arch length, e.g. the first channel arc length 1910 and/or the second channel arc length 1952 is ¼ (25%) of the oil cap body outer circumference 1905.

In other example embodiments, the first channel arch length 1910 can be in a range of 0.2 in to 6 in, or 0.25 in to 4 in, or 0.3 in to 3 in, or 0.3 in to 1.5 in, or 0.3 in to 1.0, or 0.25 in to 0.75 in, such as 0.25 in, 0.50 in, 0.75 in, 1.0 in, 1.5 in, 2.0 in, 2.5 in, 3.0 in. In an embodiment, the first channel arc 1912 can have a value which is greater than zero degrees and less than 180°, or a value in a range of 10° to 120°, or 15° to 90°, or 15° to 60°, or 20° to 60°, or 25° to 50°, or 60° to 100°, or 80° to 100°, such as 120°, or 90°, or 60°, or 45°, or 30°, or 25°.

In other example embodiments, the second channel arch length 1950 can be in a range of 0.2 in to 6 in, or 0.25 in to 4 in, or 0.3 in to 3 in, or 0.3 in to 1.5 in, or 0.3 in to 1.0, or 0.25 in to 0.75 in, such as 0.25 in, 0.50 in, 0.75 in, 1.0 in, 1.5 in, 2.0 in, 2.5 in, 3.0 in. In an embodiment, the second channel arc 1952 can have a value which is greater than zero degrees and less than 180°, or a value in a range of 10° to 120°, or 15° to 90°, or 15° to 60°, or 20° to 60°, or 25° to 50°, or 60° to 100°, or 80° to 100°, such as 120°, or 90°, or 60°, or 45°, or 30°, or 25°.

Figure 15:
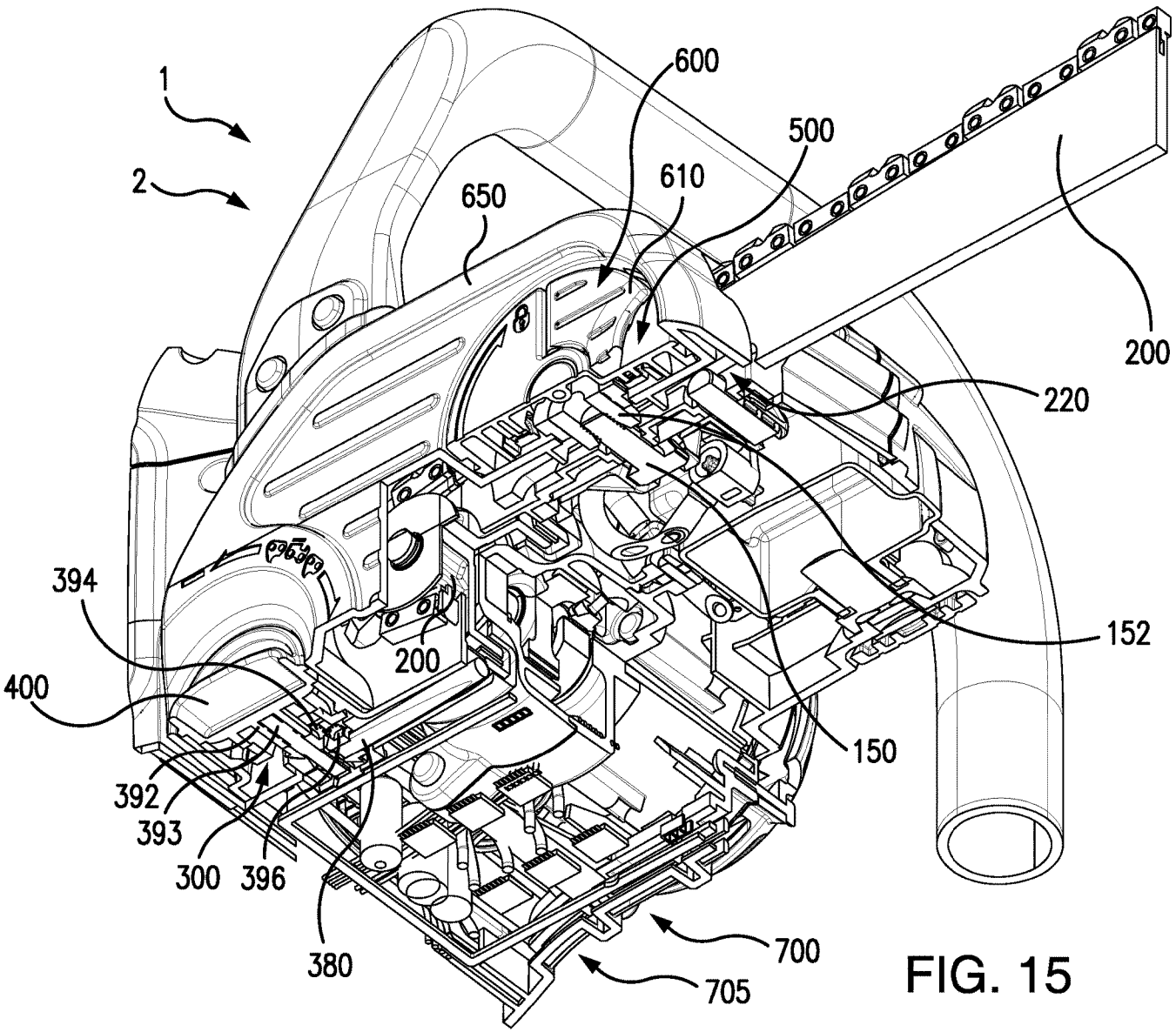
FIG. 15 is a perspective view of a chainsaw sectioned to show portions of each of the chain bar tightening clutch system, chain bar tensioning system and oil bottle assembly.

Perspective View of Relative Positions of Chainsaw Systems (e.g. FIG. 15)

FIG. 15 is a perspective view of the cordless chainsaw 2 sectioned to show portions of each of the chain bar tightening clutch system 500, chain bar tensioning system 300 and oil bottle assembly 700. FIG. 15 illustrates the low profile design achieved by use of the chain bar tightening clutch system 500 and low profile chain cover 650 with bar tightening knob handle 610 in a recessed state. FIG. 15 also illustrates the compact design achieved by using the chain bar tensioning system 300 which has the tensioning shaft 380 offset by the offset member 370 from the offset guide bar 360. Additionally, the placement of the oil bottle assembly 700 using the oil cap 710.

The scope of this disclosure is to be broadly construed. It is intended that this disclosure disclose equivalents, means, systems and methods to achieve the devices, activities and mechanical actions disclosed herein. For each mechanical element, mechanism, method and/or process disclosed, it is intended that this disclosure also encompasses in its disclosure and teaches equivalents, means, systems and methods for practicing the many aspects, mechanisms and devices disclosed herein. Additionally, this disclosure regards a chainsaw and its many aspects, features and elements. Such a chainsaw can be dynamic in its use an operation, this disclosure is intended to encompass the equivalents, means, systems and methods of the use of the tool and its many aspects consistent with the description and spirit of the operations and functions disclosed herein. The claims of this application are likewise to be broadly construed.

The description of the inventions herein in their many embodiments is merely exemplary in nature and, thus, variations that do not depart from the gist of the invention are intended to be within the scope of the invention. Such variations are not to be regarded as a departure from the spirit and scope of the invention.

We claim:

1. A method of securing a chain bar on a chainsaw, comprising the steps of:

positioning a chain bar on a chainsaw housing;

positioning a chain cover over at least a portion of the chain bar so that the chain bar is located between the chain cover and the chainsaw housing;

providing a tightening knob for tightening the chain cover against the chain bar;

providing a clutch system for the chain cover;

actuating the tightening knob to increase a force applied by the chain cover to the chain bar, whereby the clutch system activates to prevent the force from going above a predetermined level.

2. The method of securing a chain bar according to claim 1, further comprising the step of activating the clutch system to free said chain bar from receiving said force above a torque of 20 in-lbf.

3. The method of securing a chain bar according to claim 1, further comprising the step of positioning at least a portion of said chain bar between at least a portion of the chainsaw housing and at least a portion of a clutch plate.

4. A method of securing a chain bar on a chainsaw, comprising the steps of:

positioning a chain bar on a chainsaw housing;

positioning a chain cover over at least a portion of the chain bar so that the chain bar is located between the chain cover and the chainsaw housing;

providing a tightening knob for tightening the chain cover against the chain bar;

providing a clutch system for the chain cover;

rotating the tightening knob in a first direction to increase the force applied to the by the chain cover to the chain bar, whereby the clutch system activates to prevent the force from going above a predetermined level;

wherein the clutch system includes a clutch plate having a plurality of a pawl which has an inclined face, and the tightening knob includes a plurality of teeth which have an inclined face that corresponds to said pawl, so that when the tightening knob is rotated in the first direction and the predetermined force level is reached, the clutching system is activated and said plurality of said pawl rotate past said plurality of teeth.

5. The method of securing a chain bar according to claim 4, wherein said force is applied to said chain bar by at least a portion of said chain cover.

6. The method of securing a chain bar according to claim 4, wherein said force is applied to said chain bar by at least a portion of said clutch plate.

7. The method of securing a chain bar according to claim 4, wherein the chain cover includes a clutch cavity for holding the tightening knob flush with the chain cover.

8. A chain bar tightening clutch system for a chainsaw, comprising:

a chain cover for holding a chain bar against a housing;

a clutch system having a tightening state and a clutch state, and when in said tightening state said clutch system communicates an increasing force to said at least a portion of chain cover until said clutch state is activated; and when said clutch state is activated, said clutch system prevents said at least a portion of said chain bar from receiving an additional force from said chain cover during said clutch state.

9. The chain bar tightening clutch system for a chainsaw according to claim 8, wherein said clutch system has a clutch plate which imparts said force to said chain cover.

10. The chain bar tightening clutch system for a chainsaw according to claim 8, further including a tightening knob for actuating the tightening state of the clutch system.

11. The chain bar tightening clutch system for a chainsaw according to claim 10, wherein the chain cover includes a clutch cavity for holding the tightening knob flush with the chain cover.

12. The chain bar tightening clutch system for a chainsaw according to claim 9, wherein said clutch state is activated when said clutch plate receives a torque in a range of 10 in-lbf to 50 in-lbf.

* * * * *